US007108725B2

(12) United States Patent
Caswell et al.

(10) Patent No.: US 7,108,725 B2
(45) **Date of Patent: *Sep. 19, 2006**

(54) HIGHLY CONCENTRATED FABRIC SOFTENER COMPOSITIONS AND ARTICLES CONTAINING SUCH COMPOSITIONS

(75) Inventors: Debra Sue Caswell, Beijing (CN); Nabil Yaqub Sakkab, Brussels (BE); Allison Jane Danneels, Brussels (BE); Karel Pierre Marie Engels, Humbeek (BE); Ruth Anne Murphy, Hamilton, OH (US); Toan Trinh, Maineville, OH (US); Errol Hoffman Wahl, Cincinnati, OH (US); Laure Waegemans, Brussels (BE); Dominique Valeer Maria Lecluyse, Izegem (BE); Didier Gustaaf Jeanne Perot, Ghent (BE); Kurt Louis Ignoul, Hofstade (BE); Tom Danny Karl Goetry, Wortegem-Petegem (BE); Steven Louis Diersing, Cincinnati, OH (US); Gayle Marie Frankenbach, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/153,117

(22) Filed: Jun. 15, 2005

(65) Prior Publication Data

US 2005/0250670 A1 Nov. 10, 2005

Related U.S. Application Data

(63) Continuation of application No. 11/001,216, filed on Dec. 1, 2004, now Pat. No. 6,958,313, which is a continuation of application No. 09/852,940, filed on May 10, 2001, now abandoned.

(60) Provisional application No. 60/203,165, filed on May 11, 2000.

(51) Int. Cl.
*C11D 17/08* (2006.01)

(52) U.S. Cl. ..... 8/137; 510/439

(58) Field of Classification Search ..... 510/406, 510/466

See application file for complete search history.

(56) References Cited

U.S. PATENT DOCUMENTS

| | | | | |
|---|---|---|---|---|
| 3,113,674 | A | | 12/1963 | Kiefer et al. |
| 3,186,869 | A | | 6/1965 | Friedman |
| 3,322,674 | A | | 5/1967 | Friedman |
| 3,360,470 | A | | 12/1967 | Wixon |
| 3,634,260 | A | | 1/1972 | Pickin |
| 3,695,989 | A | | 10/1972 | Albert |
| 3,892,905 | A | | 7/1975 | Albert |
| 3,947,971 | A | | 4/1976 | Bauer |
| 4,018,688 | A | | 4/1977 | Pracht et al. |
| 4,082,678 | A | | 4/1978 | Pracht et al. |
| 4,108,600 | A | | 8/1978 | Wong |
| 4,416,791 | A | * | 11/1983 | Haq ..... 510/296 |
| 4,481,326 | A | | 11/1984 | Sonenstein |
| 4,547,301 | A | | 10/1985 | Ooms |
| 4,557,852 | A | | 12/1985 | Schulz et al. |
| 4,588,080 | A | | 5/1986 | Ginn |
| 4,610,799 | A | | 9/1986 | Wilsberg et al. |
| 4,680,916 | A | | 7/1987 | Ginn |
| 4,747,976 | A | | 5/1988 | Yang et al. |
| 4,765,916 | A | | 8/1988 | Ogar, Jr. et al. |
| 4,801,636 | A | | 1/1989 | Smith et al. |
| 4,806,260 | A | | 2/1989 | Broze et al. |
| 4,806,261 | A | | 2/1989 | Ciallella et al. |
| 4,851,141 | A | | 7/1989 | Demangeon et al. |
| 4,929,367 | A | | 5/1990 | Thomas et al. |
| 4,942,973 | A | | 7/1990 | Bowie |
| 4,972,017 | A | | 11/1990 | Smith et al. |
| 4,982,467 | A | | 1/1991 | Mizusawa et al. |
| 5,004,556 | A | * | 4/1991 | Julemont et al. ..... 510/304 |
| 5,078,301 | A | | 1/1992 | Gladfelter et al. |
| 5,198,198 | A | | 3/1993 | Gladfelter et al. |
| 5,234,615 | A | | 8/1993 | Gladfelter et al. |
| 5,272,003 | A | | 12/1993 | Peacock |
| 5,399,272 | A | | 3/1995 | Swartley et al. |
| 5,500,138 | A | | 3/1996 | Bacon et al. |
| 5,594,080 | A | | 1/1997 | Waymouth et al. |
| 5,759,990 | A | | 6/1998 | Wahl et al. |
| 5,863,887 | A | | 1/1999 | Gillette |
| 5,877,145 | A | | 3/1999 | Wahl et al. |
| 5,972,870 | A | | 10/1999 | Anderson |
| 6,020,425 | A | | 2/2000 | Wang et al. |
| 6,281,183 | B1 | | 8/2001 | Harbour |
| 6,958,313 | B1 | * | 10/2005 | Caswell et al. ..... 510/296 |
| 2003/0139312 | A1 | | 7/2003 | Caswell et al. |
| 2005/0079993 | A1 | | 4/2005 | Caswell et al. |

FOREIGN PATENT DOCUMENTS

| | | | | |
|---|---|---|---|---|
| WO | WO 93/04120 | A1 | | 3/1993 |
| WO | WO 94/11482 | A1 | | 5/1994 |
| WO | WO 97/03169 | A1 | | 1/1997 |
| WO | WO 97/16516 | | * | 5/1997 |
| WO | WO 98/39406 | | * | 9/1998 |
| WO | WO 98/52907 | A1 | | 11/1998 |
| WO | WO 99/40171 | A1 | | 8/1999 |
| WO | WO 00/06683 | A1 | | 2/2000 |
| WO | WO 00/55069 | A1 | | 9/2000 |
| WO | WO 01/04255 | A1 | | 1/2001 |

* cited by examiner

*Primary Examiner*—John R. Hardee
(74) *Attorney, Agent, or Firm*—David V. Upite

(57) ABSTRACT

An article comprising a polyvinyl alcohol film encapsulating a fabric care composition is useful for conditioning laundry.

20 Claims, No Drawings

HIGHLY CONCENTRATED FABRIC SOFTENER COMPOSITIONS AND ARTICLES CONTAINING SUCH COMPOSITIONS

CROSS REFERENCE TO RELATED

This patent application is a continuation is a continuation of U.S. patent application Ser. No. 11/001,216, filed Dec. 1, 2004 (now U.S. Pat. No. 6,958,313, granted Oct. 25, 2005), which is a continuation of U.S. patent application Ser. No. 09/852,940, filed May 10, 2001 (now abandoned), which claims the benefit of U.S. Provisional Application Ser. No. 60/203,165 filed May 11, 2000, (now abandoned), the disclosure of which is incorporated by reference.

TECHNICAL FIELD

The present invention relates to highly concentrated liquid fabric softening compositions, and articles containing such compositions for dispensing in a washing machine or use by handwashing to provide a softening effect to fabrics being laundered.

BACKGROUND OF THE INVENTION

Fabric softening compositions are well known for depositing fabric softening actives on fabrics during the laundry operation and thereby imparting a softened feel or effect to the laundered fabrics. Fabric softening compositions to be dispensed in the washing machine are typically formulated in bulk liquid formulations that are dispensed directly into the rinse water at the beginning of the rinse cycle or placed in a dispensing device at the beginning of the wash cycle for delayed dispensing of the composition. Unfortunately, bulk liquid formulations are well known for their instability, exhibiting undesirable viscosity characteristics (e.g., become thick and lumpy over time or even gelling) and a reduced softening effect due to poor dispersibility. In addition to the dispensing of the liquid softening composition directly into the machine, fabric softening compositions may be delivered in unit dosage forms. U.S. Pat. No. 4,082,678, Pracht et al. and U.S. Pat. No. 4,108,600 Wong, commonly assigned to The Procter & Gamble Company disclose the encapsulation of a fabric softener and/or anti-static agents in a water-soluble article that may be dispensed into the rinse bath solution. Similarly, U.S. Pat. No. 4,765,916, Ogar, Jr. et al., U.S. Pat. No. 4,801,636, Smith et al., and U.S. Pat. No. 4,972,017, Smith et al., all commonly assigned to The Clorox Company, disclose the use of a water-soluble pouch or envelope to dispense rinse bath additives. However, it has been found that when such encapsulates are dispensed by placing them in the dispensing drawer or other dispensing device incorporated into the washing machine, they tend to become highly viscous and/or form gels as water is passed through the device to dispense the composition/article. As a result, a less effective amount of the fabric softening active reaches the rinse solution and fabrics. Staining of fabrics can occur due to poor dispersiblity of the composition. Further, the consumer can be left with a most undesirable gelatinous residue in the dispenser, which may build-up with repeated use or even clog the dispensing device such that part or all of the softener composition does not reach the washing tub.

Surprisingly, it has been found that a softening composition of the present invention and an article containing such a composition minimizes residues and staining from highly concentrated fabric softener compositions. Further, because these compositions and articles are preferably virtually free of water, they also do not experience the stability and viscosity problems that are common amongst conventional liquid fabric softening formulations, especially highly concentrated conventional aqueous fabric softening compositions. In addition, the incorporation of such compositions in articles provides additional convenience, less mess, and ease of use by providing a pre-measured unitized dose of the fabric softener composition. The article may contain perfume and other desirable fabric care actives for improved fabric benefits.

SUMMARY OF THE INVENTION

The instant invention is based on the discovery that excellent fabric softening, convenience and flexibility can be achieved by dispensing an effective amount of a fabric softening composition in a rinse bath, preferably in a unitized dose form. This is accomplished in the present invention by providing a composition that comprises:

A. from about 40% to about 85%, preferably from about 50% to about 80%,and even more preferably from about 60% to about 75%, by weight of the composition of fabric softener active, preferably having a phase transition temperature of less than about 50° C., more preferably less than about 35° C., even more preferably less than about 20° C., and yet even more preferably less than about 0° C., and preferably biodegradable fabric softener actives as disclosed hereinafter;

B. optionally, but highly preferred for clear/translucent compositions, at least an effective level of principal solvent preferably having a ClogP of from about −2.0 to about 2.6, more preferably from about −1.7 to about 1.6, and even more preferably from about −1.0 to about 1.0, as defined hereinafter, typically at a level that is less than about 40%, preferably from about 1% to about 25%, more preferably from about 3% to about 15% by weight of the composition;

C. optionally, from about 0.01% to about 10% by weight, preferably from about 0.1% to about 2.5% by weight of the composition, and more preferably from about 0.2% to about 2% by weight of the composition of electrolyte as defined hereinafter;

D. optionally, but preferably, from 0% to about 20%, preferably from about 0.1% to about 15%, and more preferably from about 1% to about 10%, by weight of the composition. a phase stabilizer, preferably a nonionic surfactant, more preferably a surfactant containing alkoxylation, and also more preferably, a surfactant having an HLB of from about 8 to about 20, more preferably from about 10 to about 18, and even more preferably from about 11 to about 15, and more preferably as described hereinafter;

E. the balance water, minor ingredients and/or water-soluble solvents.

The compositions, especially the clear, or translucent liquid fabric softener compositions can optionally also contain:

(a) preferably, from 0.001% to about 15%, more preferably from about 0.1% to about 10%, and even more preferably from about 0.2% to about 8%, of perfume;

(b) principal solvent extender;

(c) cationic charge booster;

(d) other optional ingredients such as brighteners, chemical stabilizers, soil release agents, bactericides, chelating agents, silicones, and other fabric care agents;

(e) plasticizer, and (f) mixtures thereof.

Preferably, the compositions herein are virtually non-aqueous, translucent or clear, preferably clear, highly concentrated compositions.

The preferred principal solvent and/or electrolyte levels, as well as the identity of the principal solvent, are selected normally according to the level and identity of the softener.

The pH of the compositions, especially those containing the preferred softener actives comprising an ester linkage, should be from about 1 to about 5, preferably from about 2 to about 4, and more preferably from about 2.7 to about 3.5.

The present invention likewise provides an article containing a unitized dose of such a softener composition that may be used to provide an excellent softening effect and convenience, the article comprising an effective amount of a highly concentrated fabric softening composition as summarized above, and a coating, film, encapsulate or carrier for the concentrated fabric softening composition that is at least partially water-soluble . The coating/carrier is preferably selected from the group consisting of hard gelatin, soft gelatin, polyvinyl alcohol, hydroxypropyl methylcellulose, polyvinyl pyrrolidone, zeolites, waxy polymers, sugar, sugar derivatives, starch, starch derivatives, effervescing materials, and mixtures thereof. The amount of the concentrated fabric softening composition contained within the article can vary between about 2 ml and about 25 ml when the fabric softening composition is in a liquid or other flowable form. The article can also be in the form of a tablet or effervescing tablet or ball.

DETAILED DESCRIPTION OF THE INVENTION

A. Fabric Softener Actives

The compositions and articles of the present invention contain as an essential component from about 40% to about 85%, preferably from about 50% to about 80%, and even more preferably from about 60% to about 75% by weight of the composition, of a fabric softener active, either the conventional ones, or, preferably, the preferred ones selected from the compounds identified hereinafter, and mixtures thereof for liquid rinse-added fabric softener compositions.

Examples of suitable amine softeners that can be used in the present invention are disclosed in copending U.S. Ser. No. 09/463,103, filed Jul. 29, 1997, for CONCENTRATED, STABLE, PREFERABLY CLEAR, FABRIC SOFTENING COMPOSITION CONTAINING AMINE FABRIC SOFTENER by K. A. Grimm, D. R. Bacon, T. Trinh, E. H. Wahl, and H. B. Tordil, said application being incorporated herein by reference.

Concentrated clear compositions containing ester and/or amide linked fabric softening actives are disclosed in U.S. Pat. No. 5,759,990, issued Jun. 2, 1998 in the names of E. H. Wahl, H. B. Tordil, T. Trinh, E. R. Carr, R. O. Keys, and L. M. Meyer, for Concentrated Fabric Softening Composition With Good Freeze/Thaw Recovery and Highly Unsaturated Fabric Softener Compound Therefor, and in U. S. Pat. No. 5,747,443, issued May 5, 1998 in the names of Wahl, Trinh, Gosselink, Letton, and Sivik for Fabric Softening Compound/Composition, said patents being incorporated herein by reference. The fabric softener actives in said patents are preferably biodegradable ester-linked materials, containing, long hydrophobic groups with unsaturated chains. Similar clear liquid fabric softening compositions are described in WO 97/03169, incorporated herein by reference, which describes the formulation of liquid fabric softening compositions.

When a clear or translucent concentrated liquid fabric softening composition is desired, the composition will normally use a highly unsaturated and/or branched fabric softener active, preferably biodegradable, selected from the highly unsaturated and/or branched fabric softening actives identified hereinafter, and mixtures thereof. These highly unsaturated and/or branched fabric softening actives have the required properties for permitting high usage levels. Specifically, when deposited at high levels on fabrics, the highly unsaturated and/or branched fabric softening actives do not create a "greasy/oily" feel like the more conventional more fully saturated softener compounds. Moreover, the highly unsaturated and/or branched fabric softening actives provide fabrics which have excellent water absorbency after being dried. Other fabric softener actives that provide fabric softening and good water absorbency can also be used in the fabric softener compositions and processes of the present invention. Water absorbency, as measured by the Horizontal Gravimetric Wicking (HGW) test, as described herein after, of cotton terries treated at high usage levels with softener compositions of this invention should be at least about 75%, preferably at least about 85%, more preferably about 100%, and even more preferably more than about 100%, as absorbent as cotton terries not treated with a fabric softener composition. This relative water absorbency is referred to hereinafter as the HGW relative water absorbency. Furthermore, the preferred clear fabric conditioner compositions disclosed herein allow high level usage with minimal fabric staining which is commonly observed for conventional fabric softener compositions when used at high levels. The benefits provided by high usage include superior softness, static control, and, especially, maintenance of fabric appearance including recovery of fabric color appearance, improved color integrity, and anti-wrinkling benefits. Color maintenance has become an important attribute in the consumer's mind. Colored garments that are otherwise wearable, are often discarded, or not worn, because they look unacceptable. This invention provides improved appearance to garments, especially cotton, which is currently the preferred fabric. The greatest improvement is observed when the fabrics are dried in a conventional automatic tumble dryer.

Preferred fabric softeners of the invention comprise a majority of compounds as follows:

The unsaturated compounds preferably have at least about 3%, e.g., from about 3% to about 30%, of softener active containing polyunsaturated groups. Normally, one would not want polyunsaturated groups in actives, since they tend to be much more unstable than even monounsaturated groups. The presence of these highly unsaturated materials makes it highly desirable, and for the preferred higher levels of polyunsaturation, essential, that the highly unsaturated and/or branched fabric softening actives and/or compositions herein contain antibacterial agents, antioxidants, chelants, and/or reducing materials, to protect the actives from degradation. While polyunsaturation involving 2 double bonds (e.g., linoleic acid) is favored, polyunsaturation of 3 double bonds (linolenic acid) is not. It is preferred that the C18:3 level of the precursor fatty acid be less than about 3%, more preferably less than about 1%, and most preferably about 0%. The long chain hydrocabon groups can also comprise branched chains, e.g., from isostearic acid, for at least part of the groups. The total of active represented by the branched chain groups, when they are present, is typically from about 1% to about 100%, preferably from about 10% to about 70%, more preferably from about 20% to about 50%.

Typical levels of incorporation of the softening compound (active) in the softening composition are of from about 40% to about 85% by weight, preferably from about 50% to about 80%, and even more preferably from about 60% to about 75%, by weight of the composition. The fabric softener compound preferably has a phase transition temperature of less than about 50° C. more preferably less than about 35° C., even more preferably less than about 20° C., and yet even more preferably less than about 0° C., and preferably is biodegradable as disclosed hereinafter. The IV of the fatty acid precursor is from about 40 to about 140, preferably from about 50 to about 120 and even more preferably from about 85 to about 105. Preferably the cis:trans isomer ratio of the fatty acid precursor (of the C18:1 component) is at least about 1:1, preferably about 2:1, more preferably about 3:1, and even more preferably about 4:1, or higher.

The softener active can be selected from cationic, nonionic, zwitterionic. and/or amphoteric fabric softening compounds. Typical of the cationic softening compounds are the quaternary ammonium compounds or amine precursors thereof as defined hereinafter.

Preferred Diester Quaternary Ammonium Fabric Softening Active Compound (DEQA)

(1) The first type of DEQA preferably comprises, as the principal active, [DEQA (1)] compounds of the formula $$\{R_{4-m}—N^+—[(CH_2)_n—Y—R^1]_m\}X^-$$

wherein each R substituent is either hydrogen, a short chain $C_1$–$C_6$, preferably $C_1$–$C_3$ alkyl or hydroxyalkyl group, e.g., methyl (most preferred), ethyl, propyl, hydroxyethyl, and the like, poly ($C_{2-3}$ alkoxy), preferably polyethoxy, group, benzyl, or mixtures thereof; each m is 2 or 3; each n is from 1 to about 4, preferably 2; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$–$C_{22}$, preferably $C_{14}$–$C_{20}$, with each $R^1$ being a hydrocarbyl, or substituted hydrocarbyl group, and $X^-$ can be any softener-compatible anion, preferably, chloride, bromide, methylsulfate, ethylsulfate, sulfate, and nitrate, more preferably chloride or methyl sulfate (As used herein, the "percent of softener active" containing a given $R^1$ group is based upon taking a percentage of the total active based upon the percentage that the given $R^1$ group is, of the total $R^1$ groups present.);

(2) A second type of DEQA active [DEQA (2)] has the general formula:

$$[R_3N^+CH_2CH(YR^1)(CH_2YR^1)]X^-$$

wherein each Y, R, $R^1$, and $X^-$ have the same meanings as before. Such compounds include those having the formula:

$$[CH_3]_3N^{(+)}[CH_2CH(CH_2O(O)CR^1)O(O)CR^1]C1^{(-)}$$

wherein each R is a methyl or ethyl group and preferably each $R^1$ is in the range of $C_{15}$ to $C_{19}$. As used herein, when the diester is specified, it can include the monoester that is present. The amount of monoester that can be present is the same as in DEQA (1).

These types of agents and general methods of making them are disclosed in U.S. Pat. No. 4,137,180, Naik et al., issued Jan. 30, 1979, which is incorporated herein by reference. An example of a preferred DEQA (2) is the "propyl" ester quaternary ammonium fabric softener active having the formula 1,2-di(acyloxy)-3-trimethylammoniopropane chloride, where the acyl is the same as that of $FA^1$ disclosed hereinafter.

Some preferred clear fabric softening compositions of the present invention contain as an essential component from about 40% to about 85%, preferably from about 50% to about 80%, and even more preferably from about 60% to about 75% by weight of the composition, of softener active having the formula:

$$[R^1C(O)OC_2H_4]_mN^+(R)_{4-m}X^-$$

wherein each $R^1$ in a compound is a $C_6$–$C_{22}$ hydrocarbyl group, preferably having an IV from about 70 to about 140 based upon the IV of the equivalent fatty acid with the cis/trans ratio preferably being as described hereinafter, m is a number from 1 to 3 on the weight average in any mixture of compounds, each R in a compound is a $C_{1-3}$ alkyl or hydroxy alkyl group, the total of m and the number of R groups that are hydroxyethyl groups equaling 3, and X is a softener compatible anion, preferably methyl sulfate. Preferably the cis:trans isomer ratio of the fatty acid (of the C18:1 component) is at least about 1:1, preferably about 2:1, more preferably about 3:1, and even more preferably about 4:1, or higher.

Additional preferred fabric softening compositions will comprise a softener active having the formula:

$$R^1—C(O)O—R^2—N^+(R^4)_n—R^3—N(H)—C(O)—R^1X^-$$

wherein n is 1 or 2; $R^1$ is a $C_6$–$C_{22}$, preferably a $C_8$–$C_{20}$, hydrocarbyl group or substituted hardrocarbyl groups that branched or unbranched and having an IV from about 70 to about 140 based upon the IV of the equivalent fatty acid with the cis/trans ratio that is at least about 1:1, preferably about 2:1, more preferably about 3:1, and even more preferably about 4:1, or higher; $R^2$ and $R^3$ are each $C_1$–$C_5$, preferably $C_2$–$C_3$, alkyl or alkylene groups; and $R^4$ is H, or a $C_1$–$C_3$ alkyl or hydroxyalkyl group. Non-limiting examples of such softeners are described in U.S. Pat. Nos. 5,580,481 and 5,476,597, issued Dec. 3, 1996 and Dec. 19, 1995 respectively, both to Sakata et al., both of which are incorporated herein by reference.

These preferred compounds, or mixtures of compounds, have (a) either a Hunter "L" transmission of at least about 85, typically from about 85 to about 95, preferably from about 90 to about 95, more preferably above about 95, if possible, or (b) only low, relatively non-detectable levels, at the conditions of use, of odorous compounds selected from the group consisting of: isopropyl acetate; 2,2'-ethylidenebis (oxy)bis-propane; 1,3,5-trioxane; and/or short chain fatty acid (4–12, especially 6–10, carbon atoms) esters, especially methyl esters; or (c) preferably, both.

The Hunter L transmission is measured by (1) mixing the softener active with solvent at a level of about 10% of active, to assure clarity, the preferred solvent being ethoxylated (one mole EO) 2,2,4-trimethyl-1,3-pentanediol and (2) measuring the L color value against distilled water with a Hunter ColorQUEST® colorimeter made by Hunter Associates Laboratory, Reston, Va.

The level of odorant is defined by measuring the level of odorant in a headspace over a sample of the softener active. Chromatograms are generated using about 200 mL of head space sample over about 2.0 grams of sample. The head space sample is trapped on to a solid absorbent and thermally desorbed onto a column directly via cryofocussing at about −100° C. The identifications of materials is based on the peaks in the chromatograms. Some impurities identified are related to the solvent used in the quaternization process, (e.g., ethanol and isopropanol). The ethoxy and methoxy ethers are typically sweet in odor. There are $C_6$–$C_8$ methyl esters found in a typical current commercial sample, but not in the typical softener actives of this invention. These esters contribute to the perceived poorer odor of the current commercial samples. The level of each odorant in ng/L found in the head space over a preferred active is as follows: Isopropyl acetate—<1; 1,3,5-trioxane—5; 2,2'-ethylidenebis(oxy)-bispropane—<1; $C_6$ methyl ester—<1; $C_8$ Methyl ester—<1; and $C_{10}$ Methyl ester—<1. odorant The acceptable level of each odorant is as follows: isopropyl acetate should be less than about 5, preferably less than about 3, and more preferably less than about 2, nanograms per liter (ηg/L.); 2,2'-ethylidenebis(oxy)bis-propane should be less than about 200, preferably less than about 100, more preferably less than about 10, and even more preferably less than about 5, nanograms per liter (ηg/L.); 1,3,5-trioxane should be less than about 50, preferably less than about 20, more preferably less than about 10, and even more preferably less than about 7, nanograms per liter (ηg/L.); and/or each short chain fatty acid (4–12, especially 6–10, carbon atoms) ester, especially methyl esters should be less than about 4, preferably less than about 3, and more preferably less than about 2, nanograms per liter (ηg/L.).

The elimination of color and odor materials can either be accomplished after formation of the compound, or, preferably, by selection of the reactants and the reaction conditions. Preferably, the reactants are selected to have good odor and color. For example, it is possible to obtain fatty acids, or their esters, for sources of the long fatty acyl group, that have good color and odor and which have extremely low levels of short chain ($C_{4-12}$, especially $C_{6-10}$) fatty acyl groups. Also, the reactants can be cleaned up prior to use. For example, the fatty acid reactant can be double or triple distilled to remove color and odor causing bodies and remove short chain fatty acids. Additionally, the color of the triethanolamine reactant needs to be controlled to a low color level (e.g. a color reading of about 20 or less on the APHA scale). The degree of clean up required is dependent on the level of use and the presence of other ingredients. For example, adding a dye can cover up some colors. However, for clear and/or lightly colored products, the color must be almost non-detectable. This is especially true for higher levels of active, e.g., from about 40% to about 85%, preferably from about 50% to about 80%, and even more preferably from about 60% to about 75% of the softener active by weight of the composition. Similarly, the odor can be covered up by higher levels of perfume, but at the higher levels of softener active there is a relatively high cost associated with such an approach, especially in terms of having to compromise the odor quality. Higher levels of perfume can also cause the composition to be more colored, especially yellow colored, which is undesirable. Odor quality can be further improved by use of ethanol as the quaternization reaction solvent.

A preferred biodegradable fabric softener compounds comprises quaternary ammonium salt, the quaternized ammonium salt being a quaternized product of condensation between:

a) a fraction of saturated or unsaturated, linear or branched fatty acids, or of derivatives of said acids, said fatty acids or derivatives each possessing a hydrocarbon chain in which the number of atoms is between 5 and 21, and b)-triethanolamine, characterized in that said condensation product has an acid value, measured by titration of the condensation product with a standard KOH solution against a phenolphthalein indicator, of less than about 6.5.

The acid value is preferably less than or equal to about 5, more preferably less than about 3. Indeed, the lower the AV, the better softness performance is obtained.

The acid value is determined by titration of the condensation product with a standard KOH solution against a phenolphthalein indicator according to ISO#53402. The AV is expressed as mg KOH/g of the condensation product.

For optimum softness benefit, it is preferred that the reactants are present in a molar ratio of fatty acid fraction to triethanolamine of from about 1:1 to about 2.5:1.

It has also been found that the optimum softness performance is also affected by the detergent carry-over laundry conditions, and more especially by the presence of the anionic surfactant in the solution in which the softening composition is used. Indeed, the presence of anionic surfactant that is usually carried over from the wash will interact with the softener compound, thereby reducing its performance. Thus, depending on usage conditions, the mole ratio of fatty acid/triethanolamine can be critical. Accordingly, where no rinse occurs between the wash cycle and the rinse cycle containing the softening compound, a high amount of anionic surfactant will be carried over in the rinse cycle containing the softening compound. In this instance, it has been found that a fatty acid fraction/triethanolamine mole ratio of about 1.4:1 to about 1.8:1 is preferred. By high amount of anionic surfactant, it is meant that the presence of anionic in the rinse cycle at a level such that the molar ratio anionic surfactant/cationic softener compound of the invention is at least about 1:10.

A method of treating fabrics comprises the step of contacting the fabrics in an aqueous medium containing the above softener compounds or softening composition wherein the fatty acid/triethanolamine mole ratio in the softener compound is from about 1.4:1 to about 1.8:1, preferably about 1.5:1 and the aqueous medium comprises a molar ratio of anionic surfactant to said softener compound of the invention of at least about 1:10.

When an intermediate rinse cycle occurs between the wash and the later rinse cycle, less anionic surfactant, i.e. less than about 1:10 of a molar ratio anionic surfactant to cationic compound of the invention, will then be carried over. Accordingly, it has been found that a fatty acid/triethanolamine mole ratio of about 1.8:1 to about 2.2:1 is then preferred. When the method of treating fabrics comprises the step of contacting the fabrics in an aqueous medium containing the softener compound of the invention or softening composition thereof wherein the fatty acid/triethanolamine mole ratio in the softener compound is from about 1.8:1 to about 2:1, preferably about 2.0:1, and most preferably about 1.9, and the aqueous medium comprises a molar ratio of anionic surfactant to said softener compound of the invention of less than about 1:10.

In a preferred embodiment the fatty acid fraction and the triethanolamine are present in a molar ratio of from about 1:1 to about 2.5:1.

Preferred cationic, preferably biodegradable, quaternary ammonium fabric softening compounds can contain the group —(O)$CR^1$ which is derived from animal fats, unsaturated, and polyunsaturated, fatty acids, e.g., oleic acid, and/or partially hydrogenated fatty acids, derived from vegetable oils and/or partially hydrogenated vegetable oils, such as, canola oil, safflower oil, peanut oil, sunflower oil, corn oil, soybean oil, tall oil, rice bran oil, etc. Non-limiting examples of fatty acids (FA) are listed in U.S. Pat. No. 5,759,990 at column 4, lines 45–66.

Mixtures of fatty acids, and mixtures of FAs that are derived from different fatty acids can be used, and are preferred. Nonlimiting examples of FA's that can be blended, to form FA's of this invention are as follows:

| Fatty Acyl Group | $FA^1$ | $FA^2$ | $FA^3$ |
|---|---|---|---|
| $C_{14}$ | 0 | 0 | 1 |
| $C_{16}$ | 3 | 11 | 25 |
| $C_{18}$ | 3 | 4 | 20 |
| C14:1 | 0 | 0 | 0 |
| C16:1 | 1 | 1 | 0 |
| C18:1 | 79 | 27 | 45 |
| C18:2 | 13 | 50 | 6 |
| C18:3 | 1 | 7 | 0 |
| Unknowns | 0 | 0 | 3 |
| Total | 100 | 100 | 100 |
| IV | 99 | 125–138 | 56 |
| cis/trans (C18:1) | 5–6 | Not Available | 7 |
| TPU | 14 | 57 | 6 |

$FA^1$ is a partially hydrogenated fatty acid prepared from canola oil,
$FA^2$ is a fatty acid prepared from soy bean oil, and
$FA^3$ is a slightly hydrogenated tallow fatty acid.

Preferred softener actives contain an effective amount of molecules containing two ester linked hydrophobic groups [$R^1C(CO)O$—], said actives being referred to hereinafter as "DEQA's", are those that are prepared as a single DEQA from blends of all the different fatty acids that are represented (total fatty acid blend), rather than from blends of mixtures of separate finished DEQA's that are prepared from different portions of the total fatty acid blend.

It is preferred that at least a majority of the fatty acyl groups are unsaturated, e.g., from about 50% to 100%, preferably from about 55% to about 99%, more preferably from about 60% to about 98%, and that the total level of active containing polyunsaturated fatty acyl groups (TPU) be preferably from 0% to about 30%. The cis/trans ratio for the unsaturated fatty acyl groups is usually important, with the cis/trans ratio being from about 1:1 to about 50:1, the minimum being about 1:1, preferably at least about 3:1, and more preferably from about 4:1 to about 20:1. (As used herein, the "percent of softener active" containing a given $R^1$ group is the same as the percentage of that same $R^1$ group is to the total $R^1$ groups used to form all of the softener actives.)

The unsaturated, including the preferred polyunsaturated, fatty acyl and/or alkylene groups, discussed hereinbefore and hereinafter, surprisingly provide effective softening, but also provide better rewetting characteristics, good antistatic characteristics, and especially, superior recovery after freezing and thawing.

The highly unsaturated materials are also easier to formulate into concentrated premixes that maintain a low viscosity for the neat product composition and are therefore easier to process, e.g., pump, mixing, etc. These highly unsaturated materials (total level of active containing polyunsaturated fatty acyl groups (TPU) being typically from about 3% to about 30%, with only the low amount of solvent that normally is associated with such materials, i.e., from about 5% to about 20%, preferably from about 8% to about 25%, more preferably from about 10% to about 20%, weight of the total softener/solvent mixture, are also easier to formulate into concentrated, stable compositions of the present invention, even at ambient temperatures. This ability to process the actives at low temperatures is especially important for the polyunsaturated groups, since it minimizes degradation. Additional protection against degradation can be provided when the compounds and softener compositions contain effective antioxidants, chelants, and/or reducing agents, as disclosed hereinafter.

It will be understood that substituents R and $R^1$ can optionally be substituted with various groups such as alkoxyl or hydroxyl groups, and can be straight, or branched so long as the $R^1$ groups maintain their basically hydrophobic character.

A preferred long chain DEQA is the DEQA prepared from sources containing high levels of polyunsaturation, i.e., N,N-di(acyl-oxyethyl)-N,N-methylhydroxyethylammonium methyl sulfate, where the acyl is derived from fatty acids containing sufficient polyunsaturation, e.g., mixtures of tallow fatty acids and soybean fatty acids. Another preferred long chain DEQA is the dioleyl (nominally) DEQA, i.e., DEQA in which N,N-di(oleoyl-oxyethyl)-N,N-methylhydroxyethylammonium methyl sulfate is the major ingredient. Preferred sources of fatty acids for such DEQAs are vegetable oils, and/or partially hydrogenated vegetable oils, with high contents of unsaturated, e.g., oleoyl groups, such as canola oil.

As used herein, when the DEQA diester (m=2) is specified, it can include the monoester (m=1) and/or triester (m=3) that are present. Preferably, at least about 30% of the DEQA is in the diester form, and from 0% to about 30% can be DEQA monoester, e.g., there are three R groups and one $R^1$ group. For softening, under no/low detergent carry-over laundry conditions the percentage of monoester should be as low as possible, preferably no more than about 15%. However, under high, anionic detergent surfactant or detergent builder carry-over conditions, some monoester can be preferred. The overall ratios of diester "quaternary ammonium active" (quat) to monoester quat are from about 2.5:1 to about 1:1, preferably from about 2.3:1 to about 1.3:1. Under high detergent carry-over conditions, the di/monoester ratio is preferably about 1.3:1. The level of monoester present can be controlled in manufacturing the DEQA by varying the ratio of fatty acid, or fatty acyl source, to triethanolamine. The overall ratios of diester quat to triester quat are from about 10:1 to about 1.5:1, preferably from about 5:1 to about 2.8:1.

The above compounds can be prepared using standard reaction chemistry. In one synthesis of a di-ester variation of DTDMAC, triethanolamine of the formula $N(CH_2CH_2OH)_3$ is esterified, preferably at two hydroxyl groups, with an acid chloride of the formula $R^1C(O)Cl$, to form an amine which can be made cationic by acidification (one R is H) to be one type of softener, or then quaternized with an alkyl halide, RX, to yield the desired reaction product (wherein R and $R^1$ are as defined hereinbefore). However, it will be appreciated by those skilled in the chemical arts that this reaction sequence allows a broad selection of agents to be prepared.

In preferred DEQA (1) and DEQA (2) softener actives, each $R^1$ is a hydrocarbyl, or substituted hydrocarbonyl group, preferably, alkyl, monounsaturated alkenyl, and polyunsaturated alkenyl groups, with the softener active containing polyunsaturated alkenyl groups being preferably at least about 3%, more preferably at least about 5%, more preferably at least about 10%, and even more preferably at least about 15%, by weight of the total softener active present; the actives preferably containing mixtures of $R^1$ groups, especially within the individual molecules.

The DEQAs herein can also contain a low level of fatty acid, which can be from unreacted starting material used to form the DEQA and/or as a by-product of any partial degradation (hydrolysis) of the softener active in the finished composition. It is preferred that the level of free fatty acid be low, preferably below about 15%, more preferably below about 10%, and even more preferably below about 5%, by weight of the softener active.

The fabric softener actives herein are preferably prepared by a process wherein a chelant, preferably a diethylenetriaminepentaacetate (DTPA) and/or an ethylene diamine-N, N-disuccinate (EDDS) is added to the process. Another acceptable chelant is tetrakis-(2-hydroxylpropyl) ethylenediamine (TPED). Also, preferably, antioxidants are added to the fatty acid immediately after distillation and/or fractionation and/or during the esterification reactions and/or post-added to the finished softener active. The resulting softener active has reduced discoloration and malodor associated therewith.

The total amount of added chelating agent is preferably within the range of from about 10 ppm to about 5,000 ppm, more preferably within the range of from about 100 ppm to about 2500 ppm by weight of the formed softener active. The source of triglyceride is preferably selected from the group consisting of animal fats, vegetable oils, partially hydrogenated vegetable oils, and mixtures thereof. More preferably, the vegetable oil or partially hydrogenated vegetable oil is selected from the group consisting of canola oil, partially hydrogenated canola oil, safflower oil, partially hydrogenated safflower oil, peanut oil, partially hydrogenated peanut oil, sunflower oil, partially hydrogenated sunflower oil, corn oil, partially hydrogenated corn oil, soybean oil, partially hydrogenated soybean oil, tall oil, partially hydrogenated tall oil, rice bran oil, partially hydrogenated rice bran oil, and mixtures thereof. Most preferably, the source of triglyceride is canola oil, partially hydrogenated canola oil, and mixtures thereof. The process can also include the step of adding from about 0.01% to about 2% by weight of the composition of an antioxidant compound to any or all of the steps in the processing of the triglyceride up to, and including, the formation of the fabric softener active, and/or even after formation of the fabric softener active.

The above processes produce a fabric softener active with reduced coloration and malodor.

(3) Polyquaternary Ammonium Compounds.

The following polyquaternary ammonium compounds are disclosed by reference herein as suitable for use in this invention:

European Patent Application EP 0,803,498, A1, Robert O. Keys and Floyd E. Friedli, filed Apr. 25, 1997; British Pat. 808,265, issued Jan. 28, 1956 to Arnold Hoffman & Co., Incorporated; British Pat. 1,161,552, Koebner and Potts, issued Aug. 13, 1969; DE 4,203,489 A1, Henkel, published Aug. 12, 1993; EP 0,221,855, Topfl, Heinz, and Jorg, issued Nov. 3, 1986; EP 0,503,155, Rewo, issued Dec. 20, 1991; EP 0,507,003, Rewo, issued Dec. 20, 1991; EPA 0,803,498, published Oct. 29, 1997; French Pat. 2,523,606, Marie-Helene Fraikin, Alan Dillarstone, and Marc Couterau, filed Mar. 22, 1983; Japanese Pat. 84-273918, Terumi Kawai and Hiroshi Kitamura, 1986; Japanese Pat. 2-011,545, issued to Kao Corp., Jan. 16, 1990; U.S. Pat. No. 3,079,436, Hwa, issued Feb. 26, 1963; U.S. Pat. No. 4,418,054, Green et al., issued Nov. 29, 1983; U.S. Pat. No. 4,721,512, Topfl, Abel, and Binz, issued Jan. 26, 1988; U.S. Pat. No. 4,728,337, Abel, Topfl, and Riehen, issued Mar. 1, 1988; U.S. Pat. No. 4,906,413, Topfl and Binz, issued Mar. 6, 1990; U.S. Pat. No. 5,194,667, Oxenrider et al., issued Mar. 16, 1993; U.S. Pat. No. 5,235,082, Hill and Snow, issued Aug. 10, 1993; U.S. Pat. No. 5,670,472, Keys, issued Sep. 23, 1997; Weirong Miao, Wei Hou, Lie Chen, and Zongshi Li, Studies on Multifunctional Finishing Agents, Riyong Huaxue Gonye, No. 2, pp. 8–10, 1992; Yokagaku, Vol. 41, No. 4 (1992); and Disinfection, Sterilization, and Preservation, 4th Edition, published 1991 by Lea & Febiger, Chapter 13, pp. 226–30. All of these references are incorporated herein, in their entirety, by reference. The products formed by quaternization of reaction products of fatty acid with N,N,N',N', tetraakis(hydroxyethyl)-1,6-diaminohexane are also disclosed as suitable for this invention. Some nonlimiting structural examples produced by this reaction are given below:

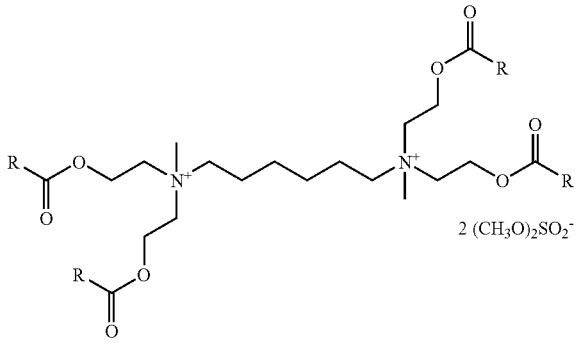

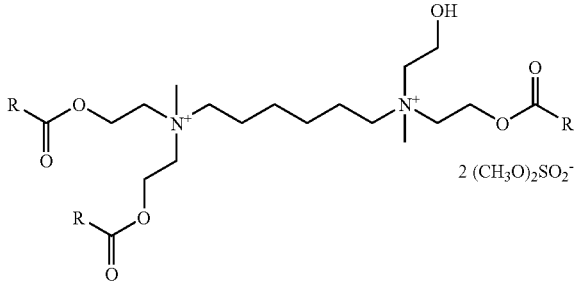

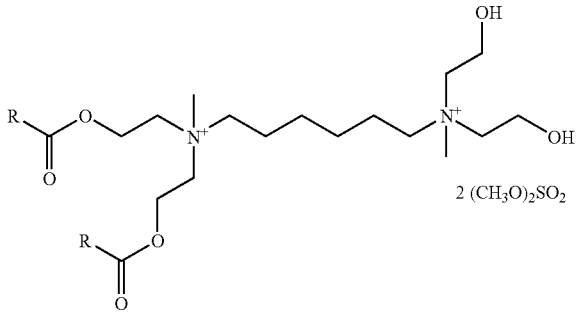

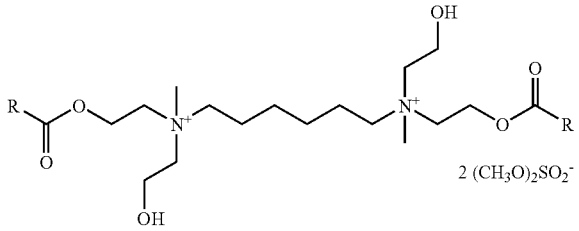

-continued
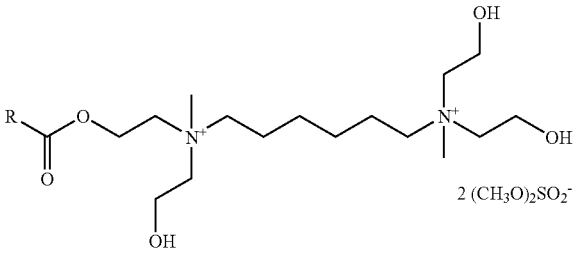
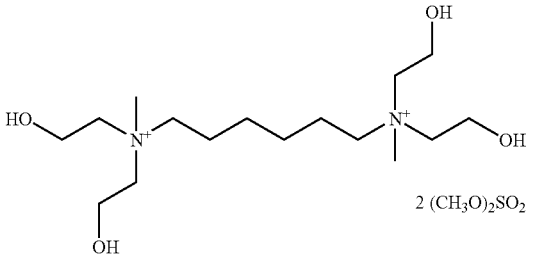
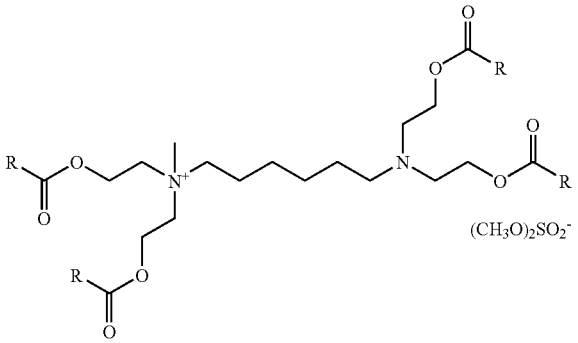
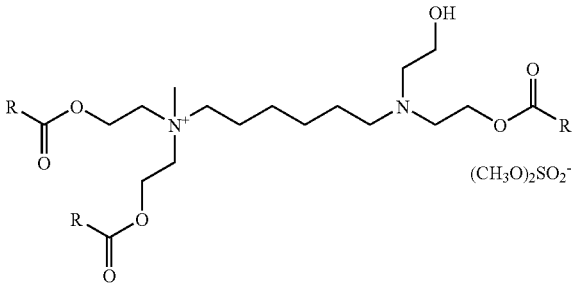
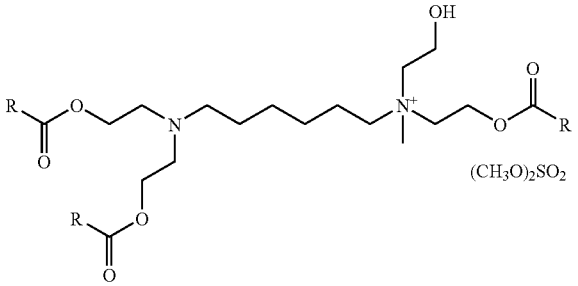
-continued
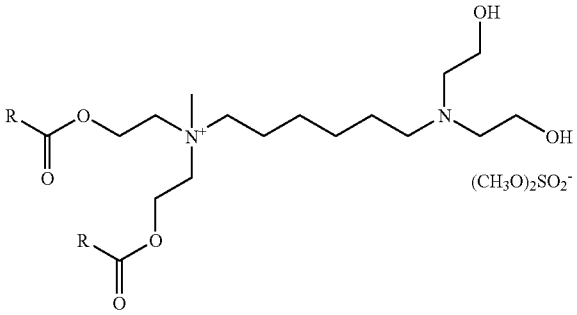
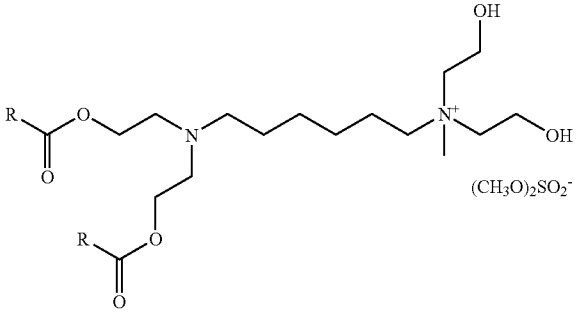
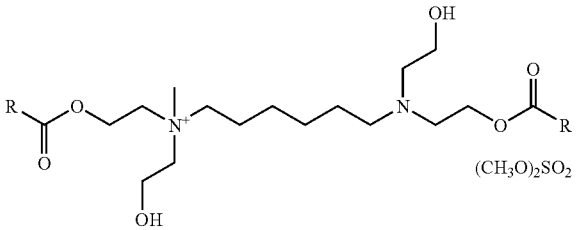
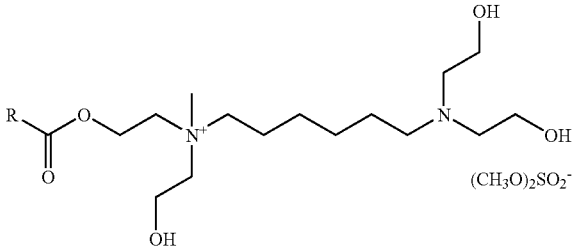
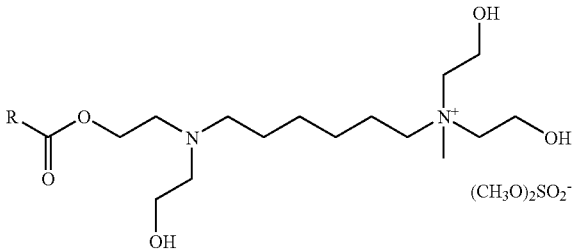
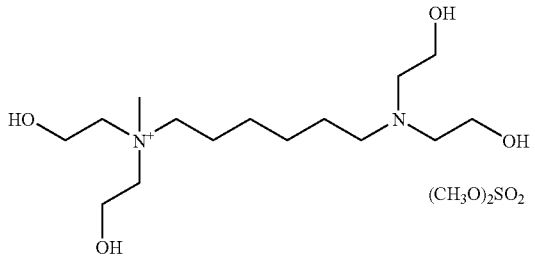

-continued

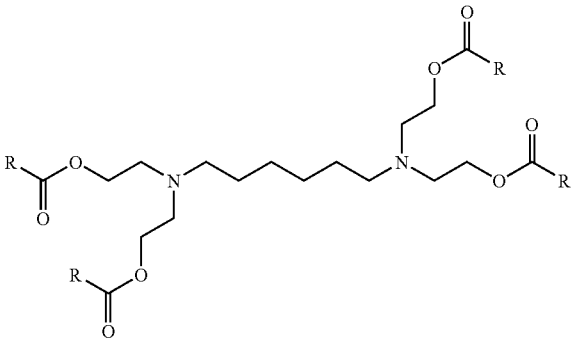

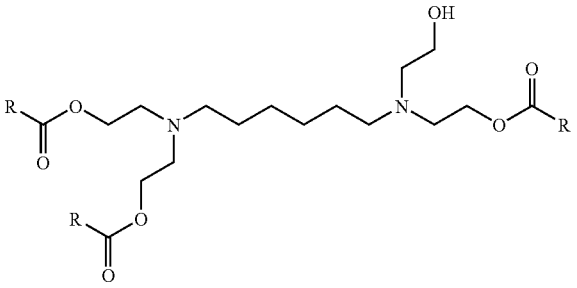

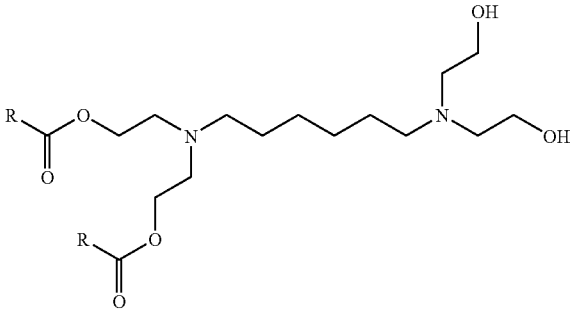

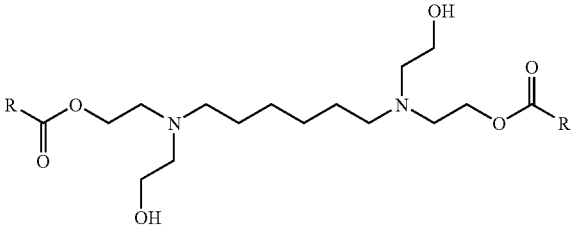

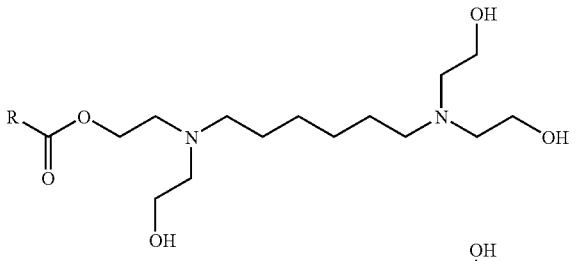

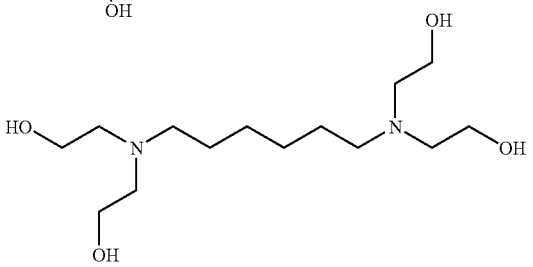

and R is defined as $R^1$ as described above.

Other Softener Actives

Highly concentrated fabric softener compositions can also be comprised of other fabric softener actives described herewithin. The compositions can also contain these actives as supplementary fabric softener active(s), in addition to the previously described softener actives, typically from 0% to about 50%, preferably from about 3% to about 30%, more preferably from about 5% to about 20%, said other fabric softener active being selected from:

(1) Softener Having the Formula:

$$[R_{4-m}—N^{(+)}—R^1{}_m]A^-$$

wherein each m is 2 or 3, each $R^1$ is a $C_6$–$C_{22}$, preferably $C_{14}$–$C_{20}$, but no more than one being less than about $C_{12}$ and then the other is at least about 16, hydrocarbyl, or substituted hydrocarbyl substituent, preferably $C_{10}$–$C_{20}$ alkyl or alkenyl (unsaturated alkyl, including polyunsaturated alkyl, also referred to sometimes as "alkylene") most preferably $C_{12}$–$C_{18}$ alkyl or alkenyl, and where the Iodine Value (hereinafter referred to as "IV") of a fatty acid containing this $R^1$ group is from about 70 to about 140, more preferably from about 80 to about 130; and most preferably from about 90 to about 115 (as used herein, the term "Iodine Value" means the Iodine Value of a "parent" fatty acid, or "corresponding" fatty acid, which is used to define a level of unsaturation for an $R^1$ group that is the same as the level of unsaturation that would be present in a fatty acid containing the same $R^1$ group) with, preferably, a cis/trans ratio of from about 1:1 to about 50:1, the minimum being about 1:1, preferably from about 2:1 to about 40:1, more preferably from about 3:1 to about 30:1, and even more preferably from about 4:1 to about 20:1; each $R^1$ can also preferably be a branched chain $C_{14}$–$C_{22}$ alkyl group, preferably a branched chain $C_{16}$–$C_{18}$ group; each R is H or a short chain $C_1$–$C_6$, preferably $C_1$–$C_3$ alkyl or hydroxyalkyl group, e.g., methyl (most preferred), ethyl, propyl, hydroxyethyl, and the like, benzyl, or $(R^2O)_{2-4}H$ where each $R^2$ is a $C_{1-6}$ alkylene group; and $A^-$ is a softener compatible anion, preferably, chloride, bromide, methylsulfate, ethylsulfate, sulfate, and nitrate, more preferably chloride and methyl sulfate;

(2) Softener Having the Formula:

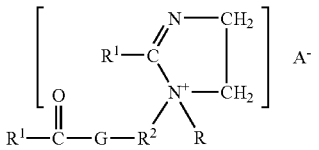

wherein each R, $R^1$, and $A^-$ have the definitions given above; each $R^2$ is a $C_{1-6}$ alkylene group, preferably an ethylene group; and G is an oxygen atom or an —NR— group;

(3) Softener Having the Formula:

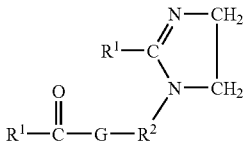

wherein $R^1$, $R^2$ and G are defined as above;

(4) Reaction Products of Substantially Unsaturated and/or Branched Chain Higher Fatty Acids with Dialkylenetriamines in, e.g., a Molecular Ratio of About 2:1, Said Reaction Products Containing Compounds of the Formula:

$$R^1—C(O)—NH—R^2—NH—R^3—NH—C(O)—R^1$$

wherein $R^1$, $R^2$ are defined as above, and each $R^3$ is a $C_{1-6}$ alkylene group, preferably an ethylene group;

(5) Softener Having the Formula:

$$[R^1—C(O)—NR—R^2—N(R)_2—R^3—NR—C(O)—R^1]^+A^-$$

wherein R, $R^1$, $R^2$, $R^3$ and $A^-$ are defined as above;

(6) The Reaction Product of Substantially Unsaturated and/or Branched Chain Higher Fatty Acid with Hydroxyalkylalkylenediamines in a Molecular Ratio of About 2:1, Said Reaction Products Containing Compounds of the Formula:

$$R^1—C(O)—NH—R^2—N(R^3OH)—C(O)—R^1$$

wherein $R^1$, $R^2$ and $R^3$ are defined as above;

(7) Softener Having the Formula:

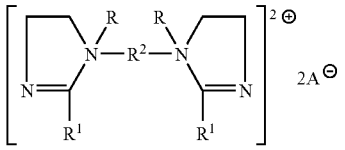

wherein R, $R^1$, $R^2$, and $A^-$ are defined as above; and (8) Mixtures Thereof.

Other optional but highly desirable cationic compounds which can be used in combination with the above softener actives are compounds containing one long chain acyclic $C_8$–$C_{22}$ hydrocarbon group, selected from the group consisting of:

(8) Acyclic Quaternary Ammonium Salts Having the Formula:

$$[R^1—N(R^5)_2—R^6]^+A^-$$

wherein $R^5$ and $R^6$ are $C_1$–$C_4$ alkyl or hydroxyalkyl groups, and $R^1$ and $A^-$ are defined as herein above;

(9) Substituted Imidazolinium Salts Having the Formula:

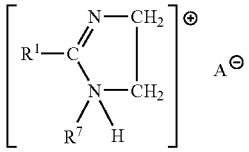

wherein $R^7$ is hydrogen or a $C_1$–$C_4$ saturated alkyl or hydroxyalkyl group, and $R^1$ and $A^-$ are defined as hereinabove;

(10) Substituted Imidazolinium Salts Having the Formula:

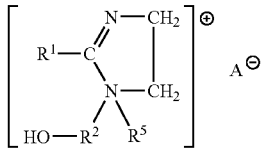

wherein $R^5$ is a $C_1$–$C_4$ alkyl or hydroxyalkyl group, and $R^1$, $R^2$, and $A^-$ are as defined above;

(11) Alkylpyridinium Salts Having the Formula:

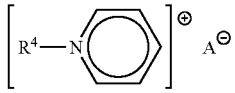

wherein $R^4$ is an acyclic aliphatic $C_8$–$C_{22}$ hydrocarbon group and $A^-$ is an anion; and

(12) Alkanamide Alkylene Pyridinium Salts Having the Formula:

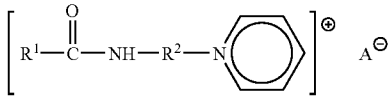

wherein $R^1$, $R^2$ and $A^-$ are defined as herein above; and mixtures thereof.

Examples of Compound (8) are the monoalkenyltrimethylammonium salts such as monooleyltrimethylammonium chloride, monocanolatrimethylammonium chloride, and soyatrimethylammonium chloride. Monooleyltrimethylammonium chloride and monocanolatrimethylammonium chloride are preferred. Other examples of Compound (8) are soyatrimethylammonium chloride available from Goldschmidt Corporation under the trade name Adogen® 415, erucyltrimethylammonium chloride wherein $R^1$ is a $C_{22}$ hydrocarbon group derived from a natural source; soyadimethylethylammonium ethylsulfate wherein $R^1$ is a $C_{16}$–$C_{18}$ hydrocarbon group, $R^5$ is a methyl group, $R^6$ is an ethyl group, and $A^-$ is an ethylsulfate anion; and methyl bis(2-hydroxyethyl)oleylammonium chloride wherein $R^1$ is a $C_{18}$ hydrocarbon group, $R^5$ is a 2-hydroxyethyl group and $R^6$ is a methyl group.

Additional fabric softeners that can be used herein are disclosed, at least generically for the basic structures, in U.S. Pat. No. 3,861,870, Edwards and Diehl; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; and U.S. Pat. No. 4,237,016, Rudkin, Clint, and Young, all of said patents being incorporated herein by reference. The additional softener actives herein are preferably those that are highly unsaturated versions of the traditional softener actives, i.e., di-long chain alkyl nitrogen derivatives, normally cationic materials, such as dioleyldimethylammonium chloride and imidazolinium compounds as described hereinafter. Examples of more biodegradable fabric softeners can be found in U.S. Pat. No. 3,408,361, Mannheimer, issued Oct. 29, 1968; U.S. Pat. No. 4,709,045, Kubo et al., issued Nov. 24, 1987; U.S. Pat. No. 4,233,451, Pracht et al., issued Nov. 11, 1980; U.S. Pat. No. 4,127,489, Pracht et al., issued Nov. 28, 1979; U.S. Pat. No. 3,689,424, Berg et al., issued Sep. 5, 1972; U.S. Pat. No. 4,128,485, Baumann et al., issued Dec. 5, 1978; U.S. Pat. No. 4,161,604, Elster et al., issued July 17, 1979; U.S. Pat. No. 4,189,593, Wechsler et al., issued Feb. 19, 1980; and U.S. Pat. No. 4,339,391, Hoffman et al., issued Jul. 13, 1982, said patents being incorporated herein by reference.

Examples of Compound (1) are dialkylenedimethylammonium salts such as dicanoladimethylammonium chloride, dicanoladimethylammonium methylsulfate, di(partially hydrogenated soybean, cis/trans ratio of about 4:1)dimethylammonium chloride, dioleyldimethylammonium chloride. Dioleyldimethylammonium chloride and di(canola)dimethylammonium chloride are preferred. An example of commercially available dialkylenedimethylammonium salts usable in the present invention is dioleyldimethylammonium chloride available from Goldschmidt Corporation under the trade name Adogen® 472.

An example of Compound (2) is 1-methyl-1-oleylamidoethyl-2-oleylimidazolinium methylsulfate wherein $R^1$ is an acyclic aliphatic $C_{15}$–$C_{17}$ hydrocarbon group, $R^2$ is an ethylene group, G is a NH group, $R^5$ is a methyl group and $A^-$ is a methyl sulfate anion, available commercially from the Goldschmidt Corporation under the trade name Varisoft® 3690.

An example of Compound (3) is 1-oleylamidoethyl-2-oleylimidazoline wherein $R^1$ is an acyclic aliphatic $C_{15}$–$C_{17}$ hydrocarbon group, $R^2$ is an ethylene group, and G is a NH group.

An example of Compound (4) is reaction products of oleic acids with diethylenetriamine in a molecular ratio of about 2:1, said reaction product mixture containing N,N"-dioleoyldiethylenetriamine with the formula:

$$R^1—C(O)—NH—CH_2CH_2—NH—CH_2CH_2—NH—C(O)—R^1$$

wherein $R^1$—C(O) is oleoyl group of a commercially available oleic acid derived from a vegetable or animal source, such as Emersol® 223LL or Emersol® 7021, available from Henkel Corporation, and $R^2$ and $R^3$ are divalent ethylene groups.

An example of Compound (5) is a di-fatty amidoamine based softener having the formula:

$$[R^1—C(O)—NH—CH_2CH_2—N(CH_3)(CH_2CH_2OH)—CH_2CH_2—NH—C(O)—R^1]^+ CH_3SO_4^-$$

wherein $R^1$—C(O) is oleoyl group, available commercially from the Goldschmidt Corporation under the trade name Varisoft® 222LT.

An example of Compound (6) is reaction products of oleic acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is oleoyl group of a commercially available oleic acid derived from a vegetable or animal source, such as Emersol® 223LL or Emersol® 7021, available from Henkel Corporation.

An example of Compound (7) is the diquaternary compound having the formula:

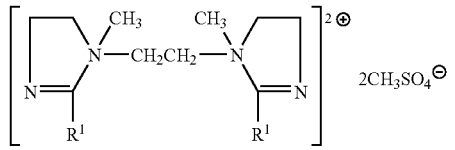

wherein $R^1$ is derived from oleic acid, and the compound is available from Goldschmidt Company.

An example of Compound (11) is 1-ethyl-1-(2-hydroxyethyl)-2-isoheptadecylimidazolinium ethylsulfate wherein $R^1$ is a $C_{17}$ hydrocarbon group, $R^2$ is an ethylene group, $R^5$ is an ethyl group, and $A^-$ is an ethylsulfate anion.

Softener actives of the present invention can also be of the "hardened" type. In these cases the fabric softener compound preferably has a phase transition temperature of greater than about 50° C., more preferably greater than about 60° C., even more preferably greater than about 70° C., and yet even more preferably greater than about 80° C., and preferably is biodegradable. The IV of the fatty acid precursor is from about 0 to about 40, preferably from about 1 to about 30 and even more preferably from about 3 to about 20. Such actives are useful for making powdered or granular highly concentrated softener compositions. Such actives and compositions can be prepared by suitable grinding, spray-drying, cyro-milling, and the like. Powdered or granular compositions can be formed into articles such as tablets, effervescing tablets, fizz balls, or encapsulated with water-soluble films to form beads or pouches.

Anion A

In the cationic nitrogenous salts herein, the anion $A^-$, which is any softener compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, and the like. Chloride and methylsulfate are preferred herein as anion A. The anion can also, but less preferably, carry a double charge in which case $A^-$ represents half a group.

It will be understood that all combinations of softener structures disclosed above are suitable for use in this invention.

B. Optional Principal Solvent System

The principal solvent, when present, is typically used at an effective level up to about 40% by weight, preferably from about 1% to about 25%, more preferably from about 3% to about 8%, by weight of the composition. An advantage of the high electrolyte level and/or the phase stabilizers disclosed in Serial No. Case 7258 is that lower levels of principal solvents and/or a wider range of principal solvents can be used to provide clarity. E.g., without the high level of electrolyte, the ClogP of the principal solvent system disclosed therein would typically be limited to a range of from about 0.15 to about 0.64 as disclosed in said '443 patent. It is known that higher ClogP compounds, up to about 1 can be used when combined with other solvents as disclosed in copending provisional application Ser. No. 60/047,058, filed May 19, 1997 in the names of H. B. Tordil, E. H. Wahl, T.

Trinh, M. Okamoto, and D. L. Duval, or with nonionic surfactants, and especially with the phase stabilizers disclosed herein as previously disclosed in Docket No. 7039P, filed Mar. 2, 1998, Provisional Application Ser. No. 60/076,564, the inventors being D. L. Duval, G. M. Frankenbach, E. H. Wahl, T. Trinh, H. J. M. Demeyere, J. H. Shaw and M. Nogami. Title: Concentrated, Stable, Translucent or Clear Fabric Softening Compositions, both of said applications being incorporated herein by reference. With the electrolyte present, the level of principal solvent can be less and/or the ClogP range that is usable is broadened to include from about −2.0 to about 2.6 , more preferably from about −1.7 to about 1.6, and even more preferably from about −1.0 to about 1.0.

With the electrolyte present, levels of principal solvent that are substantially less than about 15% by weight of the composition can be used, which is preferred for odor, safety and economy reasons. The phase stabilizer as defined hereinafter, in combination with a very low level of principal solvent is sufficient to provide good clarity and/or stability of the composition when the electrolyte is present. Said electrolyte and/or said phase stabilizer can be used to either make a composition translucent or clear, or can be used to increase the temperature range at which the composition is translucent or clear.

Principal solvents are efficient in that they provide the maximum advantage for a given weight of solvent. It is understood that "solvent", as used herein, refers to the effect of the principal solvent and not to its physical form at a given temperature, since some of the principal solvents are solids at ambient temperature.

Principal solvents that can be present are selected to minimize solvent odor impact in the composition and to provide a low viscosity to the final composition. For example, isopropyl alcohol is flammable and has a strong odor. n-Propyl alcohol is more effective, but also has a distinct odor. Several butyl alcohols also have odors but can be used for effective clarity/stability, especially when used as part of a principal solvent system to minimize their odor. The alcohols are also selected for optimum low temperature stability, that is they are able to form compositions that are liquid with acceptable low viscosities and translucent, preferably clear, down to about 50° F. (about 10° C.), more preferably down to about 40° F. (about 4.4° C.) and are able to recover after storage down to about 20° F. (about 6.7° C.).

Other suitable solvents can be selected based upon their octanol/water partition coefficient (P). Octanol/water partition coefficient of a solvent is the ratio between its equilibrium concentration in octanol and in water. The partition coefficients of the solvent ingredients of this invention are conveniently given in the form of their logarithm to the base 10, logP.

The logP of many ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. The ClogP values, which are the most reliable and widely used estimates for this physicochemical property, are preferably used instead of the experimental logP values in the selection of the principal solvent ingredients which are useful in the present invention. Other methods that can be used to compute ClogP include, e.g., Crippen's fragmentation method as disclosed in J. Chem. Inf. Comput. Sci., 27, 21 (1987); Viswanadhan's fragmentation method as disclose in J. Chem. Inf. Comput. Sci., 29, 163 (1989); and Broto's method as disclosed in Eur. J. Med. Chem.—Chim. Theor., 19, 71 (1984).

The principal solvents are typically selected from those having a ClogP of from −2.0 to 2.6, preferably from −1.7 to 1.6, and more preferably from −1.0 to 1.0.

The most preferred solvents can be identified by the appearance of the dilute treatment compositions used to treat fabrics. These dilute compositions have dispersions of fabric softener that exhibit a more uni-lamellar appearance than conventional fabric softener compositions. The closer to unilamellar the appearance, the better the compositions seem to perform. These compositions provide surprisingly good fabric softening as compared to similar compositions prepared in the conventional way with the same fabric softener active.

Operable solvents have been disclosed, listed under various listings, e.g., aliphatic and/or alicyclic diols with a given number of carbon atoms; mono-ols; derivatives of glycerine; alkoxylates of diols; and mixtures of all of the above can be found in said U.S. Pat. Nos. 5,759,990 and 5,747,443 and PCT application WO 97/03169 published on 30 Jan. 1997, said patents and application being incorporated herein by reference, the most pertinent disclosure appearing at pages 24–82 and 94–108 (methods of preparation) of the said WO 97/03169 specification and in columns 11–54 and 66–78 (methods of preparation) of the '443 patent. The '443 and PCT disclosures contain reference numbers to the Chemical Abstracts Service Registry numbers (CAS No.) for those compounds that have such a number and the other compounds have a method described, that can be used to prepare the compounds. Some inoperable solvents listed in the '443 disclosure can be used in mixtures with operable solvents and/or with the high electrolyte levels and/or phase stabilizers, to make concentrated fabric softener compositions that meet the stability/clarity requirements set forth herein.

Many diol solvents that have the same chemical formula can exist as many stereoisomers and/or optical isomers. Each isomer is normally assigned with a different CAS No. For examples, different isomers of 4-methyl-2,3-hexanediol are assigned to at least the following CAS Nos.: 146452-51-9; 146452-50-8; 146452-49-5; 146452-48-4; 123807-34-1; 123807-33-0; 123807-32-9; and 123807-31-8.

In the '443 and PCT specifications, each chemical formula is listed with only one CAS No. This disclosure is only for exemplification and is sufficient to allow the practice of the invention. The disclosure is not limiting. Therefore, it is understood that other isomers with other CAS Nos., and their mixtures, are also included. By the same token, when a CAS No. represents a molecule which contains some particular isotopes, e.g., deuterium, tritium, carbon-13, etc., it is understood that materials which contain naturally distributed isotopes are also included, and vice versa.

There is a clear similarity between the acceptability (formulatability) of a saturated diol and its unsaturated homologs, or analogs, having higher molecular weights. The unsaturated homologs/analogs have the same formulatability as the parent saturated solvent with the condition that the unsaturated solvents have one additional methylene (viz., $CH_2$) group for each double bond in the chemical formula. In other words, there is an apparent "addition rule" in that for each good saturated solvent of this invention, which is suitable for the formulation of clear, concentrated fabric softener compositions, there are suitable unsaturated solvents where one, or more, $CH_2$ groups are added while, for each $CH_2$ group added, two hydrogen atoms are removed from adjacent carbon atoms in the molecule to form one carbon-carbon double bond, thus holding the number of hydrogen atoms in the molecule constant with respect to the chemical formula of the "parent" saturated solvent. This is due to a surprising fact that adding a —$CH_2$— group to a solvent chemical formula has an effect of increasing its ClogP value by about 0.53, while removing two adjacent hydrogen atoms to form a double bond has an effect of decreasing its ClogP value by about a similar amount, viz., about 0.48, thus about compensating for the —$CH_2$— addition. Therefore one goes from a preferred saturated solvent to the preferred higher molecular weight unsaturated analogs/homologs containing at least one more carbon atom by inserting one double bond for each additional $CH_2$ group, and thus the total number of hydrogen atoms is kept the same as in the parent saturated solvent, as long as the ClogP value of the new solvent remains within the effective range. The following are some illustrative examples:

It is possible to substitute for part of the principal solvent mixture a secondary solvent, or a mixture of secondary solvents, which by themselves are not operable as a principal solvent of this invention, as long as an effective amount of the operable principal solvents of this invention is still present in the liquid concentrated, clear fabric softener composition. An effective amount of the principal solvents of this invention is at least greater than about 1%, preferably more than about 3%, more preferably more than about 5% of the composition, when at least about 15% of the softener active is also present.

Principal solvents preferred for improved clarity at 50° F. are 1,2-hexanediol; 1,2-pentanediol; hexylene glycol; 1,2-butanediol; 1,4-cyclohexanedimethanol; pinacol; 1,5-hexanediol; 1,6-hexanediol; and/or 2,4-dimethyl-2,4-pentanediol.

C. Optional Electrolyte

The compositions of this invention can contain zero, a low level, or a relatively high level of electrolyte, e.g., from 0% up, normally from about 0.01% to about 10%, preferably from about 0.05% to about 3%, and more preferably from about 0.1% to about 2%, by weight of the composition. Increasing the electrolyte level in a clear/translucent formulation provides benefits such as (a) it lowers the amount of principal solvent having a ClogP of from about 0.15 to about 0.64 or 1, which is required to provide clarity (It can even eliminate the need for such a principal solvent completely.); (b) it modifies the viscosity/elasticity profile on dilution, to provide lower viscosity and/or elasticity; and (c) it modifies the range of ClogP of acceptable principal solvents that will provide clarity/translucency.

U.S. Pat. No. 5,759,990, incorporated herein by reference, discloses that the principal solvent in clear formulations should have a ClogP of from about 0.15 to about 0.64. A high electrolyte level allows the use of principal solvents with a ClogP of from about −2.0 to about 2.6, preferably from about −1.7 to about 1.6, and more preferably from about −1.0 to about 1.0. The principal solvents are also more effective with the high electrolyte level, thus allowing one to use less of such principal solvents.

Electrolytes significantly modify the microstructures and/or alter the phases that the products dilute through compared to products with no or lowered levels of electrolyte. Cryogenic Transmission Electron Microscopy and Freeze-Fracture Transmission Electron Microscopy methods show that in products which gel or have an unacceptable increase in viscosity upon dilution, a highly concentrated, tightly packed dispersion of vesicles can be formed. Such vesicular dispersions are shown to have high elasticity using Theological measurements. It is believed that since these solutions have high elasticity, they resist the mechanical stress that can lead to effective mixing with water and thus good dilution.

It is therefore believed that fabric softener compositions with highly preferred dilution and dispensing behaviors can be identified by evaluating the visco-elastic behavior of a series of water dilutions of the fabric softener composition, or alternatively, by evaluating the visco-elastic properties of the maximum viscosity peak in the dilution series. The visco-elastic behavior of the fabric softening composition provides information on the tendency of the fabric softener composition to flow and disperse in a desirable manner when used by the consumer. Viscosity measures the ability of a fluid to flow (i.e. dissipate heat) when energy is applied, represented by G", the loss modulus. Elasticity, which is commonly denoted by the storage modulus G', measures the tendency of the fabric softener composition to be easily deformed as energy is applied. G' and G" are generally measured as functions of applied strain or stress. For the purposes of this invention, G' and G" are measured over a range of energy inputs which encompasses energies likely to be applied in common consumer practices (e.g., machine wash and hand wash processes, pre-dilution steps by hand and machine, machine dispenser use and machine-independent dispenser use). Measuring G' and G" adequately distinguishes fabric softener compositions that have preferred and highly preferred dilution and dispersion behaviors from fabric softener compositions which have less preferred behavior. Further details on rheological parameters as well as well as guidance for choosing instrumentation and making rheological measurements is available in the article on *Rheology Measurements* in the *Kirk-Othmer Encyclopedia of Chemical Technology* 3rd *Ed.,* 1982, John Wiley & Sons Publ.; *Rheology of Liquid Detergents* by R. S. Rounds in Surfactant Series Vol. 67: *Liquid Detergents* ed. K.-Y. Lai, Marcel Dekker, Inc. 1997; and *Introduction to Rheology,* Elsevier, 1989, H. A. Barnes, J. F. Hutton, and K. Walters.

There is a problem that appears when some clear formulas are diluted. Principal solvents, in general, promote facile dilution of clear concentrated formulas to less concentrated dispersions in the rinse liquor. However, when some formulas, especially those with lower levels of principal solvent, or formulas based on solvents which are not principal solvents, are diluted, they may have unacceptable viscosity/elasticity profiles. Rheological parameters which describe preferred formulations are as follows: preferred G'≦about 20 Pa and G"≦about 6 Pa sec; more preferred G'≦about 3 Pa and G"≦about 2 Pa sec; even more preferred G'≦about 1 Pa G"≦about 1 Pa. Preferred, more preferred, and yet even more preferred formulas must maintain stated G' and G" values over a range of applied strains from about 0.1 to about 1.

Microscopy shows again that high electrolyte levels allow the creation of formulas at much lower solvent/softener levels that dilute through different microstructures and/or phases which have much lower visco-elasticity. It is believed that microstructures with much lower elasticity, easily yield to slight stresses caused by agitating water in a washing machine, automatic washing machine dispenser, or automatic dispensing device not affixed to the machine agitator such as the Downy® 'Ball'. This leads to good mixing with water and consequently good dispersion of the fabric softener composition and thus reduced fabric staining potential, less fabric softener composition residue left behind in machine or machine-independent dispensing devices, less build-up of fabric softener residue in dispensers, more fabric softener available in the rinse increasing deposition on clothes, more uniform deposition over the surface of all clothes.

The electrolytes herein include the usual ones found in opaque, dispersion-type, liquid fabric softener compositions and others that are not normally used in such compositions. It was previously believed that principal solvents were increasing the flexibility of both the fabric softener domain and the water domain and thus promoting the formation of a highly fluid, optically clear, compositions containing a bicontinuous fabric softener active phase. Unexpectedly, it is now found that electrolytes seem to provide the function of increasing the flexibility of the water domain through breaking up the hydrogen bond interactions via complexation with the water molecules. This appears to be the mechanism by which the use of high electrolyte allows the use of lower amounts of principal solvents and increases the range of operable principal solvents.

Although it is believed that electrolytes function by complexing with water and breaking the hydrogen bond structure of water, it is also believed that the head groups of the fabric softener active and the phase stabilizer must be able to complex with water to increase the steric repulsion that will prevent coalescence of the separate bicontinuous phases of fabric softener actives, thus improving the stability of the typical bicontinuous phase that is present when the fabric softener active is in a clear composition. Electrolytes that have anions that are termed "soft" or "polarizable" anions as discussed in Surfactants and Interfacial Phenomena, Second Edition, M. J. Rosen, pp. 194–5, are more preferred than "hard" or "less polarizable" anions because the polarizable anions are believed to be effective at breaking up the water structure without dehydrating the head groups of the fabric softeners and the phase stabilizers. An additional reason for preferring soft, polarizable anions is that these complex less strongly than the hard ions with the fabric softener cation and so we believe a stronger cationic charge is maintained on the fabric softener head groups in the presence of the soft anions. A stronger cationic charge on the fabric softener should also help stabilize the bicontinuous phase by preventing coalescence through maintaining greater electrostatic repulsion. A typical series of anions from soft to hard is: iodide; bromide; isocyanate; orthophosphate; chloride; sulfate; hydroxide; and fluoride. The harder anions lower the cloud point of conventional ethoxylated nonionic detergent surfactants more, showing that the harder anions tend to dehydrate the head groups of the ethoxylated surfactants used as phase stabilizers.

For example, salts that lower the cloud point of a 1% solution of Neodol® 91-8 to less than about 65° C. are less preferred in the fabric softener compositions described herein because the fabric softener compositions made with these salts tend to be cloudy at ambient temperatures. Typical approximate cloud points for such a solution are: sodium sulfate—about 54.1° C.; potassium sulfate—64.4° C.; ammonium sulfate—about 64.4° C.; calcium sulfate (no change—insoluble); magnesium sulfate—about 58.7° C.; sodium chloride—about 63-66.9° C.; potassium chloride—about 73.4° C.; ammonium chloride—about 73.8° C.; calcium chloride—about 73.8° C.; and magnesium chloride—about 69.8° C. Potassium acetate provides a cloud point of about 69.8° C., thus placing the acetate anion somewhere between the chloride and sulfate anions.

Inorganic salts suitable for reducing dilution viscosity include $MgI_2$, $MgBr_2$, $MgCl_2$, $Mg(NO_3)_2$, $Mg_3(PO_4)_2$, $Mg_2P_2O_7$, $MgSO_4$, magnesium silicate, NaI, NaBr, NaCl, NaF, $Na_3(PO_4)$, $NaSO_3$, $Na_2SO_4$, $Na_2SO_3$, $NaNO_3$, $NaIO_3$, $Na_3(PO_4)$, $Na_4P_2O_7$, sodium silicate, sodium metasilicate, sodium tetrachloroaluminate, sodium tripolyphosphate (STPP), $Na_2Si_3O_7$, sodium zirconate, $CaF_2$, $CaCl_2$, $CaBr_2$, $CaI_2$, $CaSO_4$, $Ca(NO_3)_2$, Ca, KI, KBr, KCl, KF, $KNO_3$, $KIO_3$, $K_2SO_4$, $K_2SO_3$, $K_3(PO_4)$, $K_4(P_2O_7)$, potassium pyrosulfate, potassium pyrosulfite, LiI, LiBr, LiCl, LiF, $LiNO_3$, $AlF_3$, $AlCl_3$, $AlBr_3$, $AlI_3$, $Al_2(SO_4)_3$, $Al(PO_4)$, $Al(NO_3)_3$, aluminum silicate; including hydrates of these salts and including combinations of these salts or salts with mixed cations e.g. potassium alum $AlK(SO_4)_2$ and salts with mixed anions, e.g. potassium tetrachloroaluminate and sodium tetrafluoroaluminate. Salts incorporating cations from groups IIIa, IVa, Va, VIa, VIIa, VIII, Ib, and IIb on the periodic chart with atomic numbers >13 are also useful in reducing dilution viscosity but less preferred due to their tendency to change oxidation states and thus they can adversely affect the odor or color of the formulation or lower weight efficiency. Salts with cations from group Ia or IIa with atomic numbers >20 as well as salts with cations from the lactinide or actinide series are useful in reducing dilution viscosity, but less preferred due to lower weight efficiency or toxicity. Mixtures of above salts are also useful.

Organic salts useful in this invention include, magnesium, sodium, lithium, potassium, zinc, and aluminum salts of the carboxylic acids including formate, acetate, proprionate, pelargonate, citrate, gluconate, lactate aromatic acids e.g. benzoates, phenolate and substituted benzoates or phenolates, such as phenolate, salicylate, polyaromatic acids terephthalates, and polyacids e.g. oxylate, adipate, succinate, benzenedicarboxylate, benzenetricarboxylate. Other useful organic salts include carbonate and/or hydrogencarbonate ($HCO_3^{-1}$) when the pH is suitable, alkyl and aromatic sulfates and sulfonates e.g. sodium methyl sulfate, benzene sulfonates and derivatives such as xylene sulfonate, and amino acids when the pH is suitable. Electrolytes can comprise mixed salts of the above, salts neutralized with mixed cations such as potassium/sodium tartrate, partially neutralized salts such as sodium hydrogen tartrate or potassium hydrogen phthalate, and salts comprising one cation with mixed anions.

Generally, inorganic electrolytes are preferred over organic electrolytes for better weight efficiency and lower costs. Mixtures of inorganic and organic salts can be used. Typical levels of electrolyte in the compositions are less than about 10%. Preferably from about 0.01% to about 10% by weight, more preferably from about 0.1% to about 2.5%, and most preferably from about 0.2% to about 2% by weight of the fabric softener composition.

D. Optional, Highly Preferred Phase Stabilizer Surfactant

Phase stabilizers, such as nonionic surfactants, are highly desirable, and can be essential to formulating a clear or translucent fabric softener composition when electrolyte is used. Nonionic surfactants are also highly desirable when no principal solvent is used or when a low level of principal solvent is used. Nonionic surfactants can also be used with optional water-soluble solvents such as ethanol and 1,2 propanediol to provide highly concentrated fabric softener compositions. Phase stabilizers can also function as effective dispersing agents for highly concentrated fabric softener compositons, especially for compositions with a low level (less than about 10%) of water or nil water.

Surprisingly, it has been found that the use of nonionic surfactants in highly concentrated fabric softener compositions allows for easier removal of stains from fabrics that may be caused by the fabric softening composition. When staining may not be of great concern when the composition is added by hand to the rinse cycle, it can be a greater concern when the composition is added via a washing machine dispenser, dipsenser drawer, or dosing device such as the Downy Ball®.

Typical levels of phase stabilizers in the softening compositions are from an effective amount up to about 20% by weight, preferably from about 0.1% to about 15% by weight, more preferably from about 1% to about 10% by weight of the composition.

The phase stabilizers are not principal solvents as defined herein, but can be used in combination with principal solvents and water-soluble solvents. The phase stabilizers are preferably nonionic materials, preferably nonionic surfactants.

The phase stabilizers of the present invention preferably include nonionic hydrocarbons including various oils. Some non-limiting examples of such oils include soy and other vegetable oils, canola and mineral oils. Especially preferred are ester group containing hydrocarbons oils including methyl decanoate and octyl stearate. Decyl alcohol is also a preferred nonionic for use as a phase stabilizer.

The nonionic surfactants useful as phase stabilizers in the compositions of the present invention are selected surface actives materials commonly comprise of hydrophobic and hydrophilic moieties. A preferred hydrophilic moiety is polyalkoxylated group, preferably polyethoxylated group.

Preferred nonionic surfactants are derived from saturated and/or unsaturated primary, secondary, and/or branched, amine, amide, amine-oxide fatty alcohol, fatty acid, alkyl phenol, and/or alkyl aryl carboxylic acid compounds, each preferably having from about 6 to about 22, more preferably from about 8 to about 18, carbon atoms in a hydrophobic chain, more preferably an alkyl or alkylene chain, wherein at least one active hydrogen of said compounds is ethoxylated with ≦50, preferably ≦30, more preferably from about 5 to about 15, and even more preferably from about 8 to about 12, ethylene oxide moieties to provide an HLB of from about 8 to about 20, preferably from about 10 to about 18, and more preferably from about 11 to about 15.

Suitable nonionics also include nonionic surfactants with bulky head groups selected from:

a. Surfactants Having the Formula $$R^1—C(O)—Y'—[C(R^5)]_m—CH_2O(R_2O)_zH$$

wherein $R^1$ is selected from the group consisting of saturated or unsaturated, primary, secondary or branched chain alkyl or alkyl-aryl hydrocarbons; said hydrocarbon chain having a length of from about 6 to about 22; Y' is selected from the following groups: —O—; —N(A)—; and mixtures thereof; and A is selected from the following groups: H; $R^1$; $—(R^2—O)_z—H$; $—(CH_2)_xCH_3$; phenyl, or substituted aryl, wherein 0≦x≦about 3 and z is from about 5 to about 30; each $R^2$ is selected from the following groups or combinations of the following groups: $—(CH_2)_n—$ and/or $—[CH(CH_3)CH_2]—$; and each $R^5$ is selected from the following groups: —OH; and $—O(R^2O)_z—H$ ; and m is from about 2 to about 4;

b. Surfactants Having the Formulas:

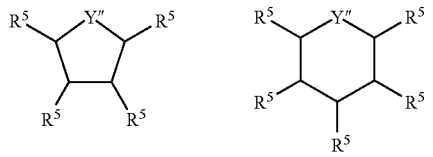

wherein Y"=N or O; and each $R^5$ is selected independently from the following: —H, —OH, $—(CH_2)xCH_3$, $—O(OR^2)_z—H$, $—OR^1$, $—OC(O)R^1$, and $—CH(CH_2—(OR^2)_{z''}—H)—CH_2—(OR^2)_{z'}—C(O)R^1$, x and $R^1$ are as defined above and 5≦z, z', and z"≦20, more preferably 5≦z+z'+z"≦20, and most preferably, the heterocyclic ring is a five member ring with Y"=O, one $R^5$ is —H, two $R^5$ are $—O—(R^2O)z—H$, and at least one $R^5$ is the following structure $—CH(CH^2—(OR^2)_{z''}—H)—CH_2—(OR^2)_{z'}—C(O)R^1$ with 8≦z+z'+z"≦20 and $R^1$ is a hydrocarbon with from 8 to 20 carbon atoms and no aryl group;

c. Polyhydroxy Fatty Acid Amide Surfactants of the Formula:

$$R^2—C(O)—N(R^1)—Z$$

wherein: each $R^1$ is H, $C_1$–$C_4$ hydrocarbyl, $C_1$–$C_4$ alkoxyalkyl, or hydroxyalkyl; and $R^2$ is a $C_5$–$C_{31}$ hydrocarbyl moiety; and each Z is a polyhydroxyhydrocarbyl moiety having a linear hydrocarbyl chain with at least 3 hydroxyls directly connected to the chain, or an ethoxylated derivative thereof; and each $R^1$ is H or a cyclic mono- or polysaccharide, or alkoxylated derivative thereof; and d. Mixtures Thereof.

Suitable phase stabilizers also include surfactant complexes formed by one surfactant ion being neutralized with surfactant ion of opposite charge or an electrolyte ion that is suitable for reducing dilution viscosity and block copolymer surfactants comprising polyethylene oxide moieties and propylene oxide moieties Examples of representative nonionics include:

(1)—Alkyl or Alkyl-aryl Alkoxylated Nonionic Surfactants $$R_1O—(R_2O)_x—R_3$$

Suitable alkyl alkoxylated nonionic surfactants are generally derived from saturated or unsaturated primary, secondary, and branched fatty alcohols, fatty acids, alkyl phenols, or alkyl aryl (e.g., benzoic) carboxylic acid, where the active hydrogen(s) is alkoxylated with x≦about 30 alkylene, with $R_2$ typically having about 8 or less carbons, preferably about 4 or less carbons, most preferably about 3 to 2 carbons. Consistent with source materials $R_1$ may be saturated or unsaturated and linear or branched with typically from about 6 to about 22 carbon atoms preferably straight chain configurations having from about 8 to about 18 carbon atoms, with the alkylene oxide being present, preferably at the primary position, in average amounts of x≦about 30 moles of alkylene oxide per alkyl chain, more preferably x is from about 5 to about 15 moles of alkylene oxide, and most preferably x is from about 8 to about 12 moles of alkylene oxide. $R^3$ is either H or an alkyl or aryl hydrocarbon compound with typically about 8 or less carbons. Preferred materials of this class also have pour points of about 70° F. and/or do not solidify in these clear formulations. Examples of alkyl alkoxylated surfactants with straight chains include Neodol® 91-8, 25-9, 1-9, 25-12, 1-9, and 45-13 from Shell, Plurafac® B-26 and C-17 from BASF, and Brij® 76 and 35 from ICI Surfactants. Examples of branched alkyl alkoxylated surfactants include Tergitol® 15-S-12, 15-S-15, and 15-S-20 from Union Carbide and Emulphogene® BC-720 and BC-840 from GAF. Examples of alkyl-aryl alkoxylated surfactants include Igepal® CO-620 and CO-710, from Rhone Poulenc, Triton® N-111 and N-150 from Union Carbide, Dowfax® 9N5 from Dow and Lutensol® AP9 and AP14, from BASF.

(2)—Alkyl or Alkyl-aryl Amine or Amine Oxide Nonionic Alkoxylated Surfactants

Suitable alkyl alkoxylated nonionic surfactants with amine functionality are generally derived from saturated or unsaturated, primary, secondary, and branched fatty alcohols, fatty acids, fatty methyl esters, alkyl phenol, alkyl benzoates, and alkyl benzoic acids that are converted to amines, amine-oxides, and optionally substituted with a second alkyl or alkyl-aryl hydrocarbon with one or two alkylene oxide chains attached at the amine functionality each having ≦about 50 moles alkylene oxide moieties (e.g. ethylene oxide and/or propylene oxide) per mole of amine. The amine, amide or amine-oxide surfactants for use herein have from about 6 to about 22 carbon atoms, and are in either straight chain or branched chain configuration, preferably there is one hydrocarbon in a straight chain configuration having about 8 to about 18 carbon atoms with one or two alkylene oxide chains attached to the amine moiety, in average amounts of ≦50 about moles of alkylene oxide per amine moiety, more preferably from about 5 to about 15 moles of alkylene oxide, and most preferably a single alkylene oxide chain on the amine moiety containing from about 8 to about 12 moles of alkylene oxide per amine moiety. Preferred materials of this class also have pour points about 70° F. and/or do not solidify in these clear formulations. Examples of ethoxylated amine surfactants include Berol® 397 and 303 from Rhone Poulenc and Ethomeens® C/20, C25, T/25, S/20, S/25 and Ethodumeens® T/20 and T25 from Akzo.

Preferably, the compounds of the alkyl or alkyl-aryl alkoxylated surfactants and alkyl or alkyl-aryl amine, amide, and amine-oxide alkoxylated have the following general formula:

$$R^1m—Y—[(R^2—O)_z—H]_p$$

wherein each R is selected from the group consisting of saturated or unsaturated, primary, secondary or branched chain alkyl or alkyl-aryl hydrocarbons; said hydrocarbon chain preferably having a length of from about 6 to about 22, more preferably from about 8 to about 18 carbon atoms, and even more preferably from about 8 to about 15 carbon atoms, preferably, linear and with no aryl moiety; wherein each $R^2$ is selected from the following groups or combinations of the following groups: $—(CH_2)_n—$ and/or $—[CH(CH_3)CH_2]—$; wherein about 1<n≦about 3; Y is selected from the following groups: —O—; $—N(A)_q—$; —C(O)O—; $—(O\leftarrow)N(A)_q—$; $—B—R^3—O—$; $—B—R^3—N(A)_q—$; $—B—R^3—C(O)O—$; $—B—R^3—N(\rightarrow O)(A)—$; and mixtures thereof; wherein A is selected from the following groups: H; $R^1$; $—(R^2—O)_z—H$; $—(CH_2)_xCH_3$; phenyl, or substituted aryl, wherein 0≦x≦about 3 and B is selected from the following groups: —O—; —N(A)—; —C(O)O—; and mixtures thereof in which A is as defined above; and wherein each $R^3$ is selected from the following groups: $R^2$; phenyl; or substituted aryl. The terminal hydrogen in each alkoxy chain can be replaced by a short chain $C_{1-4}$ alkyl or acyl group to "cap" the alkoxy chain. z is from about 5 to about 30. p is the number of ethoxylate chains, typically one or two, preferably one and m is the number of hydrophobic chains, typically one or two, preferably one and q is a number that completes the structure, usually one.

Preferred structures are those in which m=1, p=1 or 2, and 5≦z≦30, and q can be 1 or 0, but when p=2, q must be 0; more preferred are structures in which m=1, p=1 or 2, and 7≦z≦20; and even more preferred are structures in which m=1, p=1 or 2, and 9≦z≦12. The preferred y is 0.

(3)—Alkoxylated and Non-alkoxylated Nonionic Surfactants with Bulky Head Groups

Suitable alkoxylated and non-alkoxylated phase stabilizers with bulky head groups are generally derived from saturated or unsaturated, primary, secondary, and branched fatty alcohols, fatty acids, alkyl phenol, and alkyl benzoic acids that are derivatized with a carbohydrate group or heterocyclic head group. This structure can then be optionally substituted with more alkyl or alkyl-aryl alkoxylated or non-alkoxylated hydrocarbons. The heterocyclic or carbohydrate is alkoxylated with one or more alkylene oxide chains (e.g. ethylene oxide and/or propylene oxide) each having ≦about 50, preferably ≦about 30, moles per mole of heterocyclic or carbohydrate. The hydrocarbon groups on the carbohydrate or heterocyclic surfactant for use herein have from about 6 to about 22 carbon atoms, and are in either straight chain or branched chain configuration, preferably there is one hydrocarbon having from about 8 to about 18 carbon atoms with one or two alkylene oxide chains carbohydrate or heterocyclic moiety with each alkylene oxide chain present in average amounts of ≦about 50, preferably ≦about 30, moles of carbohydrate or heterocyclic moiety, more preferably from about 5 to about 15 moles of alkylene oxide per alkylene oxide chain, and most preferably between about 8 and about 12 moles of alkylene oxide total per surfactant molecule including alkylene oxide on both the hydrocarbon chain and on the heterocyclic or carbohydrate moiety. Examples of phase stabilizers in this class are Tween® 40, 60, and 80 available from ICI Surfactants.

Preferably the compounds of the alkoxylated and non-alkoxylated nonionic surfactants with bulky head groups have the following general formulas:

$$R^1—C(O)—Y'—[C(R^5)]_m—CH_2O(R_2O)_zH$$

wherein $R^1$ is selected from the group consisting of saturated or unsaturated, primary, secondary or branched chain alkyl or alkyl-aryl hydrocarbons; said hydrocarbon chain having a length of from about 6 to about 22; Y' is selected from the following groups: —O—; —N(A)—; and mixtures thereof; and A is selected from the following groups: H; $R^1$; $—(R^2—O)_z—H$; $—(CH_2)_xCH_3$; phenyl, or substituted aryl, wherein 0≦x≦about 3 and z is from about 5 to about 30; each $R^2$ is selected from the following groups or combinations of the following groups: $—(CH_2)_n—$ and/or $—[CH(CH_3)CH_2]—$; and each $R^5$ is selected from the following groups: —OH; and $—O(R^2O)_z—H$; and m is from about 2 to about 4;

Another useful general formula for this class of surfactants is

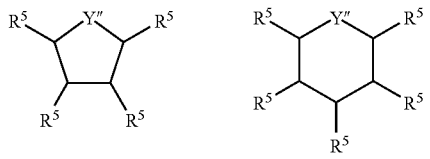

wherein Y"=N or O; and each $R^5$ is selected independently from the following: —H, —OH, —$(CH_2)xCH_3$, —$(OR^2)_z$—H, —$OR^1$, —OC(O)$R^1$, and —$CH_2(CH_2$—$(OR^2)_{z''}$—H)—$CH_2$—$(OR^2)_{z'}$—C(O)$R^1$. With x $R^1$, and $R^2$ as defined above in section D above and z, z', and z" are all from about 5≦to ≦about 20, more preferably the total number of z+z'+z" is from about 5≦to ≦about 20. In a particularly preferred form of this structure the heterocyclic ring is a five member ring with Y"=O, one $R^5$ is —H, two $R^5$ are —O—$(R^2O)_z$—H, and at least one $R^5$ has the following structure —$CH(CH_2$—$(OR^2)_{z''}$—H)—$CH_2$—$(OR^2)_{z'}$—OC(O)$R^1$ with the total z+z'+z"=to from about 8≦to ≦about 20 and $R^1$ is a hydrocarbon with from about 8 to about 20 carbon atoms and no aryl group.

Another group of surfactants that can be used are polyhydroxy fatty acid amide surfactants of the formula:

$$R^6—C(O)—N(R^7)—W$$

wherein: each $R^7$ is H, $C_1$–$C_4$ hydrocarbyl, $C_1$–$C_4$ alkoxyalkyl, or hydroxyalkyl, e.g., 2-hydroxyethyl, 2-hydroxypropyl, etc., preferably $C_1$–$C_4$ alkyl, more preferably $C_1$ or $C_2$ alkyl, most preferably $C_1$ alkyl (i.e., methyl) or methoxyalkyl; and $R^6$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and W is a polyhydroxyhydrocarbyl moiety having a linear hydrocarbyl chain with at least 3 hydroxyls directly connected to the chain, or an alkoxylated derivative (preferably ethoxylated or propoxylated) thereof. W preferably will be derived from a reducing sugar in a reductive amination reaction; more preferably W is a glycityl moiety. W preferably will be selected from the group consisting of —$CH_2$—$(CHOH)_n$—$CH_2OH$, —$CH(CH_2OH)$—$(CHOH)_n$—$CH_2OH$, —$CH_2$—$(CHOH)_2(CHOR')(CHOH)$—$CH_2OH$, where n is an integer from 3 to 5, inclusive, and R' is H or a cyclic mono- or poly-saccharide, and alkoxylated derivatives thereof. Most preferred are glycityls wherein n is 4, particularly —$CH_2$—$(CHOH)_4$—$CH_2O$. Mixtures of the above W moieties are desirable.

$R^6$ can be, for example, N-methyl, N-ethyl, N-propyl, N-isopropyl, N-butyl, N-isobutyl, N-2-hydroxyethyl, N-1-methoxypropyl, or N-2-hydroxypropyl.

$R^6$—CO—N< can be, for example, cocamide, stearamide, oleamide, lauramide, myristamide, capricamide, palmitamide, tallowamide, etc.

W can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

(4)—Alkoxylated Cationic Quaternary Ammonium Surfactants

Alkoxylated cationic quaternary ammonium surfactants suitable for this invention are generally derived from fatty alcohols, fatty acids, fatty methyl esters, alkyl substituted phenols, alkyl substituted benzoic acids, and/or alkyl substituted benzoate esters, and/or fatty acids that are converted to amines which can optionally be further reacted with another long chain alkyl or alkyl-aryl group; this amine compound is then alkoxylated with one or two alkylene oxide chains each having ≦about 50 moles alkylene oxide moieties (e.g. ethylene oxide and/or propylene oxide) per mole of amine. Typical of this class are products obtained from the quaternization of aliphatic saturated or unsaturated, primary, secondary, or branched amines having one or two hydrocarbon chains from about 6 to about 22 carbon atoms alkoxylated with one or two alkylene oxide chains on the amine atom each having less than ≦about 50 alkylene oxide moieties. The amine hydrocarbons for use herein have from about 6 to about 22 carbon atoms, and are in either straight chain or branched chain configuration, preferably there is one alkyl hydrocarbon group in a straight chain configuration having about 8 to about 18 carbon atoms. Suitable quaternary ammonium surfactants are made with one or two alkylene oxide chains attached to the amine moiety, in average amounts of ≦about 50 moles of alkylene oxide per alkyl chain, more preferably from about 3 to about 20 moles of alkylene oxide, and most preferably from about 5 to about 12 moles of alkylene oxide per hydrophobic, e.g., alkyl group. Preferred materials of this class also have a pour points below about 70° F. and/or do not solidify in these clear formulations. Examples of suitable phase stabilizers of this type include Ethoquad® 18/25, C/25, and O/25 from Akzo and Variquat®-66 (soft tallow alkyl bis(polyoxyethyl) ammonium ethyl sulfate with a total of about 16 ethoxy units) from Goldschmidt.

Preferably, the compounds of the ammonium alkoxylated cationic surfactants have the following general formula:

$$\{R^1m—Y—[(R^2—O)_z—H]_p\}^+X^-$$

wherein $R^1$ and $R^2$ are as defined previously in section D above;

Y is selected from the following groups: $=N^+$—$(A)_q$; —$(CH_2)_n$—$N^+$—$(A)_q$; —B—$(CH_2)_n$—$N^+$—$(A)_2$; —(phenyl)—$N^+$—$(A)_q$; —(B-phenyl)—$N^+$—$(A)_q$; with n being from about 1 to about 4.

Each A is independently selected from the following groups: H; $R^1$; —$(R^2O)_z$—H; —$(CH_2)_xCH_3$; phenyl, and substituted aryl; where 0≦x≦about 3; and B is selected from the following groups: —O—; —NA—; —$NA_2$; —C(O)O—; and —C(O)N(A)—; wherein $R^2$ is defined as hereinbefore; q=1 or 2; and $X^-$ is an anion which is compatible with fabric softener actives and adjunct ingredients.

Preferred structures are those in which m=1, p=1 or 2, and about 5≦z≦about 50, more preferred are structures in which m=1, p=1 or 2, and about 7≦z≦about 20, and most preferred are structures in which m=1, p=1 or 2, and about 9≦z≦about 12.

(5)—Surfactant Complexes

Surfactant complexes are considered to be surfactant ions neutralized with a surfactant ion of opposite charge or a surfactant neutralized with an electrolyte that is suitable for reducing dilution viscosity, an ammonium salt, or a polycationic ammonium salt. For the purpose of this invention, if a surfactant complex is formed by surfactants of opposite charge, it is preferable that the surfactants have distinctly different chain lengths e.g. a long-chain surfactant complexed with a short-chain surfactant to enhance the solubility of the complex and it is more preferable that the that the long chain surfactant be the amine or ammonium containing surfactant. Long chain surfactants are defined as containing alkyl chains with from about 6 to about 22 carbon atoms. These alkyl chains can optionally contain a phenyl or substituted phenyl group or alkylene oxide moieties between the chain and the head group. Short chain surfactants are defined as containing alkyl chains with less than 6 carbons and optionally these alkyl chains could contain a phenyl or substituted phenyl group or alkylene oxide moieties between the alkyl chain and the head group. Examples of suitable surfactant complexes include mixtures of Armeen® APA-10 and calcium xylene sulfonate, Armeen APA-10 and magnesium chloride, lauryl carboxylate and triethanol amine, linear alkyl benzene sulfonate and $C_5$-dimethyl amine, or alkyl ethoxylated sulfate and tetrakis N,N,N'N'(2-hydroxylpropyl) ethylenediamine.

Preferably, long-chain surfactants for making complexes have the following general formula:

$$R^1—Y^2$$

wherein $R^1$ is as hereinbefore from section D above and $Y^2$ can be chosen from the following structures: $—N(A)_2$; $—C(O)N(A)_2$; $—(O←)N(A)_2$; $—B—R^3—N(A)_2$; $—B—R^3—C(O)N(A)_2$; $—B—R^3—N(→O)(A)_2$; $—CO_2^-$; $—SO_3^{-2}$; $—OSO_3^{-2}$; $—O(R^2O)_xCO_2^-$; $—O(R^2O)_xSO_3^{-2}$; and $—O(R^2O)_xOSO_3^{-2}$; with B and $R^3$ as is hereinbefore section D above and $0<x\leqq 4$.

Preferably, short-chain surfactants for making complexes have the following general formula:

$$R^4—Y^2$$

wherein $R^1$, $R^3$, B, and $Y^2$ are as hereinbefore and $R^4$ can be chosen from the following: $—(CH_2)_yCH_3$; $—(CH_2)_y$-phenyl or $—(CH_2)_y$-substituted phenyl with $0\leqq y\leqq 6$ (6)—Block Copolymers Obtained by Copolymerization of Ethylene Oxide and Propylene Oxide Suitable polymers include a copolymer having blocks of terephthalate and polyethylene oxide. More specifically, these polymers are comprised of repeating units of ethylene and/or propylene terephthalate and polyethylene oxide terephthalate at a preferred molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymer is in the range of from about 5,000 to about 55,000.

Another preferred polymer is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

Highly preferred polymers have the generic formula:

$$X—(OCH_2CH_2)_n—[O—C(O)—R^1—C(O)—O—R^2)_u —[O—C(O)—R^1—C(O)—O)—(CH_2CH_2O)_n —X \quad (1)$$

in which X can be any suitable capping group, with each X being selected from the group consisting of H, and alkyl or acyl groups containing from about 1 to about 4 carbon atoms, preferably methyl, n is selected for water solubility and generally is from about 6 to about 113, preferably from about 20 to about 50, and u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the desired properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50% to about 100% 1,4-phenylene moieties (from 0 to about 50% moieties other than 1,4-phenylene) are adequate. Preferably, the $R^1$ moieties consist entirely of (i.e., comprise 100%) 1,4-phenylene moieties, i.e., each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixture thereof. Surprisingly, inclusion of a greater percentage of 1,2-propylene moieties tends to improve the water solubility of the compounds.

Therefore, the use of 1,2-propylene moieties or a similar branched equivalent is desirable for incorporation of any substantial part of the polymer in the liquid fabric softener compositions. Preferably, from about 75% to about 100%, more preferably from about 90% to about 100%, of the $R^2$ moieties are 1,2-propylene moieties.

The value for each n is at least about 6, and preferably is at least about 10. The value for each n usually ranges from about 12 to about 113. Typically, the value for each n is in the range of from about 12 to about 43.

A more complete disclosure of these polymers is contained in European Patent Application 185,427, Gosselink, published Jun. 25, 1986, incorporated herein by reference.

Other preferred copolymers include surfactants, such as the polyoxypropylene/polyoxyethylene/polyoxypropylene (PO/EO/PO) reverse block polymers.

The copolymer can optionally contain propylene oxide in an amount up to about 15% by weight. Other preferred copolymer surfactants can be prepared by the processes described in U.S. Pat. No. 4,223,163, issued Sep. 16, 1980, Builloty, incorporated herein by reference.

Suitable block polyoxyethylene-polyoxypropylene polymeric compounds that meet the requirements described hereinbefore include those based on ethylene glycol, propylene glycol, glycerol, trimethylolpropane and ethylenediamine as initiator reactive hydrogen compound. Certain of the block polymer surfactant compounds designated PLURONIC® and TETRONIC® by the BASF-Wyandotte Corp., Wyandotte, Mich., are suitable in compositions of the invention.

A particularly preferred copolymer contains from about 40% to about 70% of a polyoxypropylene/polyoxyethylene/polyoxypropylene block polymer blend comprising about 75%, by weight of the blend, of a reverse block copolymer of polyoxyethylene and polyoxypropylene containing 17 moles of ethylene oxide and 44 moles of propylene oxide; and about 25%, by weight of the blend, of a block copolymer of polyoxyethylene and polyoxypropylene initiated with trimethylolpropane and containing 99 moles of propylene oxide and 24 moles of ethylene oxide per mole of trimethylolpropane.

Suitable for use as copolymer are those having relatively high hydrophilic-lipophilic balance (HLB).

Other polymers useful herein include the polyethylene glycols having a molecular weight of from about 950 to about 30,000 which can be obtained from the Dow Chemical Company of Midland, Mich. Such compounds for example, have a melting point within the range of from about 30° C. to about 100° C., can be obtained at molecular weights of 1,450, 3,400, 4,500, 6,000, 7,400, 9,500, and 20,000. Such compounds are formed by the polymerization of ethylene glycol with the requisite number of moles of ethylene oxide to provide the desired molecular weight and melting point of the respective polyethylene glycol.

(7)—Alkyl Amide Alkoxylated Nonionic Surfactants

Suitable surfactants have the formula:

$$R—C(O)—N(R^4)_n—[(R^1O)_x(R^2O)_yR^3]_m$$

wherein R is $C_{7-21}$ linear alkyl, $C_{7-21}$ branched alkyl, $C_{7-21}$ linear alkenyl, $C_{7-21}$ branched alkenyl, and mixtures thereof. Preferably R is $C_{8-18}$ linear alkyl or alkenyl.

$R^1$ is $—CH_2—CH_2—$, $R_2$ is $C_3$–$C_4$ linear alkyl, $C_3$–$C_4$ branched alkyl, and mixtures thereof; preferably $R^2$ is $—CH(CH_3)—CH_2—$. Surfactants which comprise a mixture of R1 and R2 units preferably comprise from about 4 to about 12 $—CH_2—CH_2—$ units in combination with from about 1 to about 4 $—CH(CH_3)—CH_2—$ units. The units may be alternating or grouped together in any combination suitable to the formulator. Preferably the ratio of $R^1$ units to $R^2$ units is from about 4:1 to about 8:1. Preferably an $R^2$ unit (i.e. $—C(CH_3)H—CH_2—$) is attached to the nitrogen atom followed by the balance of the chain comprising from about 4 to 8 $—CH_2—CH_2—$ units.

$R^3$ is hydrogen, $C_1$–$C_4$ linear alkyl, $C_3$–$C_4$ branched alkyl, and mixtures thereof; preferably hydrogen or methyl, more preferably hydrogen.

$R^4$ is hydrogen, $C_1$–$C_4$ linear alkyl, $C_3$–$C_4$ branched alkyl, and mixtures thereof; preferably hydrogen. When the index m is equal to 2 the index n must be equal to 0 and the R4 unit is absent.

The index m is 1 or 2, the index n is 0 or 1, provided that m +n equals 2; preferably m is equal to 1 and n is equal to 1, resulting in one $—[(R^1O)_x(R^2O)_yR^3]$ unit and R4 being present on the nitrogen. The index x is from 0 to about 50, preferably from about 3 to about 25, more preferably from about 3 to about 10. The index y is from 0 to about 10, preferably 0, however when the index y is not equal to 0, y is from 1 to about 4. Preferably all the alkyleneoxy units are ethyleneoxy units.

Examples of suitable ethoxylated alkyl amide surfactants are Rewopal® $C_6$ from Goldschmidt, Amidox® C5 from Stepan, and Ethomid® O/17 and Ethomid® HT/60 from Akzo.; and (8)—Mixtures Thereof.

In terms of principal solvent reduction, with the invention compositions, a reduction of at least 30% can be made without impairing the performance of the composition compared to compositions without the phase stabilizers hereinbefore described. Using a preferred sub-class, a reduction of more than 50% is possible. These phase stabilizers provide an improved range of temperatures at which the compositions are clear and stable. They also allow more electrolyte to be used without instability. Finally, they can reduce the amount of principal solvent needed to achieve clarity and/or stability.

In order to reduce the amount of principal solvent used, the preferred phase stabilizers are alkoxylated alkyls, alkoxylated acyl amides, alkoxylated alkyl amines or alkoxylated quaternary alkyl ammonium salts, surfactant complexes, and mixtures thereof. The various stabilizers have different advantages. For example, alkoxylated cationic materials or cationic surfactant complexes improve softness and provide enhanced wrinkle release benefits.

Fabric softener compositions with highly preferred dilution and dispensing behaviors can be identified as disclosed hereinbefore.

E. Optional Ingredients (a). Perfume

As used herein the term "perfume" is used to indicate any odoriferous material that is subsequently released into the aqueous bath and/or onto fabrics contacted therewith. The perfume will most often be liquid at ambient temperatures. A wide variety of chemicals are known for perfume uses, including materials such as aldehydes, ketones, and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Typical perfumes can comprise, for example, woody/earthy bases containing exotic materials such as sandalwood, civet and patchouli oil. The perfumes can be of a light floral fragrance, e.g. rose extract, violet extract, and lilac. The perfumes can also be formulated to provide desirable fruity odors, e.g. lime, lemon, and orange. Further, it is anticipated that so-called "designer fragrances" that are typically applied directly to the skin will be used when desired by the consumer. Likewise, the perfumes delivered in the compositions and articles of the present invention may be selected for an aromatherapy effect, such as providing a relaxing or invigorating mood. As such, any material that exudes a pleasant or otherwise desirable odor can be used as a perfume active in the compositions and articles of the present invention.

Preferably, at least about 25%, more preferably at least about 50%, even more preferably at least about 75%, by weight of the perfume is composed of fragrance material selected from the group consisting of aromatic and aliphatic esters having molecular weights from about 130 to about 250; aliphatic and aromatic alcohols having molecular weights from about 90 to about 240; aliphatic ketones having molecular weights from about 150 to about 260; aromatic ketones having molecular weights from about 150 to about 270; aromatic and aliphatic lactones having molecular weights from about 130 to about 290; aliphatic aldehydes having molecular weights from about 140 to about 200; aromatic aldehydes having molecular weights from about 90 to about 230; aliphatic and aromatic ethers having molecular weights from about 150 to about 270; and condensation products of aldehydes and amines having molecular weights from about 180 to about 320; and essentially free from nitromusks and halogenated fragrance materials.

More preferably, at least about 25%, more preferably at least about 50%, most preferably at least about 75%, by weight of the perfume is composed of fragrance material selected from the group consisting of:

| Common Name | Chemical Type | Chemical Name | Approx. M.W. |
|---|---|---|---|
| adoxal | aliphatic aldehyde | 2,6,10-trimethyl-9-undecen-1-al | 210 |
| allyl amyl glycolate | ester | allyl amyl glycolate | 182 |
| allyl cyclohexane propionate | ester | allyl-3-cyclohexyl propionate | 196 |
| amyl acetate | ester | 3-methyl-1-butanol acetate | 130 |
| amyl salicylate | ester | amyl salicylate | 208 |
| anisic aldehyde | aromatic aldehyde | 4-methoxy benzaldehyde | 136 |
| aurantiol | schiff base | condensation product of methyl anthranilate and hydroxycitronellal | 305 |
| bacdanol | aliphatic alcohol | 2-ethyl-4-(2,2,3-trimethyl-3-cyclopenten-1-yl)-2-buten-1-ol | 208 |
| benzaldehyde | aromatic aldehyde | benzaldehyde | 106 |
| benzophenone | aromatic ketone | benzophenone | 182 |
| benzyl acetate | ester | benzyl acetate | 150 |
| benzyl salicylate | ester | benzyl salicylate | 228 |
| beta damascone | aliphatic ketone | 1-(2,6,6-trimethyl-1-cyclo-hexen-1-yl)-2-buten-1-one | 192 |
| beta gamma hexanol | alcohol | 3-hexen-1-ol | 100 |
| buccoxime | aliphatic ketone | 1,5-dimethyl-oxime bicyclo[3,2,1]octan-8-one | 167 |
| cedrol | alcohol | octahydro-3,6,8,8-tetramethyl-1H-3A,7-methanoazulen-6-ol | 222 |
| cetalox | ether | dodecahydro-3A,6,6,9A-tetramethylnaphtho[2,1B]-furan | 236 |
| cis-3-hexenyl acetate | ester | cis-3-hexenyl acetate | 142 |
| cis-3-hexenyl salicylate | ester | beta, gamma-hexenyl salicylate | 220 |
| citronellol | alcohol | 3,7-dimethyl-6-octenol | 156 |
| citronellyl nitrile | nitrile | geranyl nitrile | 151 |
| clove stem oil | natural | | |
| coumarin | lactone | coumarin | 146 |
| cyclohexyl salicylate | ester | cyclohexyl salicylate | 220 |
| cymal | aromatic aldehyde | 2-methyl-3-(para iso propyl phenyl)propionaldehyde | 190 |
| decyl aldehyde | aliphatic aldehyde | decyl aldehyde | 156 |
| delta damascone | aliphatic ketone | 1-(2,6,6-trimethyl-3-cyclo-hexen-1-yl)-2-buten-1-one | 192 |
| dihydromyrcenol | alcohol | 3-methylene-7-methyl octan-7-ol | 156 |
| dimethyl benzyl carbinyl acetate | ester | dimethyl benzyl carbinyl acetate | 192 |
| ethyl vanillin | aromatic aldehyde | ethyl vanillin | 166 |
| ethyl-2-methyl butyrate | ester | ethyl-2-methyl butyrate | 130 |
| ethylene brassylate | macrocyclic lactone | ethylene tridecan-1,13-dioate | 270 |
| eucalyptol | aliphatic epoxide | 1,8-epoxy-para-menthane | 154 |
| eugenol | alcohol | 4-allyl-2-methoxy phenol | 164 |
| exaltolide | macrocyclic lactone | cyclopentadecanolide | 240 |
| flor acetate | ester | dihydro-nor-cyclopentadienyl acetate | 190 |
| florhydral | aromatic aldehyde | 3-(3-isopropylphenyl) butanal | 190 |
| frutene | ester | dihydro-nor-cyclopentadienyl propionate | 206 |

-continued

| Common Name | Chemical Type | Chemical Name | Approx. M.W. |
|---|---|---|---|
| galaxolide | ether | 1,3,4,6,7,8-hexahydro-4,6,6,7,8,8-hexamethylcyclopenta-gamma-2-benzopyrane | 258 |
| gamma decalactone | lactone | 4-N-hepty-4-hydroxybutanoic acid lactone | 170 |
| gamma dodecalactone | lactone | 4-N-octyl-4-hydroxy-butanoic acid lactone | 198 |
| geraniol | alcohol | 3,7-dimethyl-2,6-octadien-1-ol | 154 |
| geranyl acetate | ester | 3,7-dimethyl-2,6-octadien-1-yl acetate | 196 |
| geranyl nitrile | ester | 3,7-diemthyl-2,6-octadienenitrile | 149 |
| helional | aromatic aldehyde | alpha-methyl-3,4,(methylenedioxy) hydrocinnamaldehyde | 192 |
| heliotropin | aromatic aldehyde | heliotropin | 150 |
| hexyl acetate | ester | hexyl acteate | 144 |
| hexyl cinnamic aldehyde | aromatic aldehyde | alpha-n-hexyl cinnamic aldehyde | 216 |
| hexyl salicylate | ester | hexyl salicylate | 222 |
| hydroxyambran | aliphatic alcohol | 2-cyclododecyl-propanol | 226 |
| hydroxycitronellal | aliphatic aldehdye | hydroxycitronellal | 172 |
| ionone alpha | aliphatic ketone | 4-(2,6,6-trimethyl-1-cyclohexenyl-1-yl)-3-buten-2-one | 192 |
| ionone beta | aliphatic ketone | 4-(2,6,6-trimethyl-1-cyclohexen-1-yl)-3-butene-2-one | 192 |
| ionone gamma methyl | aliphatic ketone | 4-(2,6,6-trimethyl-2-cyclohexyl-1-yl)-3-methyl-3-buten-2-one | 206 |
| iso E super | aliphatic ketone | 7-acetyl-1,2,3,4,5,6,7,8-octahydro-1,1,6,7,tetramethyl naphthalene | 234 |
| iso eugenol | ether | 2-methoxy-4-(1-propenyl) phenol | 164 |
| iso jasmone | aliphatic ketone | 2-methyl-3-(2-pentenyl)-2-cyclopenten-1-one | 166 |
| koavone | aliphatic aldehyde | acetyl di-isoamylene | 182 |
| lauric aldehyde | aliphatic aldehyde | lauric aldehyde | 184 |
| lavandin | natural | | |
| lavender | natural | | |
| lemon CP | natural | major component d-limonene | |
| d-limonene/orange terpenes | alkene | 1-methyl-4-iso-propenyl-l-cyclohexene | 136 |
| linalool | alcohol | 3-hydroxy-3,7-dimethyl-1,6-octadiene | 154 |
| linalyl acetate | ester | 3-hydroxy-3,7-dimethyl-1,6-octadiene acetate | 196 |
| lrg 201 | ester | 2,4-dihydroxy-3,6-dimethyl benzoic acid methyl ester | 196 |
| lyral | aliphatic aldehyde | 4-(4-hydroxy-4-methyl-pentyl)3-cylcohexene-1-carboxaldehyde | 210 |
| majantol | aliphatic alcohol | 2,2-dimethyl-3-(3-methylphenyl)-propanol | 178 |
| mayol | alcohol | 4-(1-methylethyl) cyclohexane methanol | 156 |
| methyl anthranilate | aromatic amine | methyl-2-aminobenzoate | 151 |
| methyl beta naphthyl ketone | aromatic ketone | methyl beta naphthyl ketone | 170 |
| methyl cedrylone | aliphatic ketone | methyl cedrenyl ketone | 246 |
| methyl chavicol | ester | 1-methyloxy-4,2-propen-1-yl benzene | 148 |

-continued

| Common Name | Chemical Type | Chemical Name | Approx. M.W. |
|---|---|---|---|
| methyl dihydro jasmonate | aliphatic ketone | methyl dihydro jasmonate | 226 |
| methyl nonyl acetaldehyde | aliphatic aldehyde | methyl nonyl acetaldehyde | 184 |
| musk indanone | aromatic ketone | 4-acetyl-6-tert butyl-1,1-dimethyl indane | 244 |
| nerol | alcohol | 2-cis-3,7-dimethyl-2,6-octadien-1-ol | 154 |
| nonalactone | lactone | 4-hydroxynonanoic acid, lactone | 156 |
| norlimbanol | aliphatic alcohol | 1-(2,2,6-trimethyl-cyclohexyl)-3-hexanol | 226 |
| orange CP | natural | major component d-limonene | |
| P.T. bucinal | aromatic aldehyde | 2-methyl-3(para tert butylphenyl) propionaldehyde | 204 |
| para hydroxy phenyl butanone | aromatic ketone | para hydroxy phenyl butanone | 164 |
| patchouli | natural | | |
| phenyl acetaldehyde | aromatic aldehyde | 1-oxo-2-phenylethane | 120 |
| phenyl acetaldehyde dimethyl acetal | aromatic aldehyde | phenyl acetaldehyde dimethyl acetal | 166 |
| phenyl ethyl acetate | ester | phenyl ethyl acetate | 164 |
| phenyl ethyl alcohol | alcohol | phenyl ethyl alcohol | 122 |
| phenyl ethyl phenyl acetate | ester | 2-phenylethyl phenyl acetate | 240 |
| phenyl hexanol/phenoxanol | alcohol | 3-methyl-5-phenylpentanol | 178 |
| polysantol | aliphatic alcohol | 3,3-dimethyl-5-(2,2,3-trimethyl-3-cyclopenten-1-yl)-4-penten-2-ol | 221 |
| prenyl acetate | ester | 2-methylbuten-2-ol-4-acetate | 128 |
| rosaphen | aromatic alcohol | 2-methyl-5-phenyl pentanol | 178 |
| sandalwood | natural | | |
| alpha-terpinene | aliphatic alkane | 1-methyl-4-iso-propylcyclohexadiene-1,3 | 136 |
| terpineol (alpha terpineol and beta terpineol) | alcohol | para-menth-1-en-8-ol,para-menth-1-en-1-ol | 154 |
| terpinyl acetate | ester | para-menth-1-en-8-yl acetate | 196 |
| tetra hydro linalool | aliphtic alcohol | 3,7-dimethyl-3-octanol | 158 |
| tetrahydromyrcenol | aliphatic alcohol | 2,6-dimethyl-2-octanol | 158 |
| tonalid/musk plus | aromatic ketone | 7-acetyl-1,1,3,4,4,6-hexamethyl tetralin | 258 |
| undecalactone | lactone | 4-N-heptyl-4-hydroxybutanoic acid lactone | 184 |
| undecavertol | alcohol | 4-methyl-3-decen-5-ol | 170 |
| undecyl aldehyde | aliphatic aldehyde | undecanal | 170 |
| undecylenic aldehyde | aliphatic aldehyde | undecylenic aldehyde | 168 |
| vanillin | aromatic aldehyde | 4-hydroxy-3-methoxybenzaldehyde | 152 |
| verdox | ester | 2-tert-butyl cyclohexyl acetate | 198 |
| vertenex | ester | 4-tert-butyl cyclohexyl acetate | 198 |

and mixtures thereof.

During the laundry process,a substantial amount of perfume that is added to the wash and/or the rinse cycle is lost with the water and in the subsequent drying cycle (either line drying or machine drying). This has resulted in both a waste of unusable perfume that are not deposited on the laundered fabrics, and a contribution to the general air pollution from the release of volatile organic compounds to the air. It is therefore preferable that at least about 25%, more preferably at least about 50%, even more preferably at least about 75%, by weight of the perfume is composed of substantive enduring perfume ingredients. These substantive enduring perfume ingredients are characterized by their boiling points (B.P.) and their ClogP value. The substantive enduring perfume ingredients of this invention have a B.P, measured at the normal, standard pressure of 760 mm Hg, of about 240° C. or higher, preferably of about 250° C. or higher, and a ClogP of about 2.7 or higher, preferably of about 2.9 or higher, and even more preferably of about 3.0 or higher. The enduring perfume ingredients tend to be substantive and remain on fabric after the laundry washing and drying process.

As described in U.S. Pat. No. 5,500,138, issued Mar. 19, 1996 to Bacon and Trinh, incorporated herein by reference, the ClogP of an active is a reference to the "calculated" octanol/water partitioning coefficient of the active and serves as a measure of the hydrophobicity of the active. The ClogP of an active can be calculated according to the methods quoted in "The Hydrophobic Fragmental Constant" R. F. Rekker, Elsevier, Oxford or Chem. Rev, Vol. 71, No. 5, 1971, C. Hansch and A.I. Leo, or by using a ClogP program from Daylight Chemical Information Systems, Inc. Such a program also lists experimental logP values when they are available in the Pomona92 database. The "calculated logP" (ClogP) can be determined by the fragment approach of Hansch and Leo (cf., A. Leo in Comprehensive Medicinal Chemistry, Vol. 4, C. Hansch, P. G. Sammens, J. B. Taylor, and C. A. Ramsden, Eds. p 295, Pergamon Press, 1990). The fragment approach is based on the chemical structure of each compound and takes into account the numbers and types of atoms, the atom connectivity, and chemical bonding.

The boiling points of many perfume ingredients are given in, e.g., "Perfume and Flavor Chemicals (Aroma Chemicals)," Steffen Arctander, published by the author, 1969, incorporated herein by reference. Other boiling point values can be obtained from different chemistry handbooks and data bases, such as the Beilstein Handbook, Lange's Handbook of Chemistry, and the CRC Handbook of Chemistry and Physics. When a boiling point is given only at a different pressure, usually lower pressure than the normal pressure of 760 mm Hg, the boiling point at normal pressure can be approximately estimated by using boiling point-pressure nomographs, such as those given in "The Chemist's Companion," A. J. Gordon and R. A. Ford, John Wiley & Sons Publishers, 1972, pp. 30–36. The boiling point values can also be estimated via a computer program that is described in "Development of a Quantitative Structure—Property Relationship Model for Estimating Normal Boiling Points of Small Multifunctional Organic Molecules", David T. Stanton, Journal of Chemical Information and Computer Sciences, Vol. 40, No. 1, 2000, pp. 81–90.

Thus, when a perfume composition which is composed of substantive enduring perfume ingredients, as well as when other organic actives of the present invention, have a B. P. of about 250° C. or higher, and a ClogP of about 3.0 or higher, they are very effectively deposited on fabrics, and remain substantive on fabrics after the rinsing and drying (line or machine drying) steps.

Nonlimitting examples of the preferred enduring perfume ingredients of the present invention include: benzyl salicylate, adoxal, allyl cyclohexane propionate (allyl-3-cyclohexyl propionate), alpha damascone, ambrettolide (trade name for oxacycloheptadec-10-en-2-one), ambretone (trade name for 5-cyclohexadecen-1-one), ambroxan, amyl cinnamic aldehyde,amyl cinnamic aldehyde dimethyl acetal, amyl salicylate, ambrinol 20t (trade name for 2,5,5-trimethyl-octahydro-2-naphthol), iso E super (trade name for 7-acetyl-1,2,3,4,5,6,7,8-octahydro-1,1,6,7,tetramethylnaphthalene), anandol (trade name for 2-ethyl-4-(2,2,3-trimethyl-3-cyclopenten-1-yl)-2-buten-1-ol), aurantiol (trade name for hydroxycitronellal-methyl anthranilate), benzyl benzoate, nirvanol (trade name for 4-penten-2-ol,3,3-dimethyl-5-(2,2,3 trimethyl-3-cyclopenten-1-yl)-), undecalactone (4-N-heptyl-4-hydroxybutanoic acid lactone), beta naphthol methyl ether, bourgeonal (trade name for 3-(4-tert butylphenyl)-propanal), cyclohexadecenone (cis-/trans-cyclohexadec-8-en-1-one), caryophyllene extra, methyl cedrylone (methyl cedrenyl ketone), neobutenone (trade name for 4-penten-1-one, 1-(5,5-dimethyl-1-cyclohexen-1-yl)), cedramber, cedac (trade name for cedrynyl acetate), cedrol (octahydro-3,6,8,8-tetramethyl-1H-3A,7-methanoazulen-6-ol), musk C-14 (trade name for ethylene dodecane dioate), cis-3-hexenyl salicylate, citrathal, citronellyl propionate, galaxolide (trade name for 1,3,4,6,7,8-hexahydro-4,6,6,7,8,8-hexamethlycyclopenta-gamma-2-benzopyrane), cyclohexyl salicylate, cymal (trade name for 2-methyl-3-(para iso propyl phenyl)propionaldehyde), damascone beta (1-(2,6,6-trimethylcyclohexen-1-yl)-2-buten-1-one), damascenone (1-(2,6,6-trimethyl-1,3-cyclohexadien-1-yl)-2-buten-1-one), delta damascone (1-(2,6,6-trimethyl-3-cyclo-hexen-1-yl)-2-buten-1-one), dihydro iso jasmonate, diphenyl methane, dupical (trade name for 4-(tricyclo(5.2.1.0 2,6) decylidene-8)-butanal), diphenyl oxide, gamma-dodecalactone, delta-dodecalactone, ethyl cinnamate, ebanol, ethylene brassylate (ethylene tridecan-1,13-dioate), florhydral (trade name for 3-(3-isopropylphenyl) butanol), habanolide (trade name for oxacyclohexadec-12+13-en-2-one), hexyl cinnamic aldehyde (alpha-n-hexyl cinnamic aldehyde), hexyl salicylate, hydroxyambran (trade name for 2-cyclododecyl-propanol), ionone alpha (4-(2,6,6-trimethyl-1-cyclohexenyl-1-yl)-3-buten-2-one), ionone beta (4-(2,6,6-trimethyl-1-cyclohexen-1-yl)-3-butene-2-one), ionone gamma methyl (4-(2,6,6-trimethyl-2-cyclohexyl-1-yl)-3-methyl-3-buten-2-one), ionone methyl, iralia, iso butyl quinoline, lauric aldehyde, p. t. bucinal (trade name for 2-methyl-3(para tertbutylphenyl) propionaldehyde), musk ketone, musk indanone (trade name for 4-acetyl-6-tert butyl-1,1-dimethyl indane), musk plus (trade name for 7-acetyl-1,1,3,4,4,6-hexamethyl tetralin), octalynol (trade name for 1-naphthalenol, 1,2,3,4,4a,5,8,8a,octahydro-2,2,6,8-tetramethyl), ozonil (trade name for tridecen-2-nitrile), phantolide (trade name for 5-acetyl-1,1,2,3,3,6-hexamethylindan), phenafleur (trade name for cyclohexyl phenyl ethyl ether), phenyl ethyl benzoate, phenyl ethyl phenyl acetate (2-phenylethyl phenyl acetate), vetiveryl acetate, sandalwood, amyl benzoate, amyl cinnamate, cadinene, cedryl acetate, cedryl formate, cinnamyl cinnamate, cyclamen aldehyde, exaltolide (trade name for 15-hydroxypentadecanoic acid, lactone), geranyl anthranilate, hexadecanolide, hexenyl salicylate, linayl benzoate, 2-methoxy naphthalene, methyl cinnamate, methyl dihydrojasmonate, beta-methyl napthyl ketone, musk tibetine, myristicin, delta-nonalactone, oxahexadecanolide-10, oxahexadecanolide-11, patchouli alcohol, phenyl heptanol, phenyl hexanol (3-methyl-5-phenylpentanol), alpha-santalol, thibetolide (trade name for 15-hydroxypentadecanoic acid, lactone), delta-undecalactone, gamma-undecalactone, yara-yara, methyl-N-methyl anthranilate, benzyl butyrate, benzyl iso valerate, citronellyl isobutyrate, delta nonalactone, dimethyl benzyl carbinyl acetate, dodecanal, geranyl acetate, geranyl isobutyrate, gamma-ionone, para-isopropyl phenylacetaldehyde, tonalid (trade name for 7-acetyl-1,1,3,4,4,6-hexamethyl tetralin), iso-amyl salicylate, ethyl undecylenate, benzophenone, beta-caryophyllene, dodecalactone, lilial (trade name for para-tertiary-butyl-alpha-methyl hydrocinnamic aldehyde), and mixtures thereof.

The preferred perfume compositions used in the present invention contain at least 4 different enduring perfume ingredients, preferably at least 5 enduring perfume ingredients, more preferably at least 6 different enduring perfume ingredients, and even more preferably at least 7 different enduring perfume ingredients. Most common perfume ingredients which are derived from natural sources, are composed of a multitude of components. When each such material is used in the formulation of the preferred perfume compositions of the present invention, it is counted as one single ingredient, for the purpose of defining the invention.

In the perfume art, some materials having no odor or very faint odor are used as diluents or extenders. Non-limiting examples of these materials are dipropylene glycol, diethyl phthalate, triethyl citrate, isopropyl myristate, and benzyl benzoate. These materials are used for, e.g., diluting and stabilizing some other perfume ingredients. These materials are not counted in the formulation of the lasting perfume compositions of the present invention.

The perfume compositions of the present invention can also comprise some low odor detection threshold perfume actives. The odor detection threshold of an odorous material is the lowest vapor concentration of that material which can be olfactorily detected. The odor detection threshold and some odor detection threshold values are discussed in, e.g., "Standardized Human Olfactory Thresholds", M. Devos et al, IRL Press at Oxford University Press, 1990, and "Compilation of Odor and Taste Threshold Values Data", F. A. Fazzalari, editor, ASTM Data Series DS 48A, American Society for Testing and Materials, 1978, both of said publications being incorporated by reference. The use of small amounts of perfume ingredients that have low odor detection threshold values can improve perfume odor character, even though they are not as substantive as the enduring perfume ingredients disclosed hereinabove.

Perfume ingredients having a significantly low detection threshold, useful in the lasting perfume composition of the present invention, are selected from the group consisting of allyl amyl glycolate, ambrox (trade name for 1,5,5,9-tetramethyl-1,3-oxatricyclotridecane), anethole, bacdanol (trade name for 2-ethyl-4-(2,2,3-trimethyl-3-cyclopenten-1-yl)-2-buten-1-ol), benzyl acetone, benzyl salicylate, butyl anthranilate, calone, cetalox (trade name for dodecahydro-3A,6,6,9A-tetramethylnaphtho[2,1B]-furan), cinnamic alcohol, coumarin, cyclogalbanate, Cyclal C (trade name for 3-cyclohexene-1-carboxaldehyde, 3,5-dimethyl-), cymal (trade name for 2-methyl-3-(para iso propylphenyl)propionaldehyde), damascenone (trade name for 1-(2,6,6-trimethyl-1,3-cyclohexadien-1-yl)-2-buten-1-one), alpha-damascone, 4-decenal, dihydro isojasmonate, gamma-dodecalactone, ebanol, ethyl anthranilate, ethyl-2-methyl butyrate, ethyl methylphenyl glycidate, ethyl vanillin, eugenol, flor acetate (trade name for dihydro-nor-cyclopentadienyl acetate), florhydral (trade name for 3-(3-isopropylphenyl) butanol), fructone (ethyl-2-methyl-1,3-dioxolane-2-acetate), frutene (dihydro-nor-cyclopentadienyl propionate), heliotropin, herbavert, cis-3-hexenyl salicylate, indole, ionone alpha, ionone beta, iso cyclo citral, isoeugenol, alpha-isomethylionone, keone, lilial (trade name for para-tertiary butyl alpha-methyl hydrocinnamic aldehyde), linalool, lyral (trade name for 4-(4-hydroxy-4-methyl-pentyl)3-cylcohexene-1-carboxaldehyde), methyl anthranilate, methyl dihydrojasmonate, methyl heptine carbonate, methyl isobutenyl tetrahydropyran, methyl beta naphthyl ketone, methyl nonyl ketone, beta naphthol methyl ether, nerol, para-anisic aldehyde, para hydroxy phenyl butanone, phenyl acetaldehyde, gamma-undecalactone, undecylenic aldehyde, vanillin, and mixtures thereof.

These materials are preferably present at low levels in addition to the enduring perfume ingredients, typically less than about 20%, preferably less than about 15%, more preferably less than about 10%, by weight of the total perfume compositions of the present invention. It is understood that these materials can be used a levels higher than 20% and even up to 100% of the total perfume composition. Some enduring perfume ingredients also have low odor detection threshold. These materials are counted as enduring perfume ingredients in the formulation of the perfume compositions of the present invention The following non-limiting examples exemplify enduring perfume compositions:

Enduring Perfume A

| Perfume Ingredients | Wt. % |
|---|---|
| Benzyl Salicylate | 10 |
| Coumarin | 5 |
| Ethyl Vanillin | 2 |
| Ethylene Brassylate | 10 |
| Galaxolide | 15 |
| Hexyl Cinnamic Aldehyde | 20 |
| Gamma Methyl Ionone | 10 |
| Lilial | 15 |
| Methyl Dihydrojasmonate | 5 |
| Patchouli | 5 |
| Tonalid | 3 |
| Total | 100 |

Enduring Perfume B

| Perfume Ingredients | Wt. % |
|---|---|
| Vertinex (4-tertiary butyl cyclohexyl acetate) | 3 |
| Methyl cedrylone | 2 |
| Verdox | 3 |
| Galaxolide | 14 |
| Tonalid | 5 |
| Hexyl salicylate | 4 |
| Benzyl salicylate | 4 |
| Hexyl cinnamic aldehyde | 6 |
| P.T. Bucinal | 6 |
| Musk indanone | 7 |
| Ambrettolide | 2 |
| Sandela | 5 |
| Phentolide | 2 |
| Vetivert acetate | 4 |
| Patchouli | 2 |
| Geranyl phenylacetate | 6 |
| Okoumal | 6 |
| Citronellyl acetate | 3 |
| Citronellol | 5 |
| Phenyl ethyl alcohol | 5 |
| Ethyl vanillin | 2 |
| Coumarin | 1 |
| Flor acetate | 1 |
| Linalool | 2 |
| Total | 100 |

The perfume active may also include pro-fragrances such as acetal profragrances, ketal pro-fragrances, ester pro-fragrances (e.g., digeranyl succinate), hydrolyzable inorganic-organic pro-fragrances, and mixtures thereof. These pro-fragrances may release the perfume material as a result of simple hydrolysis, or may be pH-change-triggered pro-fragrances (e.g. pH drop) or may be enzymatically releasable pro-fragrances.

Sustained Perfume Release Agents

Pro-fragrances, Pro-perfumes, and Pro-accords

The perfume active may also include one or more pro-fragrances, pro-perfumes, pro-accords, and mixtures thereof hereinafter known collectively as "pro-fragrances". The pro-fragrances of the present invention can exhibit varying release rates depending upon the pro-fragrance chosen. In addition, the pro-fragrances of the present invention can be admixed with the fragrance raw materials which are released therefrom to present the user with an initial fragrance, scent, accord, or bouquet.

The pro-fragrances of the present invention can be suitably admixed with any carrier provided the carrier does not catalyze or in other way promote the pre-mature release form the pro-fragrance of the fragrance raw materials.

The following are non-limiting classes of pro-fragrances according to the present invention.

Esters and polyesters—The esters and polyester pro-fragrances of the present invention are capable of releasing one or more fragrance raw material alcohols. Preferred are esters having the formula:

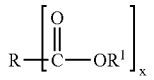

wherein R is substituted or unsubstituted $C_1$–$C_{30}$ alkylene, $C_2$–$C_{30}$ alkenylene, $C_6$–$C_{30}$ arylene, and mixtures thereof; —OR is derived from a fragrance raw material alcohol having the formula $HOR^1$, or alternatively, in the case wherein the index x is greater than 1, $R^1$ is hydrogen thereby rendering at least one moiety a carboxylic acid, —$CO_2H$ unit, rather than an ester unit; the index x is 1 or greater. Non-limiting examples of preferred polyester pro-fragrances include digeranyl succinate, dicitronellyl succinate, digeranyl adipate, dicitronellyl adipate, and the like.

Beta-Ketoesters—The b-ketoesters of the present invention are capable of releasing one or more fragrance raw materials. Preferred b-ketoesters according to the present invention have the formula:

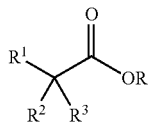

wherein —OR derives from a fragrance raw material alcohol; $R^1$, $R^2$, and $R^3$ are each independently hydrogen, $C_1$–$C_{30}$ alkyl, $C_2$–$C_{30}$ alkenyl, $C_1$–$C_{30}$ cycloalkyl, $C_2$–$C_{30}$ alkynyl, $C_6$–$C_{30}$ aryl, $C_7$–$C_{30}$ alkylenearyl, $C_3$–$C_{30}$ alkyleneoxyalkyl, and mixtures thereof, provided at least one $R^1$, $R^2$, or $R^3$ is a unit having the formula:

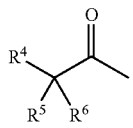

wherein $R^4$, $R^5$, and $R^6$ are each independently hydrogen, $C_1$–$C_{30}$ alkyl, $C_2$–$C_{30}$ alkenyl, $C_1$–$C_{30}$ cycloalkyl, $C_1$–$C_{30}$ alkoxy, $C_6$–$C_{30}$ aryl, $C_7$–$C_{30}$ alkylenearyl, $C_3$–$C_{30}$ alkyleneoxyalkyl, and mixtures thereof, or $R^4$, $R^5$, and $R^6$ can be taken together to form a $C_3$–$C_8$ aromatic or non-aromatic, heterocyclic or non-heterocyclic ring.

Non-limiting examples of b-ketoesters according to the present invention include 2,6-dimethyl-7-octen-2-yl 3-(4-methoxyphenyl)-3-oxo-propionate; 3,7-dimethyl-1,6-octadien-3-yl 3-(nonanyl)-3-oxo-propionate; 9-decen-1-yl 3-(b-naphthyl)-3-oxo-propionate; (a,a-4-trimethyl-3-cyclohexenyl)methyl 3-(b-naphthyl)-3-oxo-propionate; 3,7-dimethyl-1,6-octadien-3-yl 3-(4-methoxyphenyl)-3-oxo-propionate; 2,6-dimethyl-7-octen-2-yl 3-(b-naphthyl)-3-oxo-propionate; 2,6-dimethyl-7-octen-2-yl 3-(4-nitrophenyl)-3-oxo-propionate; 2,6-dimethyl-7-octen-2-yl 3-(4-methoxyphenyl)-3-oxo-propionate; 3,7-dimethyl-1,6-octadien-3-yl 3-(a-naphthyl)-3-oxo-propionate; cis 3-hexen-1-yl 3-(b-naphthyl)-3-oxo-propionate; 2,6-dimethyl-7-octen-2-yl 3-(nonanyl)-3-oxo-propionate; 2,6-dimethyl-7-octen-2-yl 3-oxo-butyrate; 3,7-dimethyl-1,6-octadien-3-yl 3-oxo-butyrate; 2,6-dimethyl-7-octen-2-yl 3-(b-naphthyl)-3-oxo-2-methylpropionate; 3,7-dimethyl-1,6-octadien-3-yl 3-(b-naphthyl)-3-oxo-2,2-dimethylpropionate; 3,7-dimethyl-1,6-octadien-3-yl 3-(b-naphthyl)-3-oxo-2-methylpropionate; 3,7-dimethyl-2,6-octadienyl 3-(b-naphthyl)-3-oxo-propionate; 3,7-dimethyl-2,6-octadienyl 3-heptyl-3-oxo-propionate.

Aetals and Ketals—Another class of compound useful as pro-accords according to the present invention are acetals and ketals having the formula:

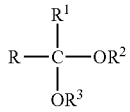

wherein hydrolysis of the acetal or ketal releases one equivalent of aldehyde or ketone and two equivalents of alcohol according to the following scheme:

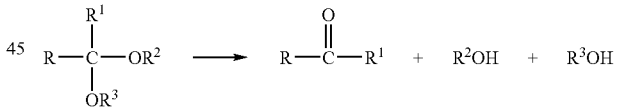

wherein R is $C_1$–$C_{20}$ linear alkyl, $C_4$–$C_{20}$ branched alkyl, $C_6$–$C_{20}$ cyclic alkyl, $C_6$–$C_{20}$ branched cyclic alkyl, $C_6$–$C_{20}$ linear alkenyl, $C_6$–$C_{20}$ branched alkenyl, $C_6$–$C_{20}$ cyclic alkenyl, $C_6$–$C_{20}$ branched cyclic alkenyl, $C_6$–$C_{20}$ substituted or unsubstituted aryl, preferably the moieties which substitute the aryl units are alkyl moieties, and mixtures thereof. $R^1$ is hydrogen, R, or in the case wherein the pro-accord is a ketal, R and $R^1$ can be taken together to form a ring. $R^2$ and $R^3$ are independently selected from the group consisting of $C_5$–$C_{20}$ linear, branched, or substituted alkyl; $C_4$–$C_{20}$ linear, branched, or substituted alkenyl; $C_5$–$C_{20}$ substituted or unsubstituted cyclic alkyl; $C_5$–$C_{20}$ substituted or unsubstituted aryl, $C_2$–$C_{40}$ substituted or unsubstituted alkyleneoxy; $C_3$–$C_{40}$ substituted or unsubstituted alkyleneoxyalkyl; $C_6$–$C_{40}$ substituted or unsubstituted alkylenearyl; $C_6$–$C_{32}$ substituted or unsubstituted aryloxy; $C_6$–$C_{40}$ substituted or unsubstituted alkyleneoxyaryl; $C_6$–$C_{40}$ oxyalkylenearyl; and mixtures thereof.

Non-limiting examples of aldehydes which are releasable by the acetals of the present invention include 4-(4-hydroxy-4-methylpentyl)-3-cyclohexene-1-carboxaldehyde (lyral), phenylacetaldehyde, methylnonyl acetaldehyde, 2-phenylpropan-1-al (hydrotropaldehyde), 3-phenylprop-2-en-1-al (cinnamaldehyde), 3-phenyl-2-pentylprop-2-en-1-al (a-amylcinnamaldehyde), 3-phenyl-2-hexylprop-2-enal (a-hexylcinnamaldehyde), 3-(4-isopropylphenyl)-2-methylpropan-1-al (cyclamen aldehyde), 3-(4-ethylphenyl)-2,2-dimethylpropan-1-al (floralozone), 3-(4-tert-butylphenyl)-2-methylpropanal, 3-(3,4-methylenedioxyphenyl)-2-methylpropan-1-al (helional), 3-(4-ethylphenyl)-2,2-dimethylpropanal, 3-(3-isopropylphenyl)butan-1-al (florhydral), 2,6-dimethylhep-5-en-1-al (melonal), n-decanal, n-undecanal, n-dodecanal, 3,7-dimethyl-2,6-octadien-1-al (citral), 4-methoxybenzaldehyde (anisaldehyde), 3-methoxy-4-hydroxybenzaldehyde (vanillin), 3-ethoxy-4-hydroxybenzaldehyde (ethyl vanillin), 3,4-methylenedioxybenzaldehyde (heliotropin), 3,4-dimethoxybenzaldehyde.

Non-limiting examples of ketones which are releasable by the ketals of the present invention include a-damascone, b-damascone, d-damascone, b-damascenone, muscone, 6,7-dihydro-1,1,2,3,3-pentamethyl-4(5H)-indanone (cashmeran), cis-jasmone, dihydrojasmone, a-ionone, b-ionone, dihydro-b-ionone, g-methyl ionone, a-iso-methyl ionone, 4-(3,4-methylenedioxyphenyl)butan-2-one, 4-(4-hydroxyphenyl)butan-2-one, methyl b-naphthyl ketone, methyl cedryl ketone, 6-acetyl-1,1,2,4,4,7-hexamethyltetralin (tonalid), 1-carvone, 5-cyclohexadecen-1-one, acetophenone, decatone, 2-[2-(4-methyl-3-cyclohexenyl-1-yl)propyl]cyclopentan-2-one, 2-sec-butylcyclohexanone, b-dihydro ionone, allyl ionone, a-irone, a-cetone, a-irisone, acetanisole, geranyl acetone, 1-(2-methyl-5-isopropyl-2-cyclohexenyl)-1-propanone, acetyl diisoamylene, methyl cyclocitrone, 4-t-pentyl cyclohexanone, p-t-butylcyclohexanone, o-t-butylcyclohexanone, ethyl amyl ketone, ethyl pentyl ketone, menthone, methyl-7,3-dihydro-2H-1,5-benzodioxepine-3-one, fenchone.

Orthoesters—Another class of compound useful as pro-accords according to the present invention are orthoesters having the formula:

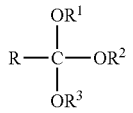

wherein hydrolysis of the orthoester releases one equivalent of an ester and two equivalents of alcohol according to the following scheme:

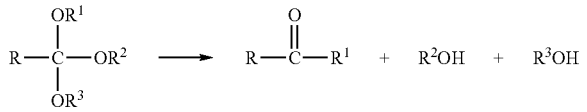

wherein R is hydrogen, $C_1$–$C_{20}$ alkyl, $C_4$–$C_{20}$ cycloalkyl, $C_6$–$C_{20}$ alkenyl, $C_6$–$C_{20}$ aryl, and mixtures thereof; $R^1$, $R^2$ and $R^3$ are each independently selected from the group consisting of $C_5$–$C_{20}$ linear, branched, or substituted alkyl; $C_4$–$C_{20}$ linear, branched, or substituted alkenyl; $C_5$–$C_{20}$ substituted or unsubstituted cyclic alkyl; $C_5$–$C_{20}$ substituted or unsubstituted aryl, $C_2$–$C_{40}$ substituted or unsubstituted alkyleneoxy; $C_3$–$C_{40}$ substituted or unsubstituted alkyleneoxyalkyl; $C_6$–$C_{40}$ substituted or unsubstituted alkylenearyl; $C_6$–$C_{32}$ substituted or unsubstituted aryloxy; $C_6$–$C_{40}$ substituted or unsubstituted alkyleneoxyaryl; $C_6$–$C_{40}$ oxyalkylenearyl; and mixtures thereof.

Non-limiting examples of orthoester pro-fragrances include tris-geranyl orthoformate, tris(cis-3-hexen-1-yl) orthoformate, tris(phenylethyl) orthoformate, bis(citronellyl) ethyl orthoacetate, tris(citronellyl) orthoformate, tris (cis-6-nonenyl) orthoformate, tris(phenoxyethyl) orthoformate, tris(geranyl, neryl) orthoformate (70:30 geranyl: neryl), tris(9-decenyl) orthoformate, tris(3-methyl-5-phenylpentanyl) orthoformate, tris(6-methylheptan-2-yl) orthoformate, tris([4-(2,2,6-trimethyl-2-cyclohexen-1-yl)-3-buten-2-yl]orthoformate, tris[3-methyl-5-(2,2,3-trimethyl-3-cyclopenten-1-yl)-4-penten-2-yl]orthoformate, trismenthyl orthoformate, tris(4-isopropylcyclohexylethyl-2-yl) orthoformate, tris-(6,8-dimethylnonan-2-yl) orthoformate, tris-phenylethyl orthoacetate, tris(cis-3-hexen-1-yl) orthoacetate, tris(cis-6-nonenyl) orthoacetate, tris-citronellyl orthoacetate, bis(geranyl) benzyl orthoacetate, tris(geranyl) orthoacetate, tris(4-isopropylcyclohexylmethyl) orthoacetate, tris(benzyl) orthoacetate, tris(2,6-dimethyl-5-heptenyl) orthoacetate, bis(cis-3-hexen-1-yl) amyl orthoacetate, and neryl citronellyl ethyl orthobutyrate.

Pro-fragrances are suitably described in the following: U.S. Pat. No. 5,378,468 Suffis et al., issued Jan. 3, 1995; U.S. Pat. No. 5,626,852 Suffis et al., issued May 6, 1997; U.S. Pat. No. 5,710,122 Sivik et al., issued Jan. 20, 1998; U.S. Pat. No. 5,716,918 Sivik et al., issued Feb. 10, 1998; U.S. Pat. No. 5,721,202 Waite et al., issued Feb. 24, 1998; U.S. Pat. No. 5,744,435 Hartman et al., issued Apr. 25, 1998; U.S. Pat. No. 5,756,827 Sivik, issued May 26, 1998; U.S. Pat. No. 5,830,835 Severns et al., issued Nov. 3, 1998; and U.S. Pat. No. 5,919,752 Morelli et al., issued Jul. 6, 1999 all of which are incorporated herein by reference.

The perfume components may also be complexed with a polymer such as is described in WO 00/02986 published Jan. 20, 2000, Busch et al., and WO 01/04248 published Jan. 18, 2001, Busch et al. both of which are incorporated herein by reference. As described therein, the perfume is complexed in an amine reaction product that is a product of reaction between a compound containing a primary and/or secondary amine functional group and a perfume active ketone or aldehyde containing component, so called hereinafter "amine reaction product". The general structure for the primary amine compound of the invention is as follows:

$$B—(NH_2)_n$$

wherein B is a carrier material, and n is an index of value of at least 1. Preferred B carriers are inorganic or organic carriers, "inorganic" meaning a carrier that has non- or substantially non-carbon based backbones. Compounds containing a secondary amine group have a structure similar to the above excepted that the compound comprises one or more —NH— groups instead of —$NH_2$.

Preferred primary and/or secondary amines, among the inorganic carriers, are those selected from mono or polymers or organic-organosilicon copolymers of amino derivatised organo silane, siloxane, silazane, alumane, aluminum siloxane, or aluminum silicate compounds. Typical examples of such carriers are: organosiloxanes with at least one primary amine moiety like the diaminoalkylsiloxane [H2NCH2 (CH3)2Si]O, or the organoaminosilane (C6H5) 3SiNH2 described in: Chemistry and Technology of Silicone, W. Noll, Academic Press Inc. 1998, London, pp 209, 106).

Preferred primary and/or secondary amines, among the organic carriers, are those selected from aminoaryl derivatives, polyamines, amino acids and derivatives thereof, substituted amines and amides, glucamines, dendrimers, polyvinylamines and derivatives thereof, and/or copolymer thereof, alkylene polyamine, polyaminoacid and copolymer thereof, cross-linked polyaminoacids, amino substituted polyvinylalcohol, polyoxyethylene bis amine or bis aminoalkyl, aminoalkyl piperazine and derivatives thereof, bis (amino alkyl) alkyl diamine linear or branched, and mixtures thereof. A typical disclosure of amine reaction product suitable for use herein can be found in recently filed applications EP 98870227.0, EP 98870226.2, EP 99870026.4, and EP 99870025.6, all incorporated herein by reference.

Perfume can be present at a level of from 0% to about 15%, preferably from about 0.1% to about 10%, and more preferably from about 0.2% to about 8%, by weight of the finished composition.

(b). Principal Solvent Extender

The compositions of the present invention can optionally include a principal solvent extender to enhance stability and clarity of the formulations and in certain instances provide increased softness benefits. The solvent extender is typically incorporated in amounts ranging from about 0.05% to about 10%, more preferably from about 0.5% to about 5% and most preferably from about 1% to about 4% by weight of the composition.

The principal solvent extender may include a range of materials with the provision that the material provide stability and clarity to a compositions having reduced principal solvent levels and typically reduced perfume or fragrance levels. Such materials typically include hydrophobic materials such as polar and non-polar oils, and more hydrophilic materials like hydrotropes and electrolytes as disclosed above, e.g. electrolytes of groups IIB, III and IV of the periodic table in particular electrolytes of groups IIB and IIIB such as aluminum, zinc, tin chloride electrolytes, sodium EDTA, sodium DPTA, and other electrolytes used as metal chelators.

Polar hydrophobic oils may be selected from emollients such as fatty esters, e.g. methyl oleates, Wickenols®, derivatives of myristic acid such as isopropyl myristate, and triglycerides such as canola oil; free fatty acids such as those derived from canola oils, fatty alcohols such as oleyl alcohol, bulky esters such as benzyl benzoate and benzyl salicylate, diethyl or dibutyl phthalate; bulky alcohols or diols; and perfume oils particularly low-odor perfume oils such as linalool; mono or poly sorbitan esters; and mixtures thereof. Non-polar hydrophobic oils may be selected from petroleum derived oils such as hexane, decane, penta decane, dodecane, isopropyl citrate and perfume bulky oils such as limonene, and mixtures thereof. In particular, the free fatty acids such as partially hardened canola oil may provide increased softness benefits.

Particularly preferred hydrophobic oils include the polar hydrophobic oils. In particular, polar hydrophobic oils which have a freezing point, as defined by a 20% solution of the extender in 2,2,4-trimethyl-1,3-pentanediol, of less than about 22° C. and more preferably less than about 20° C. Preferred oils in this class include methyl oleate, benzyl benzoate and canola oil.

Suitable hydrotropes include sulfonate electrolytes particularly alkali metal sulfonates and carboxylic acid derivatives such as isopropyl citrate. In particular, sodium and calcium cumene sulfonates and sodium toluene sulfonate. Alternative hydrotropes include benzoic acid and its derivatives, electrolytes of benzoic acid and its derivatives.

(c). Cationic Charge Boosters

Cationic charge boosters may be added to the rinse-added fabric softening compositions of the present invention if needed. Some of the charge boosters serve other functions as described hereinbefore. Typically, ethanol is used to prepare many of the below listed ingredients and is therefore a source of solvent into the final product formulation. The formulator is not limited to ethanol, but instead can add other solvents inter alia hexyleneglycol to aid in formulation of the final composition.

The preferred cationic charge boosters of the present invention are described herein below.

(i) Quaternary Ammonium Compounds

A preferred composition of the present invention comprises at least about 0.2%, preferably from about 0.2% to about 20%, more preferably from about 0.2% to about 10% by weight, of a cationic charge booster having the formula:

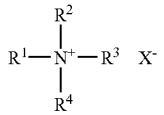

wherein $R^1$, $R^2$, $R^3$, and $R^4$ are each independently $C_1$–$C_{22}$ alkyl, $C_3$–$C_{22}$ alkenyl, $R^5$—Q—$(CH_2)_m$—, wherein $R^5$ is $C_1$–$C_{22}$ alkyl, and mixtures thereof, m is from 1 to about 6; X is an anion.

Preferably $R^1$ is $C_6$–$C_{22}$ alkyl, $C_6$–$C_{22}$ alkenyl, and mixtures thereof, more preferably $C_{11}$–$C_{18}$ alkyl, $C_{11}$–$C_{18}$ alkenyl, and mixtures thereof; $R^2$, $R^3$, and $R^4$ are each preferably $C_1$–$C_4$ alkyl, more preferably each $R^2$, $R^3$, and $R^4$ are methyl.

The formulator may similarly choose $R^1$ to be a $R^5$—Q—$(CH_2)_m$— moiety wherein $R^5$ is an alkyl or alkenyl moiety having from 1 to 22 carbon atoms, preferably the alkyl or alkenyl moiety when taken together with the Q unit is an acyl unit derived preferably derived from a source of triglyceride selected from the group consisting of tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures thereof.

An example of a fabric softener cationic booster comprising a $R^5$—Q—$(CH_2)_m$— moiety has the formula:

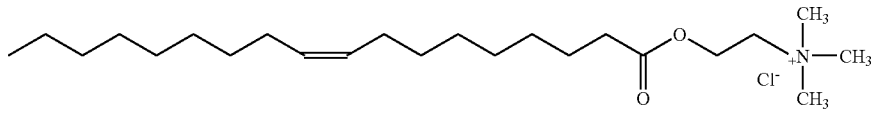

wherein $R^5$—Q— is an oleoyl units and m is equal to 2.

X is a softener compatible anion, preferably the anion of a strong acid, for example, chloride, bromide, methylsulfate, ethylsulfate, sulfate, nitrate and mixtures thereof, more preferably chloride and methyl sulfate.

(ii) Polyvinyl Amines

A preferred composition according to the present invention contains at least about 0.2%, preferably from about 0.2% to about 5%, more preferably from about 0.2% to about 2% by weight, of one or more polyvinyl amines having the formula

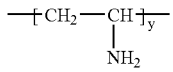

wherein y is from about 3 to about 10,000, preferably from about 10 to about 5,000, more preferably from about 20 to about 500. Polyvinyl amines suitable for use in the present invention are available from BASF.

Optionally, one or more of the polyvinyl amine backbone —$NH_2$ unit hydrogens can be substituted by an alkyleneoxy unit having the formula:

$$—(R^1O)_xR^2$$

wherein $R^1$ is $C_2$–$C_4$ alkylene, $R^2$ is hydrogen, $C_1$–$C_4$ alkyl, and mixtures thereof; x is from 1 to 50. In one embodiment or the present invention the polyvinyl amine is reacted first with a substrate which places a 2-propyleneoxy unit directly on the nitrogen followed by reaction of one or more moles of ethylene oxide to form a unit having the general formula:

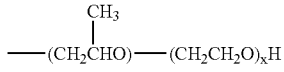

wherein x has the value of from 1 to about 50. Substitutions such as the above are represented by the abbreviated formula PO-$EO_x$—. However, more than one propyleneoxy unit can be incorporated into the alkyleneoxy substituent.

Polyvinyl amines are especially preferred for use as cationic charge booster in liquid fabric softening compositions since the greater number of amine moieties per unit weight provides substantial charge density. In addition, the cationic charge is generated in situ and the level of cationic charge can be adjusted by the formulator.

(iii) Polyalkyleneimines

A preferred composition of the present invention comprises at least about 0.2%, preferably from about 0.2% to about 10%, more preferably from about 0.2% to about 5% by weight, of a polyalkyleneimine charge booster having the formula:

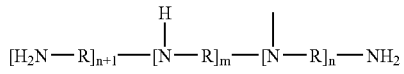

wherein the value of m is from 2 to about 700 and the value of n is from 0 to about 350. Preferably the compounds of the present invention comprise polyamines having a ratio of m:n that is at least 1:1 but may include linear polymers (n equal to 0) as well as a range as high as 10:1, preferably the ratio is 2:1. When the ratio of m:n is 2:1, the ratio of primary: secondary:tertary amine moieties, that is the ratio of —$RNH_2$, —RNH, and —RN moieties, is 1:2:1.

R units are $C_2$–$C_8$ alkylene, $C_3$–$C_8$ alkyl substituted alkylene, and mixtures thereof, preferably ethylene, 1,2-propylene, 1,3-propylene, and mixtures thereof, more preferably ethylene. R units serve to connect the amine nitrogens of the backbone.

Optionally, one or more of the polyvinyl amine backbone —$NH_2$ unit hydrogens can be substituted by an alkyleneoxy unit having the formula:

$$—(R^1O)_xR^2$$

wherein $R^1$ is $C_2$–$C_4$ alkylene, $R^2$ is hydrogen, $C_1$–$C_4$ alkyl, and mixtures thereof; x is from 1 to 50. In one embodiment or the present invention the polyvinyl amine is reacted first with a substrate which places a 2-propyleneoxy unit directly on the nitrogen followed by reaction of one or more moles of ethylene oxide to form a unit having the general formula:

$$—[CH_2C(CH_3)HO]—(CH_2CH_2O)_xH$$

wherein x has the value of from 1 to about 50. Substitutions such as the above are represented by the abbreviated formula PO-$EO_x$—. However, more than one propyleneoxy unit can be incorporated into the alkyleneoxy substituent.

The preferred polyamine cationic charge boosters suitable for use in rinse-added fabric softener compositions comprise backbones wherein less than 50% of the R groups comprise more than 3 carbon atoms. The use of two and three carbon spacers as R moieties between nitrogen atoms in the backbone is advantageous for controlling the charge booster properties of the molecules. More preferred embodiments of the present invention comprise less than 25% moieties having more than 3 carbon atoms. Yet more preferred backbones comprise less than 10% moieties having more than 3 carbon atoms. Most preferred backbones comprise 100% ethylene moieties.

The cationic charge boosting polyamines of the present invention comprise homogeneous or non-homogeneous polyamine backbones, preferably homogeneous backbones. For the purpose of the present invention the term "homogeneous polyamine backbone" is defined as a polyamine backbone having R units that are the same (i.e., all ethylene). However, this sameness definition does not exclude polyamines that comprise other extraneous units comprising the polymer backbone that are present due to an artifact of the chosen method of chemical synthesis. For example, it is known to those skilled in the art that ethanolamine may be used as an "initiator" in the synthesis of polyethyleneimines, therefore a sample of polyethyleneimine that comprises one hydroxyethyl moiety resulting from the polymerization "initiator" would be considered to comprise a homogeneous polyamine backbone for the purposes of the present invention.

For the purposes of the present invention the term "non-homogeneous polymer backbone" refers to polyamine backbones that are a composite of one or more alkylene or substituted alkylene moieties, for example, ethylene and 1,2-propylene units taken together as R units However, not all of the suitable charge booster agents belonging to this category of polyamine comprise the above described polyamines. Other polyamines that comprise the backbone of the compounds of the present invention are generally polyalkyleneamines (PAA's), polyalkyleneimines (PAI's), preferably polyethyleneamine (PEA's), or polyethyleneimines (PEI's). A common polyalkyleneamine (PAA) is tetrabutylenepentamine. PEA's are obtained by reactions involving ammonia and ethylene dichloride, followed by fractional distillation. The common PEA's obtained are triethylenetetramine (TETA) and tetraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372, Dickinson, issued May 14, 1957, which describes the preparation of PEA's.

The PEI's which comprise the preferred backbones of the charge boosters of the present invention can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing PEI's are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951 (all herein incorporated by reference). In addition to the linear and branched PEI's, the present invention also includes the cyclic amines that are typically formed as artifacts of synthesis. The presence of these materials may be increased or decreased depending on the conditions chosen by the formulator.

(iv) Poly-Quaternary Ammonium Compounds

A preferred composition of the present invention comprises at least about 0.2%, preferably from about 0.2% to about 10%, more preferably from about 0.2% to about 5% by weight, of a cationic charge booster having the formula:

$$[R^2—N(R^1)_2—R—N(R^1)_2—R^2]2X^-$$

wherein R is substituted or unsubstituted $C_2$–$C_{12}$ alkylene, substituted or unsubstituted $C_2$–$C_{12}$ hydroxyalkylene; each $R^1$ is independently $C_1$–$C_4$ alkyl, each $R^2$ is independently $C_1$–$C_{22}$ alkyl, $C_3$–$C_{22}$ alkenyl, $R^5$—Q—$(CH_2)_m$—, wherein $R^5$ is $C_1$–$C_{22}$ alkyl, $C_3$–$C_{22}$ alkenyl, and mixtures thereof; m is from 1 to about 6; Q is a carbonyl unit as defined hereinabove; and mixtures thereof; X is an anion.

Preferably R is ethylene; $R^1$ is methyl or ethyl, more preferably methyl; at least one $R^2$ is preferably $C_1$–$C_4$ alkyl, more preferably methyl. Preferably at least one $R^2$ is $C_{11}$–$C_{22}$ alkyl, $C_{11}$–$C_{22}$ alkenyl, and mixtures thereof.

The formulator may similarly choose $R^2$ to be a $R^5$—Q—$(CH_2)_m$— moiety wherein $R^5$ is an alkyl moiety having from 1 to 22 carbon atoms, preferably the alkyl moiety when taken together with the Q unit is an acyl unit derived preferably derived from a source of triglyceride selected from the group consisting of tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures thereof.

An example of a fabric softener cationic booster comprising a $R^5$—Q—$(CH_2)_m$— moiety has the formula:

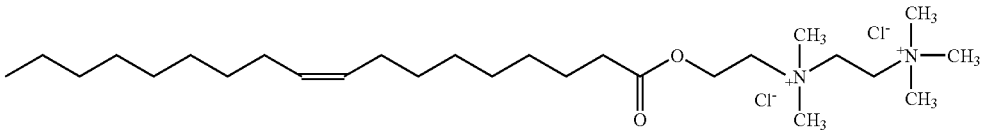

wherein $R^1$ is methyl, one $R^2$ units is methyl and the other $R^2$ unit is $R^5$—Q—$(CH_2)_m$— wherein $R^5$—Q— is an oleoyl unit and m is equal to 2.

X is a softener compatible anion, preferably the anion of a strong acid, for example, chloride, bromide, methylsulfate, ethylsulfate, sulfate, nitrate and mixtures thereof, more preferably chloride and methyl sulfate.

(v). Cationic Polymers

Composition herein can contain from about 0.001% to about 10%, preferably from about 0.01% to about 5%, more preferably from about 0.1% to about 2%, of cationic polymer, typically having a molecular weight of from about 500 to about 1,000,000, preferably from about 1,000 to about 500,000, more preferably from about 1,000 to about 250,000, and even more preferably from about 2,000 to about 100,000 and a charge density of at least about 0.01 meq/gm., preferably from about 0.1 to about 8 meq/gm., more preferably from about 0.5 to about 7, and even more preferably from about 2 to about 6.

The cationic polymers of the present invention can be amine salts or quaternary ammonium salts. Preferred are quaternary ammonium salts. They include cationic derivatives of natural polymers such as some polysaccharide, gums, starch and certain cationic synthetic polymers such as polymers and copolymers of cationic vinyl pyridine or vinyl pyridinium halides. Preferably the polymers are water-soluble, for instance to the extent of at least 0.5% by weight at 20° C. Preferably they have molecular weights of from about 600 to about 1,000,000, more preferably from about 600 to about 500,000, even more preferably from about 800 to about 300,000, and especially from about 1000 to 10,000. As a general rule, the lower the molecular weight the higher the degree of substitution (D.S.) by cationic, usually quaternary groups, which is desirable, or, correspondingly, the lower the degree of substitution the higher the molecular weight which is desirable, but no precise relationship appears to exist. In general, the cationic polymers should have a charge density of at least about 0.01 meq/gm., preferably from about 0.1 to about 8 meq/gm., more preferably from about 0.5 to about 7, and even more preferably from about 2 to about 6.

Suitable desirable cationic polymers are disclosed in "CTFA International Cosmetic Ingredient Dictionary, Fourth Edition, J. M. Nikitakis, et al, Editors, published by the Cosmetic, Toiletry, and Fragrance Association, 1991, incorporated herein by reference. The list includes the following:

Of the polysaccharide gums, guar and locust bean gums, which are galactomannam gums are available commercially, and are preferred. Thus guar gums are marketed under Trade Names CSAA M/200, CSA 200/50 by Meyhall and Stein-Hall, and hydroxyalkylated guar gums are available from the same suppliers. Other polysaccharide gums commercially available include: Xanthan Gum; Ghatti Gum; Tamarind Gum; Gum Arabic; and Agar.

Cationic guar gums and methods for making them are disclosed in British Pat. No. 1,136,842 and U.S. Pat. No. 4,031,307. Preferably they have a D.S. of from 0.1 to about 0.5.

An effective cationic guar gum is Jaguar C-13S (Trade Name—Meyhall). Cationic guar gums are a highly preferred group of cationic polymers in compositions according to the invention and act both as scavengers for residual anionic surfactant and also add to the softening effect of cationic textile softeners even when used in baths containing little or no residual anionic surfactant. The other polysaccharide-based gums can be quaternized similarly and act substantially in the same way with varying degrees of effectiveness. Suitable starches and derivatives are the natural starches such as those obtained from maize, wheat, barley etc., and from roots such as potato, tapioca etc., and dextrins, particularly the pyrodextrins such as British gum and white dextrin.

Some very effective individual cationic polymers are the following: Polyvinyl pyridine, molecular weight about 40,000, with about 60% of the available pyridine nitrogens quaternized.; Copolymer of 70/30 molar proportions of vinyl pyridine/styrene, molecular weight about 43,000, with about 45% of the available pyridine nitrogens quaternized as above; Copolymers of 60/40 molar proportions of vinyl pyridine/acrylamide, with about 35% of the available pyridine nitrogens quaternized as above. Copolymers of 77/23 and 57/43 molar proportions of vinyl pyridine/methyl methacrylate, molecular weight about 43,000, with about 97% of the available pyridine nitrogens quaternized as above.

These cationic polymers are effective in the compositions at very low concentrations for instance from 0.001% by weight to 0.2% especially from about 0.02% to 0.1%. In some instances the effectiveness seems to fall off, when the content exceeds some optimum level, such as for polyvinyl pyridine and its styrene copolymer about 0.05%.

Some other effective cationic polymers are: Copolymer of vinyl pyridine and N-vinyl pyrrolidone (63/37) with about 40% of the available pyridine nitrogens quaternized.; Copolymer of vinyl pyridine and acrylonitrile (60/40), quaternized as above.; Copolymer of N,N-dimethyl amino ethyl methacrylate and styrene (55/45) quaternized as above at about 75% of the available amino nitrogen atoms. Eudragit E (Trade Name of Rohm GmbH) quaternized as above at about 75% of the available amino nitrogens. Eudragit E is believed to be copolymer of N,N-dialkyl amino alkyl methacrylate and a neutral acrylic acid ester, and to have molecular weight about 100,000 to 1,000,000.; Copolymer of N-vinyl pyrrolidone and N,N-diethyl amino methyl methacrylate (40/50), quaternized at about 50% of the available amino nitrogens.; These cationic polymers can be prepared in a known manner by quaternizing the basic polymers.

Yet other cationic polymeric salts are quaternized polyethyleneimines. These have at least 10 repeating units, some or all being quaternized. Commercial examples of polymers of this class are also sold under the generic Trade Name Alcostat by Allied Colloids.

Typical examples of polymers are disclosed in U.S. Pat. No. 4,179,382, incorporated herein by reference.

Each polyamine nitrogen whether primary, secondary or tertiary, is further defined as being a member of one of three general classes; simple substituted, quaternized or oxidized.

The polymers are made neutral by water-soluble anions such as chlorine ($Cl^-$), bromine ($Br^-$), iodine ($I^-$) or any other negatively charged radical such as sulfate ($SO_4^{2-}$) and methosulfate ($CH_3SO_3^-$).

Specific polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

An example of modified polyamine cationic polymers of the present invention comprising PEI's comprising a PEI backbone wherein all substitutable nitrogens are modified by replacement of hydrogen with a polyoxyalkyleneoxy unit, —$(CH_2CH_2O)_7H$. Other suitable polyamine cationic polymers comprise this molecule which is then modified by subsequent oxidation of all oxidizable primary and secondary nitrogens to N-oxides and/or some backbone amine units are quaternized, e.g. with methyl groups.

Of course, mixtures of any of the above described cationic polymers can be employed, and the selection of individual polymers or of particular mixtures can be used to control the physical properties of the compositions such as their viscosity and the stability of the aqueous dispersions.

(d). Mono-Alkyl Cationic Quaternary Ammonium Compound

When the mono-long chain alkyl cationic quaternary ammonium compound is present, it is typically present at a level of from about 2% to about 25%, preferably from about 3% to about 17%, more preferably from about 4% to about 15%, and even more preferably from about 5% to about 13% by weight of the composition, the total mono-alkyl cationic quaternary ammonium compound being at least at an effective level to improve softening in the presence of anionic surfactant.

Such mono-alkyl cationic quaternary ammonium compounds useful in the present invention are, preferably, quaternary ammonium salts of the general formula:

$$[R^4N^+(R^5)_3]A^-$$

wherein $R^4$ is $C_8$–$C_{22}$ alkyl or alkenyl group, preferably $C_{10}$–$C_{18}$ alkyl or alkenyl group; more preferably $C_{10}$–$C_{14}$ or $C_{16}$–$C_{18}$ alkyl or alkenyl group;

each $R^5$ is a $C_1$–$C_6$ alkyl or substituted alkyl group (e.g., hydroxy alkyl), preferably $C_1$–$C_3$ alkyl group, e.g., methyl (most preferred), ethyl, propyl, and the like, a benzyl group, hydrogen, a polyethoxylated chain with from about 2 to about 20 oxyethylene units, preferably from about 2.5 to about 13 oxyethylene units, more preferably from about 3 to about 10 oxyethylene units, and mixtures thereof; and $A^-$ is as defined hereinbefore for (Formula (I)).

Especially preferred are monolauryl trimethyl ammonium chloride and monotallow trimethyl ammonium chloride available from Goldschmidt under the trade name Varisoft® 471 and monooleyl trimethyl ammonium chloride available from Goldschmidt under the tradename Varisoft® 417.

The $R^4$ group can also be attached to the cationic nitrogen atom through a group containing one, or more, ester, amide, ether, amine, etc., linking groups. Such linking groups are preferably within from about one to about three carbon atoms of the nitrogen atom.

Mono-alkyl cationic quaternary ammonium compounds also include $C_8$–$C_{22}$ alkyl choline esters. The preferred compounds of this type have the formula:

$$[R^1C(O)—O—CH_2CH_2N^+(R)_3]A^-$$

wherein $R^1$, R and $A^-$ are as defined previously.

Highly preferred compounds include $C_{12}$–$C_{14}$ coco choline ester and $C_{16}$–$C_{18}$ tallow choline ester.

Suitable biodegradable single-long-chain alkyl compounds containing an ester linkage in the long chains are described in U.S. Pat. No. 4,840,738, Hardy and Walley, issued Jun. 20, 1989, said patent being incorporated herein by reference.

Suitable mono-long chain materials correspond to the preferred biodegradable softener actives disclosed above, where only one $R^1$ group is present in the molecule. The $R^1$ group or $YR^1$ group, is replaced normally by an R group.

These quaternary compounds having only a single long alkyl chain, can protect the cationic softener from interacting with anionic surfactants and/or detergent builders that are carried over into the rinse from the wash solution. It is highly desirable to have sufficient single long chain quaternary compound, or cationic polymer to tie up the anionic surfactant. This provides improved softness and wrinkle control. The ratio of fabric softener active to single long chain compound is typically from about 100:1 to about 2:1, preferably from about 50:1 to about 5:1, more preferably from about 13:1 to about 8:1. Under high detergent carry-over conditions, the ratio is preferably from about 5:1 to about 7:1. Typically the single long chain compound is present at a level of about 10 ppm to about 25 ppm in the rinse.

(e). Metal Chelating Agent

Metals present in fabrics, products, water supply or arriving from other sources, especially transition metals and particularly copper and iron, can act to catalyze auto-oxidation of unsaturated materials, which can produce colored compounds. Therefore, metal chelating agents, that are preferably fabric substantive are added to the composition to control and reduce, or eliminate, catalysis of auto-oxidation reactions by metals. Preferred metal chelating agents contain amine and especially tertiary amine moieties since these tend to be fabric substantive and very effectively chelate copper and iron as well as other metals. Aldehydes are produced by the auto-oxidation reactions, these are easily oxidized, and are believed to propagate the auto-oxidation reactions. Therefore amine-based metal chelating agents, and especially tertiary amine moieties, are also preferred since these react with aldehydes to terminate the auto-oxidation reactions. Low molecular weight amine-based oligimers and/or polymers are also useful in modifying visco-elastic properties of formulations herein. Formulations tend to get hung-up in plastic containers such as the product bottle or the machine dispensers or machine-independent dosing devices such as the Downy® Ball. Adding a small amount of low molecular weight amine-based chelator, especially, tetrakis-(2-hydroxylpropyl) ethylenediamine (TPED), improves flow of the product out of these vessels, thus improving the performance and use experience.

The product contains at least about 0.01%, preferably at least about 0.05%, more preferably at least about 0.10% even more preferably about 0.5%, and most preferably at least about 0.75% and less than about 10%, preferably less than about 5.0% and more preferably less than about 1.0% by weight of a metal chelating agent. Levels below 1.0% are especially preferred in this formulation, since higher levels of metal chelating agents lead to instability in the formulation. Metal chelating agents may also be added at any point during the process of making fabric softener raw materials where polyunsaturated moieties would be present e.g. these could be added into oils used to make fatty acids, during fatty acid making and/or storage during fabric softener active making and/or storage.

The structural description of a preferred amine-based metal chelating compound for use in this composition is given below:

$$(R_1)(R_2)N(CX_2)_nN(R_3)(R_4)$$

wherein X is selected from the group consisting of hydrogen, linear or branched, substituted or unsubstituted alkyl having from 1 to 10 carbons atoms and substituted or unsubstituted aryl having at least 6 carbon atoms; n is an integer from 0 to 6; $R_1$, $R_2$, $R_3$, and $R_4$ are independently selected from the group consisting of alkyl; aryl; alkaryl; arylalkyl; hydroxyalkyl; polyhydroxyalkyl; polyalkylether having the formula $—((CH_2)_yO)_zR_7$ where $R_7$ is hydrogen or a linear, branched, substituted or unsubstituted alkyl chain having from 1 to 10 carbon atoms and where y is an integer from 2 to 10 and z is an integer from 1 to 30; alkoxy; polyalkoxy having the formula: $—(O(CH_2)_y)_zR_7$; the group $—C(O)R_8$ where $R_8$ is alkyl; alkaryl; arylalkyl; hydroxyalkyl; polyhydroxyalkyl and polyalkyether as defined in $R_1$, $R_2$, $R_3$, and $R_4$; $(CX_2)_nN(R_5)(R_6)$ with no more than one of $R_1$, $R_2$, $R_3$, and $R_4$ being $(CX_2)_nN(R_5)(R_6)$ and wherein $R_5$ and $R_6$ are alkyl; alkaryl; arylalkyl; hydroxyalkyl; polyhydroxyalkyl; polyalkylether; alkoxy and polyalkoxy as defined in $R_1$, $R_2$, $R_3$, and $R_4$; and either of $R_1$+$R_3$ or $R_4$ or $R_2$+$R_3$ or $R_4$ can combine to form a cyclic substituent.

Preferred agents include those where $R_1$, $R_2$, $R_3$, and $R_4$ are independently selected from the group consisting of alkyl groups having from 1 to 10 carbon atoms and hydroxyalkyl groups having from 1 to 5 carbon atoms, preferably ethyl, methyl, hydroxyethyl, hydroxypropyl and isohydroxypropyl. The color care agent has more than about 1% nitrogen by weight of the compound, and preferably more than 7%. A preferred agent is tetrakis-(2-hydroxylpropyl) ethylenediamine (TPED).

Other suitable water-soluble chelating agents can be selected from the group consisting of amino carboxylates, amino phosphonates, polyfunctionally-substituted aromatic chelating agents and mixtures thereof, all as hereinafter defined. The chelating agents disclosed in said U.S. Pat. No. 5,759,990 at column 26, line 29 through column 27, line 38 are suitable.

A suitable amine-based metal chelator, EDDS, that can be used herein (also known as ethylenediamine-N,N'-disuccinate) is the material described in U.S. Pat. No. 4,704,233, cited hereinabove, and has the formula (shown in free acid form):

$$HN(L)C_2H_4N(L)H$$

wherein L is a $CH_2(COOH)CH_2(COOH)$ group.

A wide variety of chelators can be used herein. Indeed, simple polycarboxylates such as citrate, oxydisuccinate, and the like, can also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.05% to about 10%, more preferably from about 0.75% to about 5%, by weight of the compositions herein, in addition to those that are stabilizers. Preferred chelators include DETMP, DETPA, NTA, EDDS, and EDTA.

Mixtures of metal chelating agents are acceptable for use herein.

(f). Soil Release Agent

Suitable soil release agents are disclosed in the U.S. Pat. No. 5,759,990 at column 23, line 53 through column 25, line 41. The addition of the soil release agent can occur in combination with the premix, in combination with the acid/water seat, before or after electrolyte addition, or after the final composition is made. The softening composition prepared by the process of the present invention herein can contain from 0% to about 10%, preferably from 0.2% to about 5%, of a soil release agent. Preferably, such a soil release agent is a polymer. Polymeric soil release agents useful in the present invention include copolymeric blocks of terephthalate and polyethylene oxide or polypropylene oxide, and the like.

A preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon 4780® (from Dupont) and Milease T® (from ICI).

These soil release agents can also act as a scum dispersant.

(g). Bactericides

Examples of bactericides used in the compositions of this invention include glutaraldehyde, formaldehyde, 2-bromo-2-nitro-propane-1,3-diol sold by Inolex Chemicals, located in Philadelphia, Pa., under the trade name Bronopol®, and a mixture of 5-chloro-2-methyl-4-isothiazoline-3-one and 2-methyl-4-isothiazoline-3-one sold by Rohm and Haas Company under the trade name Kathon about 1 to about 1,000 ppm by weight of the agent. If the water level is nil, then a bactericide may not be needed and this is a further advantage on the compositions of the present invention.

(h). Silicones

The silicone herein can be either a polydimethyl siloxane (polydimethyl silicone or PDMS), or a derivative thereof, e.g., amino silicones, ethoxylated silicones, etc. The PDMS, is preferably one with a low molecular weight, e.g., one having a viscosity of from about 2 to about 5000 cSt, preferably from about 5 to about 500 cSt, more preferably from about 25 to about 200 cSt Silicone emulsions can conveniently be used to prepare the compositions of the present invention. However, preferably, the silicone is one that is, at least initially, not emulsified. I.e., the silicone should be emulsified in the composition itself. In the process of preparing the compositions, the silicone is preferably added to the "water seat", which comprises the water and, optionally, any other ingredients that normally stay in the aqueous phase.

Low molecular weight PDMS is preferred for use in the fabric softener compositions of this invention. The low molecular weight PDMS is easier to formulate without pre-emulsification.

Silicone derivatives such as amino-functional silicones, quaternized silicones, and silicone derivatives containing Si—OH, Si—H, and/or Si—Cl bonds, can be used. However, these silicone derivatives are normally more substantive to fabrics and can build up on fabrics after repeated treatments to actually cause a reduction in fabric absorbency.

When added to water, the fabric softener composition deposits the biodegradable cationic fabric softening active on the fabric surface to provide fabric softening effects. However, in a typical laundry process, using an automatic washer, cotton fabric water absorbency can be appreciably reduced at high softener levels and/or after multiple cycles. The silicone improves the fabric water absorbency, especially for freshly treated fabrics, when used with this level of fabric softener without adversely affecting the fabric softening performance. The mechanism by which this improvement in water absorbency occurs is not understood, since the silicones are inherently hydrophobic. It is very surprising that there is any improvement in water absorbency, rather than additional loss of water absorbency.

The amount of PDMS needed to provide a noticeable improvement in water absorbency is dependent on the initial rewettability performance, which, in turn, is dependent on the detergent type used in the wash. Effective amounts range from about 2 ppm to about 50 ppm in the rinse water, preferably from about 5 to about 20 ppm. The PDMS to softener active ratio is from about 2:100 to about 50:100, preferably from about 3:100 to about 35:100, more preferably from about 4:100 to about 25:100. As stated hereinbefore, this typically requires from about 0.2% to about 20%, preferably from about 0.5% to about 10%, more preferably from about 1% to about 5% silicone.

The PDMS also improves the ease of ironing in addition to improving the rewettability characteristics of the fabrics. When the fabric care composition contains an optional soil release polymer, the amount of PDMS deposited on cotton fabrics increases and PDMS improves soil release benefits on polyester fabrics. Also, the PDMS improves the rinsing characteristics of the fabric care compositions by reducing the tendency of the compositions to foam during the rinse. Surprisingly, there is little, if any, reduction in the softening characteristics of the fabric care compositions as a result of the presence of the relatively large amounts of PDMS.

(i). Water

The level of water in the highly concentrated fabric softener compositions of the present invention is generally very low, less than about 20%, preferably less than about 10%, more preferably less than about 5%, and most preferably less than about 1%, or even about zero. High water levels can cause the films used (for example, polyvinyl alcohol) to encapsulate said compositions of the present invention to leak or start to dissolve or disintegrate prematurely, either in the manufacturing process, during shipping/handling, or upon storage. However, it has been found that a low level of water can be desirable as medium for adding water-soluble dyes to the composition to give it an attractive color and to distinguish between compositions with different perfumes and/or added fabric care benefits. Oil soluble dyes can be used without the use of water medium but are not preferred since they can cause fabric staining to occur. Additionally, compositions of the present invention can have a low closed cup flashpoint caused mainly by the ethanol or isopropanol that is used as a solvent for the softener active. Typically the closed cup flashpoint of highly concentrated fabric softener compositions can be less than 100° F., and such compositions may be classified as "flammable". Regulatory requirements on what is classified as flammable and the shipping requirements vary by region. In some regions compositions with a closed cup flashpoint of less than 100° F. require special labeling of product and specialized equipment in manufacturing and processing of said compositions and articles of the present invention. This can lead to increased cost of manufacturing and shipping said compositions and articles. Surprisingly, it has been found that the addition of only a small amount of water to compositions of the present invention can effectively raise the closed cup flashpoint of said compositions to greater than about 100° F. Such compositions therefore can be labeled, made and shipped with less costly requirements. Accordingly, when flammability of the composition is an issue the highly concentrated fabric softener composition should have at least about 1% to about 15%, more preferably at least about 2% to about 10%, and even more preferably at least about 3% to about 8% water by weight of the composition.

(j). Plasticizers

For compositions intended to be enclosed or encapsulated by a film, especially a highly water-soluble film like polyvinyl alcohol, it is desirable to incorporate the same or similar plasticizers found in the film into the fabric softener composition. This helps reduce or prevent migration of the film plasticizers into the softener composition. Loss of plasticizers from the film can cause the article to become brittle and/or lose mechanical strength over time. Typical plasticizers to include in the highly concentrated fabric softener composition are glycerin, sorbitol, 1,2 propanediol, PEGS, and other diols and glycols and mixtures. Compositions should contain from at least about 0.1%, preferably at least about 1%, and more preferably at least about 5% to about 50% plasticizer or mixture of plasticizers.

The present invention can include other optional components conventionally used in textile treatment compositions, for example: colorants; preservatives; surfactants; anti-shrinkage agents; fabric crisping agents; spotting agents; germicides; fungicides; anti-corrosion agents; enzymes such as proteases, cellulases, amylases, lipases, etc.; and the like.

The present invention can also include other compatible ingredients, including those disclosed U.S. Pat. No. 5,686,376, Rusche, et al.; issued Nov. 11, 1997, Shaw, et al.; and U.S. Pat. No. 5,536,421, Hartman, et al., issued Jul. 16, 1996, said patents being incorporated herein by reference.

All parts, percentages, proportions, and ratios herein are by weight unless otherwise specified and all numerical values are approximations based upon normal confidence limits. All documents cited are, in relevant part, incorporated herein by reference.

The following non-limiting Examples of concentrated fabric softening compositions show clear, or translucent, products with acceptable viscosities. Examples 1 and 2 provide two concentrated fabric softening compositions and compare each to existing high concentrate fabric softening compositions. In particular, it is to be noted that the prior art compositions typically contain significantly larger concentrations of water, whereas the concentrated compositions of the present invention have to a large extent eliminated water from the compositions. This reduction in water content is believed to contribute to improved stability of the composition/article

EXAMPLE 1

| Chemical | % Raw Material Active | Prior Art Composition A | Claimed Concentrate A |
|---|---|---|---|
| Softener Active[1] | 85% | 26% | 63.77% |
| Fatty Acid[2] | 100% | 0.75% | 1.84% |
| TMPD[3] | 100% | 6.0% | 14.72% |
| Cocoamide 6EO[4] | 100% | 1.65% | 4.05% |
| Demineralized (DI)Water | 100% | 57.43% | — |
| HCl | 25.39% | 0.035% | — |
| NaHEDP[5] | 19.8% | 0.02% | — |
| $CaCl_2$ | 14.81% | 0.22% | — |
| Perfume | 100% | 1.75% | 4.29% |
| Dye | 1% | 0.0011% | 0.00074% |
| Hexylene Glycol[6] | (7.5% in active) | 2.29% | 5.63% |
| Ethanol[6] | (7.5% in active) | 2.29% | 5.63% |

[1]Di(acyloxyethyl)(2-hydroxy ethyl) methyl ammonium methyl sulfate wherein the acyl group is derived from partially hydrogenated canola fatty acid.
[2]Partially hydrogenated canola fatty acid.
[3]2,2,4-trimethyl-1,3-pentanediol
[4]PEG 6 cocamide - polyethylene glycol amide of coconut fatty acid.
[5]Sodium salt of hydroxyethane diphosphonic acid
[6]Material included with softening active by supplier.

Sources of Water in the Example 1 A Compositions

| Chemical | Prior Art Composition A | Claimed Concentrate A |
|---|---|---|
| HCl | 0.1028% | — |
| NaHEDP | 0.081% | — |
| $CaCl_2$ | 1.27% | — |
| Dye | 0.1089% | 0.0733% |
| Ethanol | 0.1147 | 0.2813% |
| Added DI Water | 57.43% | — |
| Total | 59.10% | 0.35% |

EXAMPLE 2

| Chemical | % Raw Material Active | Prior Art Composition B | Claimed Concentrate B |
|---|---|---|---|
| Softener Active[1] | 85% | 35% | 64.35% |
| TMPD[2] | 100% | 5.0% | 9.19% |
| Neodol 91-8[3] | 100% | 5.4% | 9.93% |
| Pluronic L35[4] | 100% | 1% | 1.84% |
| Demineralized (DI) Water | 100% | 39.77% | — |
| DTPA[5] | 40% | 0.01% | — |
| $MgCl_2$ | 30.08% | 1.75% | — |
| Perfume | 100% | 1.7% | 3.13% |
| Dye | 1% | 0.0011% | 0.002% |
| Hexelene Glycol[6] | (7.5% in active) | 3.09% | 5.68% |
| Ethanol[6] | (7.5% in active) | 3.09% | 5.68% |

[1]Di(acyloxyethyl)(2-hydroxy ethyl) methyl ammonium methyl sulfate wherein the acyl group is derived from partially hydrogenated canola fatty acid.
[2]2,2,4-trimethyl-1,3-pentanediol
[3]Alkyl alkoxylated surfactant trademarked by Shell
[4]Block copolymer of ethylene oxide and propylene oxide trademarked by Shell
[5]Sodium diethylenetriaminepentaacetate
[6]Material included with softening active by supplier.

Sources of Water in the Example 2 B Compositions

| Chemical | Prior Art Composition B | Claimed Concentrate B |
|---|---|---|
| DTPA | 0.015% | — |
| $MgCl_2$ | 4.068% | — |
| Dye | 0.1089% | 0.198% |
| Ethanol | 0.1544% | 0.2839% |
| Added DI Water | 39.77% | — |
| Total | 44.12% | 0.48% |

Additional examples of concentrated fabric softening compositions of the present invention are presented in the following table as examples 3 through 8.

| CHEMICAL | EXAMPLE 3 (wt %) | EXAMPLE 4 (wt %) | EXAMPLE 5 (wt %) | EXAMPLE 6 (wt %) | EXAMPLE 7 (wt %) | EXAMPLE 8 (wt %) |
|---|---|---|---|---|---|---|
| Softener Active (85%)[1] | 68.47 | 74.94 | 68.24 | 68.24 | 68.24 | 68.24 |
| TMPD | 8.32 | 9.12 | — | — | — | — |
| PLURONIC L-35 | 1.66 | 1.80 | — | — | — | — |
| MgCl2 | 2.92 | — | — | — | — | — |
| DTPA | 0.0164 | 0.0175 | — | — | — | — |
| PERFUME | 2.83 | 3.10 | 5.10 | 5.00 | 5.00 | 5.00 |
| NEODOL 91-8 | 10.00 | 10.90 | — | — | — | — |
| ADOGEN 417[2] | — | — | 26.67 | — | — | — |
| HEXYLENE GLYCOL | — | — | — | 26.76 | — | — |
| BUTYL CARBITOL[3] | — | — | — | — | 26.76 | — |
| 1,2-HEXANEDIOL | — | — | — | — | — | 26.76 |
| Water from MgCl2 | 5.67 | — | — | — | — | — |
| Water from DTPA | 0.1236 | 0.1325 | — | — | — | — |
| TOTAL | 100.0 | 100.0 | 100.0 | 100.0 | 100.0 | 100.0 |

[1]Di(acyloxyethyl)(2-hydroxy ethyl) methyl ammonium methyl sulfate wherein the acyl group is derived from partially hydrogenated canola fatty acid. Active contains about 7.5% hexylene glycol and 7.5% of ethanol solvent which is about 95% ethanol and about 5% water.
[2]Mono-oleyl trimethyl ammonium chloride
[3]Trademark for diethylene glycol monobutyl ether

| Chemical | Example 9 Wt % | Example 10 Wt % | Example 11 Wt % |
|---|---|---|---|
| Softener Active (85%)[1] | 75.08 | 77.087 | 87.565 |
| TMPD | 14.73 | — | — |
| Canola fatty acid | 1.84 | — | — |
| 1,4-CHDM | — | 7.174 | — |
| Neodol 91-8 | — | 6.696 | 7.606 |
| Cocoamide 6EO | 4.05 | — | — |
| Hexylene glycol | — | 4.783 | — |
| Perfume | 4.30 | 4.185 | 4.754 |
| Acid Blue 80 dye | 0.00075 | 0.00075 | 0.00075 |

[1]Di(acyloxyethyl)(2-hydroxy ethyl) methyl ammonium methyl sulfate wherein the acyl group is derived from partially hydrogenated canola fatty acid. Active contains about 7.5% hexylene glycol and 7.5% of ethanol solvent which is about 95% ethanol and about 5% water

EXAMPLE 12

| Component | % Active | Wt. % |
|---|---|---|
| Softener Active[1] | 85 | 63.62 |
| Canola fatty Acid | 100 | 1.84 |
| TMPD | 100 | 9.91 |
| Cocoamide EO6 | 100 | 4.03 |
| Perfume | 100 | 4.3 |
| Blue Dye | 1 | 0.0008 |
| DI Water | 100 | 5 |
| Hexylene Glycol (from softener active) | 100 | 5.61 |
| Ethanol (from softener active) | 100 | 5.61 |
| Total | | 100 |

-continued

| Component | % Active | Wt. % |
|---|---|---|
| Sources of Water: | | |
| Dye | | 0.0792 |
| Added Water | | 5.00 |
| Ethanol | | 0.28 |
| Total | | 5.36 |

This example had a closed cup flashpoint (Pensky-Martens) of 106° F.
[1]Di(acyloxyethyl)(2-hydroxy ethyl) methyl ammonium methyl sulfate wherein the acyl group is derived from partially hydrogenated canola fatty acid.

EXAMPLE 13

| Component | % Active | Wt. % |
|---|---|---|
| Softener Active[1] | 85 | 63.62 |
| Fatty Acid | 100 | 1.84 |
| TMPD | 100 | 14.68 |

-continued

| Component | % Active | Wt. % |
|---|---|---|
| Cocoamide EO6 | 100 | 4.03 |
| Perfume | 100 | 4.3 |
| Blue Dye | 1 | 0.003 |
| DI Water | 100 | 0 |
| Hexylene Glycol (from softener active) | 100 | 5.61 |
| Ethanol (from softener active) | 100 | 5.61 |
| Total | | 100 |
| Sources of Water: | | |
| Dye | | 0.297 |
| Added Water | | 0.00 |
| Ethanol | | 0.28 |
| Total | | 0.58 |

This example had a closed cup flashpoint (Pensky-Martens) of 98° F.
[1]Di(acyloxyethyl)(2-hydroxy ethyl) methyl ammonium methyl sulfate wherein the acyl group is derived from partially hydrogenated canola fatty acid.

EXAMPLE 14

| | (Wt %) |
|---|---|
| Softener Acitive (85%)[1] | 95.1 |
| Perfume | 4.9 |

[1]Di(acyloxyethyl)(2-hydroxy ethyl) methyl ammonium methyl sulfate wherein the acyl group is derived from partially hydrogenated canola fatty acid. Active contains about 7.5% hexylene glycol and 7.5% of ethanol solvent that is about 95% ethanol and about 5% water.

The following Viscosity Pour Test was developed to determine which highly concentrated fabric softener compositions would leave little or no residue in the softener dispenser drawer of a European style washing machine.

Preparation for Viscosity Pour Test

Place a 250 Pyrex Erlenmeyer flask on a balance. A ring stand with clamp should be positioned over the balance so that a funnel may be placed on the ring with the bottom stem of the funnel about 1.5 cm above the flask. An 8 oz Hutzler plastic funnel should be used. The mouth of the funnel is about 10.2 cm wide, its stem length is about 3.7 cm, the diameter of the stem at the bottom opening is about 0.8 cm, and the entire length of funnel from top to bottom is about 11.5 cm. The funnel cone has a 60° angle.

Procedure for Viscosity Pour Test

Prepare a 200 gram sample containing 20% deionized water (DI) and 80% test composition. Measure out 160 grams of product into a 250 ml Kimax Brand Graduated Griffin Beaker, and then pour 40 grams of DI water on top of the product. The product and DI water are both used at ambient temperature (72° F.). Immediately mix on a RW20 DZM Janke and Kunkel IKA-Werk mixer. Use a rounded edge, three-bladed propeller agitator that has a 13.9 inch shaft length. The blades are 1.4 cm (long)×1.6 cm (wide) with a 35° angle. The bottom of the agitator should be at the 50 ml mark and positioned vertically in the center of the beaker. Stir the mixture for 25 sec. at 305 rpms. Within 30 seconds or less after mixing, quickly pour all of the mixture through the funnel (using the design above set up prior to making the dilution) and time how long it takes for 180 grams of mixture to be poured through the funnel. Start the timer as soon as the fluid passes from the stem of funnel into the flask. For more viscous mixtures use a spatula to scrap the mixture from the beaker into the funnel. Record the time for 180 g to pass through the funnel. Times longer than 60 seconds are recorded as greater than 60 seconds.

Viscosity pour times for several examples described above were determined as follows.

| | Example | | | |
|---|---|---|---|---|
| | 9 | 10 | 11 | 14 |
| Viscosity Pour Time (seconds) | 4 | 5 | 20 | >60 |

The viscosity pour time of the compositions of the present invention by this test should be less than about 60 seconds, preferably less than about 30 seconds, more preferably less than about 20 seconds, and most preferably about 10 seconds or even less. Examples 9, 10 and 11 had short pour times and leave little or no residue in a European style washing machine dispenser drawer. Example 14 had a long pour time of greater than 60 seconds and is not acceptable.

Fabric Softening Articles

The materials and methods that may be used to manufacture the articles of the present invention are more fully described in U.S. Ser. No. 09/838,863 filed Apr. 20, 2001 by Caswell et al. The disclosure of that application is specifically incorporated herein by reference.

The articles of the present invention utilize a wide range of materials and processes to deliver a pre-measured or unitized amount of highly concentrated fabric softening composition to a laundry solution by dispensing in that solution an article containing an effective amount of a concentrated fabric softening composition as described above. The dose forms and articles of the present invention should be sufficiently water-soluble so that the materials of the articles will rapidly dissociate upon contact with water, thereby releasing the softening composition to the solution within the first several seconds and/or minutes of contact with the solution.

Specifically, in its most simplified form, an article of the present invention comprises a unitized amount a fabric softener active that is at least about 40%, more preferably at least 50%, and even more preferably at least about 65%, and most preferably at least about 75% by weight of the softening composition, and wherein the composition has less than about 20%, more preferably less than about 10% and even more preferably less than about 5%, and most preferably less than about 1%, water by weight of the composition, and having a coating, film, encapsulate or carrier material that is at least partially water-soluble .

As used herein, "unitized" refers to the amount of fabric softening active that should be delivered to a laundry solution to provide an effective amount of the softening active to a minimum volume of fabrics in a minimum volume of laundry solution, to thereby produce the desired softening effect. For loads containing larger volumes of fabrics, multiple units or doses of the fabric softening article may be needed to provide the desired softening effect.

The article of the present invention will have a weight between about 0.05 g and about 60 g, more preferably between about 2 g and about 40 g, and even more preferably between about 4 g and about 35 g. The articles should have at least one dimension (e.g. length, width, height, diameter etc.) that is less than about 15 mm when the articles are to be dispensed in the rinse bath with a dispenser. Although optional, it is preferred that the articles of the present invention have identification means to aid in the identification of articles that contain different actives, perfumes and that provide various benefits. Preferred identification means may include article features of color, odor, texture, opacity, pearlescence, size, shape, embossing, debossing, applied or printed markings and mixtures thereof.

The weight of the final article will depend on the amount of the highly concentrated fabric softening composition that is incorporated into the article. This in turn depends on the percentage and amount of fabric softening active in the composition as well as the amount of non-actives and optional ingredients that are present. When the softener active present is a less concentrated conventional composition such that the active is about 26% of the composition, approximately 35 ml of the composition should be used. When the softening active constitutes a higher concentration of compositions on the present invention, such as at least about 60%, or more preferably at least about 75% of the composition, a lesser volume of the composition is required to deliver an effective amount of the composition in the article. For instance, where the softening active comprises more than 50% of the composition, less than about 20 ml may be incorporated in the article, and more preferably when the softening active constitutes about 75% of the composition, about 14 ml of the composition may be included in the article. It is preferred that the articles of the present invention contain between about 2 ml and about 30 ml of a concentrated fabric softening composition.

Once dispensed in the laundry solution, the materials of the article should rapidly dissociate, dissolve and/or disintegrate in order to rapidly release the active or mixture of actives. The dissolution rate of the articles of the present invention should be rapid across a broad range of pH conditions so that the dissolution occurs rapidly in both the high pH solutions typically found in the wash and the relatively lower pH solutions (more neutral pH) typically found in the rinse. Further, the articles should rapidly dissociate across a broad range of temperature conditions. Specifically, it is preferred that the articles have a dissolution rate between about 0.05 min and about 5 min, and more preferably between about 0.05 min and 1 min in an aqueous bath at about 24° C. Similarly, in an aqueous bath at about 10° C., it is preferred that the articles dissolve in less than about 15 min., preferably less than about 10 min, more preferably less than about 5 min, even more preferably less than about 3 min and even still more preferably less than about 2 min. At about 4° C., it is preferred that the articles dissolve in less than about 15 min., preferably less than about 10 min, more preferably less than about 5 min, even more preferably less than about 3 min and even still more preferably less than about 2 min.

The concentrated fabric softening compositions may be dispensed to the laundry solution in a variety of forms including but not limited to solids, waxy solids, pastes, liquids, slurries, dispersions, gels, foams, sprays and aerosols. Further, these materials may be encapsulated, molded, compacted, coated or applied to a substrate to form a unitized article or dose form. A number of non-actives may optionally be included to facilitate the manufacture, processing, dispensing and dissociation of the composition through a variety of dose forms.

Solid forms of the articles will include or be comprised of powders, pellets, granules, tablets including but not limited to dimple tablets, bars, spheres, sticks, and virtually any other form that may be created through the use of compression or molding. Further, it is preferred that solid articles be sufficiently robust to withstand handling, packaging, and distribution without breakage, leakage or dusting prior to being dispensed in a laundry solution. It is preferred that the articles of the present invention will be in the form of a capsule, tablet, sphere or an encapsulate such as a pouch, pillow, sachet, bead, or envelope. Where the article is in the form of a tablet, it is preferred that the composition further comprise an effervescent composition to increase the dissolution rate of the tablet when it is dispensed into the rinse bath solution.

The coating, film, encapsulate or carrier materials that are preferred for the manufacture of the articles of the present invention include hard gelatins, soft gelatins, polyvinyl alcohols, polyvinyl pyrrolidone, hydroxypropyl methylcellulose, zeolites, waxy polymers such as polyethylene glycols, sugars, sugar derivatives, starches, starch derivatives, effervescing materials, and mixtures thereof. Optionally, but highly preferred is the use of a plasticizing agent the film of encapsulate material, between about 1% and about 50% by weight of the film or encapsulate material. Preferred plasticizing agents include 1,4 cyclohexanedimethanol, 1,2 hexanediol, 1,6 hexanediol, glycerine, sorbitol, polyethylene glycols, 1,2 propanediol, and mixtures thereof. It is also preferred that the film composition comprise a perfume, water-soluble dye, and one or more solid particulates.

When an encapsulated article is desired, these materials may be obtained in a film or sheet form that may be cut to a desired shape or size. Specifically, it is preferred that films of polyvinyl alcohol, hydroxypropyl methyl cellulose, methyl cellulose, non-woven polyvinyl alcohols, PVP and gelatins or mixtures be used to encapsulate the concentrated fabric softening compositions. Polyvinyl alcohol films are commercially available from a number of sources including Chris Craft Industrial Products Inc., of Gary, Ind., Nippon Synthetic Chemical Industry Co. Ltd. Of Osaka Japan, and Ranier Specialty Chemicals of Yakima, Wash. These films may be used in varying thicknesses ranging from about 20 to about 80 microns preferably between about 25 to at least about 76 microns. For purposes of the present invention, it is preferred to use a film having a thickness of about 25 to about 40 micrometers for rapid dissolution in cold water. Where larger volumes of composition are to be contained in encapsulate, volumes exceeding about 25 ml, a thicker film may be desired to provide additional strength and integrity to the encapsulate. Further, it is preferred that the water-soluble films be printable and colored as desired.

Encapsulate articles such as pouches, pillows, sachets, beads, or envelopes are easily manufactured by heat-sealing multiple sheets together at their edges, leaving an opening for inserting the fabric softening composition. This opening is then heat sealed after the softening composition has been introduced. The size of the film segments used will depend on the volume of composition to be encapsulated. Heat sealing is described as a preferred method for forming and sealing encapsulated articles of the present invention, but it should be recognized that the use of adhesives, mechanical bonding, and partially solvating the films are alternative preferred methods for forming encapsulated articles.

It is also anticipated that articles of the present invention will further comprise separate phases within the encapsulated article. These phases may include a second liquid phase or a gas or solid phase. The use of a second liquid phase is preferred for providing one or more of the optional fabric care actives or other optional materials that are described hereinabove. Likewise, the use of a gas phase is also preferred. The gas phase is preferably an inert gas such as nitrogen or may also include air. When present, the gas phase will constitute at least about 1%, preferably at least about 5% and more preferably at least about 10% of the volume of the encapsulate article.

To insure the stability of the articles during transport and storage, it is preferred that the compositions and articles of the present invention be packaged in humidity resistant materials. The packaging preferably has identification means as described above of use in identifying and distinguishing between articles. It is preferred that multiple similar or dissimilar articles will be packaged together, or may be assembled by the consumer at the point of purchase. Such kits may optionally include detergents, pre-treaters, stain removers, fabric care sprays, dryer-added sheets and bleaches for use in combination with the articles of the present invention. When combinations of these other fabric care agents are included in a kit or made available for assembly in a kit at the point of sale, it is preferred that these agents and the articles of the present invention have the same perfume or no perfume and be made available with a selection of perfumes to enable the consumer to select a fragrance that is most desired by the consumer. It is further anticipated and preferred that such kits will provide a set of instructions to aid the consumer in combining the elements of the kit to achieve improved performance. This set of instructions is preferably comprises written instructions, pictures, icons, other graphical elements and combinations thereof.

EXAMPLES 15 AND 16

The compositions identified in Examples 1 and 2 as Claimed Concentrates A and B were encapsulated in water-soluble pillows. The pillows were formed from polyvinyl alcohol films obtained from Chris Craft, film identification number E6030. This is an embossed polyvinyl alcohol film having a thickness of 25 micrometers. Data provides by Chris Craft indicates that the film will dissolve in 37 seconds in water at 10° C. and in 22 seconds in water at 24° C.

The film was cut into segments of about 4.5 cm×6 cm, 5 cm×5 cm and 16 cm×2 cm to make encapsulates having a variety of sizes. The edges of the films were heat sealed on at least three sides to form a pocket. Approximately, 14 ml of the concentrated softening compositions was filled into the pockets and the opening heat-sealed to close the encapsulate. The articles were dispensed into the rinse bath by placing them in the dispensing drawer of a conventional European washing machine. It was observed that as water was passed through the dispensing drawer, the encapsulates ruptured and began to disintegrate within 4 seconds in water at 24° C. and in 8 seconds in water at 10° C.

The fabrics treated with these highly concentrated compositions of the present invention were observed to have equal softness relative to existing liquid fabric softening compositions at equal softener active levels. Further, little or no staining or residue was observed on the fabrics. Still further, where the highly concentrated compositions contained an optional perfume active, a good freshness on dry fabrics was likewise observed.

Another useful fast dissolving polyvinyl alcohol (PVA) film for making articles of the present invention is KP-06 from Nippon Gohsei. The PVA is from about 71 to about 74 mol % hydrolyzed and has a viscosity of from about 5 to about 7 mPa·s (cPs). The viscosity is measured with a 4% PVA solution in water at 20° C. The preferred range of thickness for the KP-06 film is from about 20 mircons to about 60 microns.

A performance test was conducted with several PVA films for evaluate solubility and residues of fabric softening articles of the present invention in European (EU) washing machines by placing the article in the fabric softener dispenser drawer. The fabric softener composition was the same for each PVA film and is shown in Example 10.

PVA films were tested in 5 different European washing machines (40° C., short cycle, no load, 1200 rpm, one single wash). The articles were sachets and were hand-made in the lab by heat sealing (45×60 mm) and filled with 14 g of product.

| | Thickness | Film Residue in EU Washing Machine | | | | |
|---|---|---|---|---|---|---|
| Film | (μm) | Miele | Siemens | Zanussi | Bauknecht | Hotpoint |
| Aquafilm L330 | 38 | Residue | Residue | Residue | Residue | OK |
| Nippon Goshei KP-06 | 42 | Slight residue | Slight residue | OK | OK | OK |
| Nippon Goshei KP-06 | 62 | Slight residue | Slight residue | OK | OK | OK |
| Nippon Goshei KP-06 | 85 | Residue | Residue | Residue | Residue | OK |

Articles made with the Nippon Gohsei films at 42 microns and 62 microns thickness gave only a slight or no residue using several different EU washing machines.

EXAMPLE 17

An effervescent article containing the concentrated fabric softening compositions of the present invention was prepared by mixing sodium bicarbonate and citric acid together in a conventional mixer. Calcium chloride was then added with continued stirring of the mixture, followed by the addition of cornstarch. The mixture was stirred for an additional 5 minutes before a pre-mix containing the softening active, hexylene glycol and perfume was added to the mixer. This pre-mix was added slowly and stirring was continued for approximately 10 minutes after the addition of the pre-mix was complete. The mixture was then placed in molds to dry. A spray coating of witch hazel was then applied to the dried product.

The effeverscent articles made from this process contained 15.5% softening active, 4.14% hexylene glycol, 0.4% perfume, 33.6% sodium bicarbonate, 12% calcium chloride, 16% cornstarch, and 18.36% citric acid. When dispensed in a beaker of water at about 30° C. these articles were observed to disintegrate and disperse within about two to about three minutes.

All documents cited in the DETAILED DESCRIPTION OF THE INVENTION are, in relevant part, incorporated herein by reference; the citation of any document is not to be construed as an admission that it is prior art with respect to the present invention While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of treating fabric comprising the step of dispensing an article in a laundry solution, wherein the article comprises a film encapsulating a composition, wherein the film is at least partially water-soluble, and wherein the composition comprises from about 5% to about 20%, by weight of the composition, of a polydimethyl siloxane or derivative thereof.

2. The method according to claim 1, wherein the composition comprises polydimethyl silicone.

3. The method of claim 2, wherein the plasticizer is chosen from glycerin, or polyethylene glycol and comprises from 5% to about 50% by weight of the composition.

4. The method according to claim 1, wherein the film comprises a material chosen from a polyvinyl alcohol, polyvinyl pyrrolidine, hydropropyl methyl cellulose, methyl cellulose, non-woven polyvinyl alcohol, gelatin, polyethylene glycol, or mixture thereof.

5. The method of claim 4, wherein the film comprises a polyvinyl alcohol.

6. The method of claim 5, wherein the film comprises a thicknesses ranging from about 20 to about 80 microns.

7. The method of claim 1, wherein the article has a dissolving rate less than 1 minute in an aqueous bath at about 24° C.

8. The method of claim 1, wherein the article is packaged within humidity resistant materials.

9. The method of claim 1, wherein the composition further comprises from about 1% to about 50%, by weight of the composition, of a plasticizer.

10. The method of claim 9, wherein the derivative of the polydimethyl siloxane is an amino silicone or an ethoxylated silicone.

11. The method of claim 9, wherein the plasticizer is chosen from is chosen from 1,4 cyclohexanedimethanol, 1,2 hexanediol, 1,6 hexanediol, glycerin, sorbitol, polyethylene glycol, 1,2 propanediol, and mixture thereof.

12. The method of claim 11, wherein the plasticizer comprises glycerin.

13. The method of claim 12, wherein the plasticizer comprises from 1% to about 50% by weight of the composition.

14. The method of claim 11, wherein the plasticizer comprises polyethylene glycol.

15. The method of claim 13, wherein the plasticizer comprises from 5% to about 50% by weight of the composition.

16. The method of claim 11, wherein the plasticizer comprises from 1% to about 50% by weight of the composition.

17. The method of claim 16, wherein the plasticizer comprises from 5% to about 50% by weight of the composition.

18. The method of claim 9, wherein the plasticizer comprises from 1% to about 50% by weight of the composition.

19. The method of claim 18, wherein the plasticizer comprises from 5% to about 50% by weight of the composition.

20. The method of claim 1, wherein the composition further comprises from about 2% to about 20%, by weight of the composition, of water.

* * * * *